US007959824B2

(12) United States Patent
Tagawa et al.

(10) Patent No.: US 7,959,824 B2
(45) **Date of Patent: *Jun. 14, 2011**

(54) REFRIGERATING MACHINE OIL COMPOSITION

(75) Inventors: Kazuo Tagawa, Yokohama (JP); Katsuya Takigawa, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 451 days.

This patent is subject to a terminal disclaimer.

(21) Appl. No.: 10/565,739

(22) PCT Filed: Jul. 29, 2004

(86) PCT No.: PCT/JP2004/010840

§ 371 (c)(1),
(2), (4) Date: Sep. 25, 2006

(87) PCT Pub. No.: WO2005/012469

PCT Pub. Date: Feb. 10, 2005

(65) Prior Publication Data

US 2007/0032391 A1 Feb. 8, 2007

(30) Foreign Application Priority Data

Aug. 1, 2003 (JP) ..... P2003-285403
Aug. 1, 2003 (JP) ..... P2003-285409

(51) Int. Cl.
*C09K 5/00* (2006.01)
*C10M 141/00* (2006.01)
*C10M 169/04* (2006.01)
*C10M 105/34* (2006.01)

(52) U.S. Cl. ..... 252/68; 508/421; 508/583; 508/463

(58) Field of Classification Search ..... 508/421, 508/583, 459, 463; 252/68
See application file for complete search history.

(56) References Cited

U.S. PATENT DOCUMENTS 5,403,503 A * 4/1995 Seiki et al. ..... 508/440
6,228,282 B1 * 5/2001 Shimomura et al. ..... 252/68
7,595,286 B2 9/2009 Yokota et al.
2001/0038088 A1 * 11/2001 Schnur ..... 252/68
2002/0013233 A1 1/2002 Corr et al.
2007/0155635 A1 7/2007 Tagawa et al.

FOREIGN PATENT DOCUMENTS

| | | | |
|---|---|---|---|
| CN | 1349555 | A | 5/2002 |
| JP | 62-292895 | | 12/1987 |
| JP | 2-158693 | | 6/1990 |
| JP | 03-128992 | | 5/1991 |
| JP | 03-200895 | | 9/1991 |
| JP | H-03-505602 | | 12/1991 |
| JP | 5-059386 | | 3/1993 |
| JP | 06-100882 | | 4/1994 |
| JP | 06-31318O | | 11/1994 |
| JP | 08-48990 | | 2/1996 |
| JP | 08-209182 | | 8/1996 |
| JP | 10-168479 | | 6/1998 |
| JP | 2000-256692 | | 9/2000 |
| JP | 2002-38175 | | 2/2002 |
| JP | 2002-97486 | | 4/2002 |
| JP | 2002-194366 | | 7/2002 |
| JP | 2003-96481 | | 4/2003 |
| WO | WO 91/09097 | | 6/1991 |
| WO | WO 00/68345 | A1 | 11/2000 |
| WO | WO/01-02519 | | 1/2001 |
| WO | WO 01/48127 | A1 | 7/2001 |

OTHER PUBLICATIONS

International Search Report dated Oct. 22, 2004.
Office Action dated Mar. 12, 2010.

* cited by examiner

*Primary Examiner* — Glenn A Caldarola
*Assistant Examiner* — Vishal Vasisth
(74) *Attorney, Agent, or Firm* — Finnegan, Henderson, Farabow, Garrett & Dunner, LLP

(57) ABSTRACT

The refrigerating machine oil composition of the invention is characterized by comprising a prescribed base oil, a phosphorus-based extreme pressure agent and an oil agent. The refrigerating machine oil composition of the invention having this construction exhibits excellent lubricity for refrigerating/air conditioning devices employing refrigerants such as HFCs, and allows the refrigerating/air conditioning devices to be operated in a stable manner for prolonged periods.

10 Claims, No Drawings

REFRIGERATING MACHINE OIL COMPOSITION

This application is a 371 of PCT/JP04/10840, filed Jul., 29$^{th}$, 2004.

TECHNICAL FIELD

The present invention relates to a refrigerating machine oil composition for use in compressors of refrigerating/air conditioning devices.

BACKGROUND ART

With the shift from ozone layer-depleting chlorofluorocarbons toward refrigerant substitutes in accordance with the Montreal Protocol, much research is being carried out on refrigerating machine oils suitable for such refrigerant substitutes. Refrigerating machine oils used for hydrofluorocarbon (HFC) refrigerants, for example, include synthetic oils such as polyol esters and ethers, which are miscible with HFC refrigerants (for example, see Patent Documents 1-3).

[Patent Document 1] Japanese Patent Public Inspection HEI No. 3-505602

[Patent Document 2] Japanese Unexamined Patent Publication HEI No. 3-128992

[Patent Document 3] Japanese Unexamined Patent Publication HEI No. 3-200895

DISCLOSURE OF THE INVENTION

When such conventional refrigerating machine oils comprising oxygen-based synthetic oils are used, however, the lower lubricity of such refrigerating machine oils compared to that of mineral oil-based refrigerating machine oils, combined with the lower lubricity of refrigerant substitutes used with them compared to that of ozone layer-depleting chlorofluorocarbons, tends to contribute to unstable operation of the refrigerating/air conditioning device, and a shorter usable life of the apparatus.

The present invention has been accomplished in light of the aforementioned problems of the prior art, and its object is to provide a refrigerating machine oil composition which exhibits excellent lubricity for refrigerating/air conditioning devices employing refrigerants such as HFCs, and allows the refrigerating/air conditioning devices to be operated in a stable manner for prolonged periods.

In order to achieve this object, the invention provides a refrigerating machine oil composition comprising a prescribed base oil, a phosphorus-based extreme pressure agent and an ester-based additive.

By using a phosphorus-based extreme pressure agent in combination with an oil agent in the refrigerating machine oil composition of the invention, both the abrasion resistance and friction properties of the refrigerating machine oil composition are adequately enhanced, thereby allowing stable operation of the refrigerating/air conditioning device for prolonged periods even for use in combination with refrigerants such as HFCs.

Since the enhancing effect of the refrigerating machine oil composition of the invention on the abrasion resistance and friction properties also contributes to improved energy efficiency of the refrigerating/air conditioning device, it is also highly advantageous from the standpoint of energy saving and of reducing production costs for the refrigerating/air conditioning device. Specifically, reduction in abrasion and friction due to refrigerating machine oils in conventional refrigerating/air conditioning devices has not been adequately studied, and most attempts to improve abrasion resistance or friction properties have relied on modifying the hard components such as the compressor, since adverse effects by abrasion resistance enhancers or oil agents is a concern. However, the refrigerating machine oil composition of the invention adequately reduces the sliding load in the compressor due to its excellent abrasion resistance and friction properties, and it can therefore improve energy efficiency of refrigerating/air conditioning devices even without modifying hard components such as the compressor or heat exchanger. In addition, the enhancing effect on abrasion resistance and friction properties according to the invention allows low material grade sliding members, i.e. cheaper sliding members, to be used as the sliding members for the compressor, thereby realizing a cost reduction for the refrigerating/air conditioning device. Furthermore, by combining the refrigerating machine oil composition of the invention with an abrasion resistance-enhanced compressor or the like, it is possible to achieve a drastic improvement in energy efficiency.

The enhancing effect of the refrigerating machine oil composition of the invention on the abrasion resistance and friction properties is only obtained by using a phosphorus-based extreme pressure agent in combination with an oil agent, and the enhancing effect is remarkable compared to using either a phosphorus-based extreme pressure agent or an oil agent alone. For example, when an oil agent alone among the aforementioned additives is used in a refrigerating machine oil for an HFC-based refrigerant, the enhancing effect on abrasion resistance and friction properties is often inadequate, or in some cases the thermal-oxidative stability or the refrigerant atmosphere/low temperature anti-separation property of the refrigerating machine oil are impaired. When an extreme pressure agent such as a phosphorus-based compound is used alone, the friction properties are sometimes inferior. The refrigerating machine oil composition of the invention, on the other hand, allows these properties to be maintained at a high level.

The term "phosphorus-based extreme pressure agent" used according to the invention encompasses phosphorus-based additives such as phosphoric acid esters, acidic phosphoric acid esters, acidic phosphoric acid ester amines, chlorinated phosphoric acid esters and phosphorous acid esters, as well as phosphorothionates (thiophosphoric acid esters).

The phosphorus-based extreme pressure agent in the refrigerating machine oil composition of the invention preferably contains a phosphorothionate. Combination of a phosphorothionate with an oil agent will allow a satisfactory balance to be achieved with high levels of both abrasion resistance and friction properties of the refrigerating machine oil composition.

The phosphorus-based extreme pressure agent in the refrigerating machine oil composition of the invention preferably contains both a phosphorothionate and a phosphorus-based extreme pressure agent other than a phosphorothionate. The aforementioned effect of the invention will thereby be exhibited at an even higher level due to the synergistic effect of the phosphorothionate and the phosphorus-based extreme pressure agent other than the phosphorothionate, as well as the synergistic effect between each of the phosphorus-based extreme pressure agents and the oil agent, thereby providing further enhancement particularly of the friction properties.

The refrigerating machine oil composition of the invention preferably further contains an epoxy compound. Combination of a phosphorus-based extreme pressure agent, an oil agent and an epoxy compound will allow the aforementioned effect of the invention to be exhibited at an even higher level, and is effective particularly from the standpoint of further enhancing the friction properties.

The oil agent in the refrigerating machine oil composition of the invention preferably contains an ester oil agent. The aforementioned effect of the invention will thereby be exhibited at an even higher level due to the synergistic effect of the phosphorus-based extreme pressure agent and the ester oil agent.

The oil agent in the refrigerating machine oil composition of the invention preferably comprises at least one compound selected from among esters of monobasic acids and monohydric alcohols and esters of linear dibasic acids and monohydric alcohols, and more preferably it comprises at least one compound selected from among ≧C12 esters of monobasic acids and monohydric alcohols and esters of linear dibasic acids and monohydric alcohols. Using such an oil agent can further enhance the abrasion resistance and friction properties.

The oil agent in the refrigerating machine oil composition of the invention includes an ester oil agent, and the content of the ester oil agent is preferably 0.01-10 wt % based on the total weight of the composition. An ester oil agent content within this range will enhance not only the abrasion resistance and friction properties, but also the thermal-oxidative stability.

Preferably, the base oil in the refrigerating machine oil composition of the invention comprises at least one compound selected from among esters of polyhydric alcohols and monobasic fatty acids and esters of alicyclic dibasic acids and monohydric alcohols, and the oil agent comprises at least one compound selected from among esters of monobasic acids and monohydric alcohols and esters of linear dibasic acids and monohydric alcohols. Such a combination of an ester-based base oil and an ester oil agent can further enhance the abrasion resistance and friction properties, as well as the refrigerant atmosphere/low temperature anti-separation property.

By using the refrigerating machine oil composition of the invention it is possible to achieve excellent lubricity for refrigerating/air conditioning devices employing refrigerants such as HFCs, thus allowing refrigerating/air conditioning devices to be operated in a stable manner for prolonged periods.

BEST MODE FOR CARRYING OUT THE INVENTION

A preferred mode of the invention will now be explained in detail.

(Base Oil)

The base oil used for the invention may be a mineral oil or synthetic oil, or it may be a mixed-base oil comprising a mineral oil and a synthetic oil.

As examples of mineral oils there may be mentioned paraffin-based mineral oils or naphthene-based mineral oils obtained by applying an appropriate combination of one or more purifying means from among solvent deasphalting, solvent extraction, hydrocracking, solvent dewaxing, catalytic dewaxing, hydrorefining, sulfuric acid washing and clay treatment, to lube-oil distillates obtained by atmospheric distillation and vacuum distillation of paraffin base crude oils, intermediate base crude oils or naphthene base crude oils.

Among such mineral oils, it is preferred to use mineral oils which have been highly purified (hereinafter referred to as "highly purified mineral oils"), from the standpoint achieving superior thermal stability. As specific examples of highly purified mineral oils there may be mentioned purified oils obtained using ordinary methods to purify oil distillates prepared by atmospheric distillation of, or vacuum distillation of the oil residue from atmospheric distillation of, paraffin base crude oils, intermediate base crude oils or naphthene base crude oils; deep dewaxed oils obtained by further deep dewaxing treatment after purification; and hydrogenated oils obtained by hydrogenation treatment.

There are no particular restrictions on the purification method used for this purification step, and any conventional publicly known method may be employed; as examples, however, there may be mentioned (a) hydrogenation treatment, (b) dewaxing treatment (solvent dewaxing or hydrogenated dewaxing), (c) solvent extraction treatment, (d) alkali washing or sulfuric acid washing treatment and (e) clay treatment, either alone or in combinations of two or more in a suitable order. It is effective to repeatedly carry out a treatment from among treatments (a) to (e) above over multiple stages. More specifically, there may be mentioned (i) a method of hydrogenation treatment of the oil distillate or a method of hydrogenation treatment followed by alkali washing or sulfuric acid washing; (ii) a method of hydrogenation treatment of the oil distillate followed by dewaxing treatment; (iii) a method of solvent extraction of the oil distillate followed by hydrogenation treatment; (iv) a method of two-stage or three-stage hydrogenation treatment of the oil distillate, optionally followed by alkali washing or sulfuric acid washing treatment; and (v) any of the aforementioned methods (i) to (iv) followed by further dewaxing treatment to obtain a deep dewaxed oil.

Among highly purified mineral oils obtained by these purification methods, naphthene-based mineral oils and minerals oils obtained by deep dewaxing treatment are preferred from the standpoint of low-temperature flow properties and of preventing wax separation at low temperature. The deep dewaxing treatment will ordinarily be carried out by solvent dewaxing treatment under stringent conditions, or catalytic dewaxing treatment using a zeolite catalyst.

The non-aromatic unsaturated portion (degree of unsaturation) of the highly purified mineral oil is preferably no greater than 10 wt %, more preferably no greater than 5 wt %, even more preferably no greater than 1 wt % and most preferably no greater than 0.1 wt %.

A non-aromatic unsaturated portion of greater than 10 wt % will result in greater sludge production, which will tend to clog the expansion mechanisms such as capillaries of the refrigerant circulation system.

As synthetic oils to be used for the invention there may be mentioned hydrocarbon-based oils such as olefin polymers, naphthalene compounds and alkylbenzenes, and oxygen-containing synthetic oils such as esters, polyoxyalkylene glycols, polyvinyl ethers, ketones, polyphenyl ethers, silicones, polysiloxanes and perfluoroethers.

As olefin polymers there may be mentioned those obtained by polymerization of C2-12 olefins, as well as hydrogenated products of the compounds obtained by such polymerization, and preferred for use are polybutene, polyisobutene, C5-12 α-olefin oligomers (poly α-olefins), ethylene-propylene copolymers and hydrogenated products thereof.

There are no particular restrictions on the method of producing olefin polymers, and any of various publicly known methods may be employed. For example, poly α-olefins are produced by treatment of ethylene-derived α-olefin starting materials by publicly known polymerization methods such as Ziegler catalyst methods, radical polymerization methods, aluminum chloride methods, boron fluoride methods or the like.

There are no particular restrictions on the naphthalene compound so long as it includes a naphthalene skeleton, but from the standpoint of excellent miscibility with refrigerants, it is preferably one having one to four C1-10 alkyl groups, with a total of 1-10 carbon atoms of the alkyl groups, and is more preferably one having one to three C1-8 alkyl groups, with a total of 3-8 carbon atoms of the alkyl groups.

As specific examples of C1-10 alkyl groups for the naphthalene compound there may be mentioned methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl and straight-chain or branched decyl.

When a naphthalene compound is used, one compound with a specific structure may be used alone, or two or more compounds with different structures may be used in combination.

There are no particular restrictions on the method of producing the naphthalene compound, and any of various publicly known methods may be employed. As examples there may be mentioned a method wherein a C1-10 hydrocarbon halide, C2-10 olefin or C8-10 styrene is added to naphthalene in the presence of an acidic catalyst, e.g. a mineral acid such as sulfuric acid, phosphoric acid, tungstosilicic acid or hydrofluoric acid, a solid acidic substance such as acidic white clay or active white clay, or a metal halide Friedel-Crafts catalyst such as aluminum chloride or zinc chloride.

There are no particular restrictions on an alkylbenzene used for the invention, but from the standpoint of excellent miscibility with refrigerants it is preferably one having one to four C1-40 alkyl groups, with a total of 1-40 carbon atoms of the alkyl groups, and is more preferably one having one to four C1-30 alkyl groups, with a total of 3-30 carbon atoms of the alkyl groups.

As specific examples of C1-40 alkyl groups for the alkylbenzene compound there may be mentioned methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl, straight-chain or branched tetracosyl, straight-chain or branched pentacosyl, straight-chain or branched hexacosyl, straight-chain or branched heptacosyl, straight-chain or branched octacosyl, straight-chain or branched nonacosyl, straight-chain or branched triacontyl, straight-chain or branched hentriacontyl, straight-chain or branched dotriacontyl, straight-chain or branched tritriacontyl, straight-chain or branched tetratriacontyl, straight-chain or branched pentatriacontyl, straight-chain or branched hexatriacontyl, straight-chain or branched heptatriacontyl, straight-chain or branched octatriacontyl, straight-chain or branched nonatriacontyl and straight-chain or branched tetracontyl (including all isomers thereof).

Although the aforementioned alkyl groups may be straight-chain or branched, they are preferably straight-chain alkyl groups from the standpoint of miscibility with organic materials used in the refrigerant circulation system. From the standpoint of refrigerant miscibility, thermal stability and lubricity, however, branched alkyl groups are preferred, while from the standpoint of availability, branched alkyl groups derived from oligomers of olefins such as propylene, butene and isobutylene are more preferred.

When an alkylbenzene is used, one compound with a specific structure may be used alone, or two or more compounds with different structures may be used in combination.

Any alkylbenzene production process may be employed with no restrictions whatsoever, and the synthesis method outlined below may be set forth as an example.

As aromatic starting compounds there may be used, specifically, benzene, toluene, xylene, ethylbenzene, methylethylbenzene, diethylbenzene, and mixtures thereof. As alkylating agents there may be used C6-40 straight-chain or branched olefins obtained by polymerization of lower monoolefins such as ethylene, propylene, butene or isobutylene (preferably propylene); C6-40 straight-chain or branched olefins obtained by thermal decomposition of waxes, heavy oils, petroleum fractions, polyethylene, polypropylene and the like; C9-40 straight-chain olefins obtained by separation of n-paraffin from petroleum fractions such as kerosene and light oil, and olefination thereof with a catalyst; as well as mixtures of these.

The reaction between the aforementioned aromatic compound and alkylating agent may be conducted using a conventional publicly known alkylation catalyst, e.g. a Friedel-Crafts catalyst such as aluminum chloride or zinc chloride, or an acidic catalyst such as sulfuric acid, phosphoric acid, tungstosilicic acid, hydrofluoric acid, or acidic white clay.

Examples of esters include aromatic esters, dibasic acid esters, polyol esters, complex esters, carbonic acid esters, and mixtures thereof.

As aromatic esters there may be mentioned esters of monobasic to hexabasic, preferably dibasic to tetrabasic and more preferably monobasic to tribasic aromatic carboxylic acids with C1-18 and preferably C1-12 aliphatic alcohols. As specific monobasic to hexabasic aromatic carboxylic acids there may be mentioned benzoic acid, phthalic acid, isophthalic acid, terephthalic acid, trimellitic acid, pyromellitic acid, and mixtures thereof. The C1-18 aliphatic alcohols may be straight-chain or branched, and specifically there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, and mixtures thereof.

As specific aromatic esters obtained using the aforementioned aromatic compounds and aliphatic alcohols there may be mentioned dibutyl phthalate, di(2-ethylhexyl) phthalate, dinonyl phthalate, didecyl phthalate, didodecyl phthalate, ditridecyl phthalate, tributyl trimellitate, tri (2-ethylhexyl) trimellitate, trinonyl trimellitate, tridecyl trimellitate, tridodecyl trimellitate and tritridecyl trimellitate. Needless to mention, when a dibasic or greater aromatic carboxylic acid is used, the ester may be a simple ester comprising one type of aliphatic alcohol, or it may be a complex ester comprising two or more different aliphatic alcohols.

As dibasic acid esters there are preferably used esters of C5-10 linear or cyclic aliphatic dibasic acids such as glutaric acid, adipic acid, pimelic acid, suberic acid, azelaic acid, sebacic acid, 1,2-cyclohexanedicarboxylic acid and 4-cyclohexene-1,2-dicarboxylic acid, with straight-chain or branched C1-15 monohydric alcohols such as methanol, ethanol, propanol, butanol, pentanol, hexanol, heptanol, octanol, nonanol, decanol, undecanol, dodecanol, tridecanol, tetradecanol and pentadecanol, as well as mixtures thereof, among which there may be mentioned specifically ditridecyl glutarate, di-2-ethylhexyl adipate, diisodecyl adipate, ditridecyl adipate, di-2-ethylhexyl sebacate, diesters of 1,2-cyclohexanedicarboxylic acid with C4-9 monohydric alcohols, diesters of 4-cyclohexene-1,2-dicarboxylic acid with C4-9 monohydric alcohols, and mixtures thereof.

As polyol esters to be used there are preferred esters of C6-20 fatty acids with diols or with polyols containing 3-20 hydroxyl groups. As specific diols there may be mentioned ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol. As specific polyols there may be mentioned polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (2-20 mers of glycerin), 1,3,5-pentanetriol, sorbitol, sorbitan, sorbitol glycerin condensate, adonitol, arabitol, xylitol and mannitol, sugars such as xylose, arabinose, ribose, rhamnose, glucose, fructose, galactose, mannose, sorbose, cellobiose, maltose, isomaltose, trehalose, sucrose, raffinose, gentianose and melezitose and their partial etherified products, as well as methylglucoside. Preferred polyols among these are hindered alcohols such as neopentyl glycol, trimethylolethane, trimethylolpropane, trimethylolbutane, di-(trimethylolpropane), tri-(trimethylolpropane), pentaerythritol, di-(pentaerythritol) and tri-(pentaerythritol).

There are no particular restrictions on the number of carbon atoms in the fatty acid used in the polyol ester, but ordinarily a C1-24 fatty acid will be used. Among C1-24 fatty acids, from the standpoint of lubricity, those having 3 or more carbon atoms are preferred, those having 4 or more carbon atoms are more preferred, those having 5 or more carbon atoms are even more preferred, and those having 10 or more carbon atoms are especially preferred. From the standpoint of miscibility with refrigerants, those with no greater than 18 carbon atoms are preferred, those with no greater than 12 carbon atoms are more preferred, and those with no greater than 9 carbon atoms are even more preferred.

Such fatty acids may be either straight-chain fatty acids or branched fatty acids, but straight-chain fatty acids are preferred from the standpoint of lubricity, while branched fatty acids are preferred from the standpoint of hydrolytic stability. The fatty acids may be either saturated fatty acids or unsaturated fatty acids.

As specific fatty acids there may be mentioned pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, eicosanoic acid and oleic acid, and the fatty acids may be either straight-chain fatty acids or branched fatty acids, and may also be fatty acids wherein the α-carbon atom is a quaternary carbon atom (neo acids). Preferred for use among these are valeric acid (n-pentanoic acid), caproic acid (n-hexanoic acid), enanthic acid (n-heptanoic acid), caprylic acid (n-octanoic acid), pelargonic acid (n-nonanoic acid), capric acid (n-decanoic acid), oleic acid (cis-9-octadecenoic acid), isopentanoic acid (3-methylbutanoic acid), 2-methylhexanoic acid, 2-ethylpentanoic acid, 2-ethylhexanoic acid and 3,5,5-trimethylhexanoic acid.

A polyol ester used for the invention may be a partial ester wherein a portion of the hydroxyl groups of the polyol remain unesterified, so long as it has at least two ester groups, or it may be a complete ester wherein all of the hydroxyl groups are esterified, or even a mixture of a partial ester and a complete ester, but complete esters are preferred.

Complex esters are esters of fatty acids and dibasic acids with monohydric alcohols and polyols, and such fatty acids, dibasic acids, monohydric alcohols and polyols used may be the same fatty acids, dibasic acids, monohydric alcohols and polyols mentioned above for the dibasic acid ester and polyol ester.

A carbonic acid ester is a compound having a carbonic acid ester bond represented by the following formula (1) in the molecule:

$$—O—CO—O— \quad (1)$$

The number of carbonic acid ester bonds represented by formula (1) may be one, two or more per molecule.

As alcohols forming the carbonic acid ester there may be used monohydric alcohols and polyols mentioned above for dibasic acid esters and polyol esters, as well as polyglycols and polyglycol-added polyols. There may also be used compounds obtained from carbonic acid and fatty acids and/or dibasic acids.

Needless to mention, when an ester is used, one compound with a specific structure may be used alone, or two or more compounds with different structures may be used in combination.

Among the esters mentioned above, dibasic acid esters, polyol esters and carbonic acid esters are preferred from the standpoint of excellent miscibility with refrigerants.

More preferred among dibasic acid esters are alicyclic dicarboxylic acid esters such as 1,2-cyclohexanedicarboyxlic acid and 4-cyclohexene-1,2-dicarboxylic acid, from the standpoint of miscibility with refrigerants and thermal/hydrolytic stability.

As specific examples of dibasic acid esters which are preferably used for the invention, there may be mentioned dibasic acid esters obtained from one or more monohydric alcohols selected from the group consisting of butanol, pentanol, hexanol, heptanol, octanol and nonanol, and one or more dibasic acids selected from the group consisting of 1,2-cyclohexanedicarboxylic acid and 4-cyclohexene-1,2-dicarboxylic acid, as well as mixtures thereof.

Two or more different monohydric alcohols are preferably used to form a dibasic acid ester according to the invention, as this will tend to improve the low temperature property and refrigerant miscibility of the refrigerating machine oil composition. Dibasic acid esters composed of two or more monohydric alcohols include mixtures of two or more different esters of a dibasic acid and one type of alcohol, and esters of a dibasic acid and two or more different mixed alcohols.

More preferred among polyol esters for their excellent hydrolytic stability are esters of hindered alcohols such as neopentyl glycol, trimethylolethane, trimethylolpropane, trimethylolbutane, di-(trimethylolpropane), tri-(trimethylolpropane), pentaerythritol and di-(pentaerythritol) and tri-(pentaerythritol), with esters of neopentyl glycol, trimethylolethane, trimethylolpropane, trimethylolbutane and pentaerythritol being more preferred, and esters of pentaerythritol being most preferred for their excellent refrigerant stability and hydrolytic stability.

As specific examples of polyol esters preferred used according to the invention there may be mentioned diesters, triesters and tetraesters obtained from one or more types of fatty acids selected from the group consisting of valeric acid, caproic acid, enanthic acid, caprylic acid, pelargonic acid, capric acid, oleic acid, isopentanoic acid, 2-methylhexanoic acid, 2-ethylpentanoic acid, 2-ethylhexanoic acid and 3,5,5-trimethylhexanoic acid, and one or more types of alcohols selected from the group consisting of neopentyl glycol, trimethylolethane, trimethylolpropane, trimethylolbutane and pentaerythritol, as well as mixtures thereof.

Two or more different fatty acids preferably form the polyol ester according to the invention, as this will tend to improve the low temperature property and refrigerant miscibility of the refrigerating machine oil composition. Polyol esters composed of two or more fatty acids include mixtures of two or more different esters of a polyol and one type of fatty acid, and esters of a polyol and two or more different mixed fatty acids.

Preferred among carbonic acid esters are those having the structure represented by the following general-formula (2):

$$(X^1O)_b—B—[O-(A^1O)_c—CO—O-(A^2O)_d—Y^1]_a \quad (2)$$

[wherein $X^1$ is hydrogen, alkyl, cycloalkyl or a group represented by the following general formula (3):

$$Y^2—(OA^3)_e- \quad (3)$$

(wherein $Y^2$ represents hydrogen, alkyl or cycloalkyl, $A^3$ represents C2-4 alkylene, and e represents an integer of 1-50), $A^1$ and $A^2$ may be the same or different and each represents C2-4 alkylene, $Y^1$ represents hydrogen, alkyl or cycloalkyl, B represents the residue of a compound having 3-20 hydroxyl groups, a represents 1-20, b represents 0-19 (a+b representing an integer of 3-20), c represents an integer of 0-50, and d represents an integer of 1-50]

In formula (2) above, $X^1$ represents hydrogen, alkyl, cycloalkyl or a group represented by formula (3) above. The number of carbon atoms of the alkyl group here is not particularly restricted, but will normally be 1-24, preferably 1-18 and more preferably 1-12. The alkyl group may be either straight-chain or branched.

As specific C1-24 alkyl groups there may be mentioned methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl and straight-chain or branched tetracosyl.

As specific cycloalkyl groups there may be mentioned cyclopentyl, cyclohexyl and cycloheptyl.

As C2-4 alkylene groups represented by $A^3$ in formula (2) above there may be mentioned specifically ethylene, propylene, trimethylene, butylene, tetramethylene, 1-methyltrimethylene, 2-methyltrimethylene, 1,1-dimethylethylene and 1,2-dimethylethylene.

$Y^2$ in formula (2) above represents hydrogen, alkyl or cycloalkyl. The number of carbon atoms of the alkyl group here is not particularly restricted, but will normally be 1-24, preferably 1-18 and more preferably 1-12. The alkyl group may be either straight-chain or branched. As C1-24 alkyl groups there may be mentioned the alkyl groups mentioned above for $X^1$.

As specific examples of cycloalkyl groups there may be mentioned cyclopentyl, cyclohexyl and cycloheptyl.

Among the groups represented by $Y^2$ there are preferred hydrogen and C1-12 alkyl, with hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl or iso-dodecyl being more preferred. Also, e represents an integer of 1-50.

As groups represented by $X^1$ there are preferred hydrogen, C1-12 alkyl or groups represented by general formula (3) above, with hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl, iso-dodecyl or groups represented by general formula C3) being more preferred.

As specific compounds having B as a residue and containing 3-20 hydroxyl groups there may be mentioned the polyols referred to above.

$A^1$ and $A^2$ may be the same or different and each represents a C2-4 alkylene group. As specific alkylene groups there may be mentioned ethylene, propylene, trimethylene, butylene, tetramethylene, 1-methyltrimethylene, 2-methyltrimethylene, 1,1-dimethylethylene and 1,2-dimethylethylene.

$Y^1$ represents hydrogen, alkyl or cycloalkyl. The number of carbon atoms of the alkyl group here is not particularly restricted, but will normally be 1-24, preferably 1-18 and more preferably 1-12. The alkyl group may be either straight-chain or branched. As C1-24 alkyl groups there may be mentioned the alkyl groups mentioned above for $X^1$.

As specific cycloalkyl groups, there may be mentioned cyclopentyl, cyclohexyl and cycloheptyl.

Among the groups represented by $Y^1$ there are preferred hydrogen and C1-12 alkyl, with hydrogen, methyl, ethyl, n-propyl, iso-propyl, n-butyl, iso-butyl, sec-butyl, tert-butyl, n-pentyl, iso-pentyl, neo-pentyl, n-hexyl, iso-hexyl, n-heptyl, iso-heptyl, n-octyl, iso-octyl, n-nonyl, iso-nonyl, n-decyl, iso-decyl, n-undecyl, iso-undecyl, n-dodecyl or iso-dodecyl being more preferred.

In formulas (2) and (3) above, c, d and e represent the polymerization degree of the polyoxyalkylene chain, and the polyoxyalkylene chains in the molecule may be the same or different. When the carbonic acid ester represented by formula (2) has different polyoxyalkylene chains, there are no particular restrictions on the form of polymerization of the oxyalkylene groups, and they may be randomly copolymerized or block copolymerized.

The carbonic acid ester used for the invention may be obtained by any production process, and for example, it may be obtained by addition of an alkylene oxide to a polyol compound to produce a polyalkyleneglycol polyolether, and then reacting this with a chloroformate at 0-30° C. in the presence of an alkali, e.g. an alkali metal hydroxide such as sodium hydroxide or potassium hydroxide, an alkali metal alkoxide such as sodium methoxide or sodium ethoxide, or metallic sodium. Alternatively, it may be obtained by reacting a polyalkyleneglycol polyolether with a carbonic acid source such as a carbonic acid diester or phosgene, at 80-150° C. in the presence of an alkali, e.g. an alkali metal hydroxide such as sodium hydroxide or potassium hydroxide, an alkali metal alkoxide such as sodium methoxide or sodium ethoxide, or metallic sodium. If necessary, the free hydroxyl groups may then be etherified.

The product obtained from the aforementioned starting materials may be purified to remove by-products or unreacted substances, but there is no problem with the presence of small amounts of by-products or unreacted substances so long as they do not inhibit the excellent performance of the lubricating oil of the invention.

When a carbonic acid ester according to the invention is used, one compound with a specific structure may be used alone, or two or more compounds with different structures may be used in combination. The molecular weight of the carbonic acid ester of the invention is not particularly restricted, but from the standpoint of further improving the seal property of the compressor, the number average molecular weight is preferably 200-4000 and more preferably 300-3000. The kinematic viscosity of the carbonic acid ester of the invention at 100° C. is preferably 2-150 $mm^2/s$ and more preferably 4-100 $m^2/s$.

As examples of polyoxyalkylene glycols to be used in the lubricating oil of the invention there may be mentioned compounds represented by the following general formula (4):

$$R^1—[(OR^2)_f—OR^3]_g \quad (4)$$

[wherein $R^1$ represents hydrogen, C1-10 alkyl, C2-10 acyl or the residue of a compound having 2-8 hydroxyl groups, $R^2$ represents C2-4 alkylene, $R^3$ represents hydrogen, C1-10 alkyl or C2-10 acyl, f represents an integer of 1-80, and g represents an integer of 1-8].

In general formula (4), the alkyl groups represented by $R^1$ and $R^3$ may be straight-chain, branched or cyclic. As specific examples of alkyl groups there may be mentioned methyl, ethyl, n-propyl, isopropyl, straight-chain or branched butyl, straight-chain or branched pentyl, straight-chain or branched hexyl, straight-chain or branched heptyl, straight-chain or branched octyl, straight-chain or branched nonyl, straight-chain or branched decyl, cyclopentyl and cyclohexyl. If the alkyl group contains more than 10 carbon atoms, the refrigerant miscibility will be reduced and phase separation will tend to occur. The preferred number of carbon atoms in the alkyl group is 1-6.

The alkyl group portion of an acyl group represented by $R^1$ and $R^3$ may be straight-chain, branched or cyclic. As specific examples of alkyl portions for acyl groups there may be mentioned the C1-9 alkyl groups among those mentioned above as examples of alkyl groups. If the acyl group contains more than 10 carbon atoms, the refrigerant miscibility will be reduced and phase separation may occur. The preferred number of carbon atoms in the acyl group is 2-6.

When the groups represented by $R^1$ and $R^3$ are both alkyl, or when they are both acyl, the groups represented by $R^1$ and $R^3$ may be the same or different. Also, when g is 2 or greater, the groups represented by $R^1$ and $R^3$ in the same molecule may be the same or different.

When the group represented by $R^1$ is the residue of a compound having 2-8 hydroxyl groups, the compound may be either linear or cyclic. As specific compounds with two hydroxyl groups there may be mentioned ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol and 1,12-dodecanediol.

As specific compounds with 3-8 hydroxyl groups there may be mentioned polyhydric alcohols such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (2-6 mers of glycerin), 1,3,5-pentanetriol, sorbitol, sorbitan, sorbitol glycerin condensate, adonitol, arabitol, xylitol and mannitol, sugars such as xylose, arabinose, ribose, rhamnose, glucose, fructose, galactose, mannose, sorbose, cellobiose, maltose, isomaltose, trehalose, sucrose, raffinose, gentianose and melezitose, as well as their partial etherified products, and methylglucoside.

Among the polyoxyalkylene glycols represented by general formula (4) above, there are preferred those wherein at least one of $R^1$ and $R^3$ is an alkyl group (more preferably a C-14 alkyl group), and especially methyl, from the standpoint of refrigerant miscibility. From the standpoint of thermal and chemical stability, $R^1$ and $R^3$ are both preferably alkyl groups (more preferably C1-4 alkyl groups), and most preferably both are methyl. From the standpoint of production ease and cost, preferably at least one of $R^1$ and $R^3$ is an alkyl group (more preferably a C1-4 alkyl group) and the other is hydrogen, and most preferably one is methyl and the other is hydrogen.

$R^2$ in general formula (4) above represents C2-4 alkylene, and as specific alkylene groups there may be mentioned ethylene, propylene and butylene. As oxyalkylene groups for the repeating unit represented by $OR^2$ there may be mentioned oxyethylene, oxypropylene and oxybutylene. The oxyalkylene groups in the same molecule may be the same, or the molecule may contain two or more different oxyalkylene groups.

Among the polyoxyalkylene glycols represented by general formula (4), copolymers comprising oxyethylene (EO) and oxypropylene (PO) are preferred from the standpoint of refrigerant miscibility and viscosity-temperature properties, in which case the proportion of oxyethylene in the total of the oxyethylene and oxypropylene (EO/(PO+EO)) is preferably in the range of 0.1-0.8, and more preferably in the range of 0.3-0.6, from the standpoint of seizure load and viscosity-temperature properties.

From the standpoint of hygroscopicity and thermal-oxidative stability, the value of EO/(PO+EO) is preferably in the range of 0-0.5, more preferably in the range of 0-0.2 and most preferably zero (i.e. a propylene oxide homopolymer).

In general formula (4) above, f represents an integer of 1-80, and g represents an integer of 1-8. When $R^7$ is alkyl or acyl, for example, g is 1. When $R^7$ is the residue of a compound with 2-8 hydroxyl groups, g is the number of hydroxyl groups in the compound.

There are no particular restrictions on the product of f and g (f×g), but the average value of f×g is preferably 6-80 in order to provide a satisfactory balance for the required performance as a refrigerating machine lubricating oil.

Among polyoxyalkylene glycols having the structure described above, polyoxypropyleneglycol dimethyl ether represented by the following general formula (5):

$$CH_3O—(C_3H_6O)_h—CH_3 \quad (5)$$

(wherein h represents an integer of 6-80)

and polyoxyethylenepolyoxypropyleneglycol dimethyl ether represented by the following general formula (6):

$$CH_3O—(C_2H_4O)_i—(C_3H_6O)_j—CH_3 \quad (6)$$

(wherein i and j are each 1 or greater and the total of i and j is 6-80)

are preferred from the standpoint of economy and the effect described above, while polyoxypropyleneglycol monobutyl ether represented by the following general formula (7):

$$C_4H_9O—(C_3H_6O)_k—H \quad (7)$$

(wherein k represents an integer of 6-80), polyoxypropyleneglycol monomethyl ether represented by the following general formula (8):

$$CH_3O—(C_3H_6O)_l—H \quad (8)$$

(wherein l represents an integer of 6-80), polyoxyethylenepolyoxypropyleneglycol monomethyl ether represented by the following general formula (9):

$$C_3H_3O—(C_2H_4O)_m—(C_3H_6O)_n—H \quad (9)$$

(wherein m and n are each 1 or greater and the total of m and n is 6-80), polyoxyethylenepolyoxypropyleneglycol monobutyl ether represented by the following general formula (10):

$$C_4H_9O—(C_2H_4O)_m—(C_3H_6O)_n—H \quad (10)$$

(wherein m and n are each 1 or greater and the total of m and n is 6-80), and polyoxypropylene glycol diacetate represented by the following general formula (11):

$$CH_3COO—(C_3H_6O)_1—COCH_3 \quad (11)$$

(wherein l represents an integer of 6-80) are preferred from the standpoint of economy.

As the aforementioned polyoxyalkylene glycols of the invention, there may be used polyoxyalkylene glycol derivatives comprising at least one structural unit represented by general formula (12):

[Chemical Formula 1]

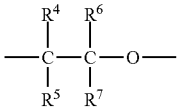

(12)

[wherein $R^4$-$R^7$ may be the same or different and each represents hydrogen, a C1-10 monovalent hydrocarbon group or a group represented by the following general formula (13):

[Chemical Formula 2]

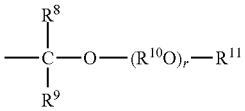

(13)

(wherein $R^8$ and $R^9$ may be the same or different and each represents hydrogen, a C1-10 monovalent hydrocarbon group or C2-20 alkoxyalkyl, $R^{10}$ represents C2-5 alkylene, substituted alkylene having alkyl as a substituent and comprising a total of 2-5 carbon atoms, or substituted alkylene having alkoxyalkyl as a substituent and comprising 4-10 carbon atoms, r represents an integer of 0-20, and $R^{13}$ represents a C1-10 monovalent hydrocarbon group), and at least one from among $R^8$-$R^{11}$ is a group represented by general formula (13)].

In formula (12) above, $R^4$-$R^7$ each represents hydrogen, a C1-10 monovalent hydrocarbon group or a group represented by general formula (13) above, and as specific C1-10 monovalent hydrocarbon groups there may be mentioned C1-10 straight-chain or branched alkyl, C2-10 straight-chain or branched alkenyl, C5-10 cycloalkyl or alkylcycloalkyl, C6-10 aryl or alkylaryl and C7-10 arylalkyl. Preferred among these monovalent hydrocarbon groups are ≦C6 monovalent hydrocarbon groups, and especially ≦C3 alkyl, with methyl, ethyl, n-propyl and isopropyl being specifically preferred.

In general formula (13) above, $R^8$ and $R^9$ each represent hydrogen, a C1-10 monovalent hydrocarbon group or C2-20 alkoxyalkyl, among which ≦C3 alkyl and ≦C6 alkoxyalkyl groups are preferred. As specific ≦C3 alkyl groups there may be mentioned methyl, ethyl, n-propyl and isopropyl. As specific C2-6 alkoxyalkyl groups there may be mentioned methoxymethyl, ethoxymethyl, n-propoxymethyl, isopropoxymethyl, n-butoxymethyl, isobutoxymethyl, sec-butoxymethyl, tert-butoxymethyl, pentoxymethyl (including all isomers thereof), methoxyethyl (including all isomers thereof), ethoxyethyl (including all isomers thereof), propoxyethyl (including all isomers thereof), butoxyethyl (including all isomers thereof), methoxypropyl (including all isomers thereof), ethoxypropyl (including all isomers thereof), propoxypropyl (including all isomers thereof), methoxybutyl (including all isomers thereof), ethoxybutyl (including all isomers thereof) and methoxypentyl (including all isomers thereof).

In general formula (13) above, $R^{10}$ represents C2-5 alkylene, substituted alkylene having alkyl as a substituent and comprising a total of 2-5 carbon atoms, or substituted alkylene having alkoxyalkyl as a substituent and comprising 4-10 carbon atoms, and preferably it represents C2-4 alkylene or substituted ethylene having a total of no more than 6 carbon atoms. As specific C2-4 alkylene groups there may be mentioned ethylene, propylene, butylene. As specific substituted ethylene groups having a total of no more than 6 carbon atoms there may be mentioned 1-(methoxymethyl)ethylene, 2-(methoxymethyl) ethylene, 1-(methoxyethyl) ethylene, 2-(methoxyethyl)ethylene, 1-(ethoxymethyl)ethylene, 2-(ethoxymethyl)ethylene, 1-methoxymethyl-2-methylethylene, 1,1-bis(methoxymethyl)ethylene, 2,2-bis(methoxymethyl)ethylene, 1,2-bis(methoxymethyl)ethylene, 1-methyl-2-methoxymethylethylene, 1-methoxymethyl-2-methylethylene, 1-ethyl-2-methoxymethylethylene, 1-methoxymethyl-2-ethylethylene, 1-methyl-2-ethoxymethylethylene, 1-ethoxymethyl-2-methylethylene, 1-methyl-2-methoxyethylethylene and 1-methoxyethyl-2-methylethylene.

In general formula (13), $R^{11}$ represents a C1-10 monovalent hydrocarbon group, and as such hydrocarbon groups there may be mentioned specifically C1-10 straight-chain or branched alkyl, C2-10 straight-chain or branched alkenyl, C5-10 cycloalkyl or alkylcycloalkyl, C6-10 aryl or alkylaryl and C7-10 arylalkyl. Preferred among these are ≦C6 monovalent hydrocarbon groups and especially ≦C3 alkyl groups, with methyl, ethyl, n-propyl and isopropyl being specifically preferred.

In general formula (12), at least one from among $R^4$ -$R^7$ is a group represented by general formula (13) above. In particular, preferably either $R^4$ or $R^6$ is a group represented by general formula (13) and the other $R^4$ or $R^6$, as well as $R^5$ and $R^7$, is each hydrogen or a C1-10 monovalent hydrocarbon group.

Polyoxyalkylene glycols having a structural unit represented by general formula (12) above which are preferred for use according to the invention may be largely classified into three types: homopolymers comprising a structural unit represented by general formula (12); copolymers comprising two or more structural units represented by general formula (12) and having different structures; and copolymers comprising a structural unit represented by general formula (12) and another structural unit, for example, a structural unit represented by the following general formula (14):

[Chemical Formula 3]

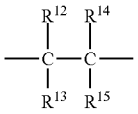

(14)

[wherein $R^{12}$-$R^{15}$ may be the same or different and each represents hydrogen or C1-3 alkyl].

As preferred examples of the aforementioned homopolymers there may be mentioned homopolymers having 1-200 structural units A represented by general formula (12) and comprising hydroxyl, C1-10 acyloxy, C1-10 alkoxy or aryloxy groups as terminal groups. As preferred examples of copolymers there may be mentioned copolymers having 1-200 each of two different structural units A and B represented by general formula (12), or having 1-200 structural units A represented by general formula (12) and 1-200 structural units C represented by general formula (12), and comprising hydroxyl, C1-10 acyloxy, C1-10 alkoxy or aryloxy groups as terminal groups. Such copolymers may have a polymerization form of alternating copolymerization, random copolymerization or block copolymerization of structural unit A and structural unit B (or structural unit C), or may be graft copolymers of structural unit B grafted onto a main chain of structural unit A.

As examples of polyvinyl ethers to be used for the invention there may be mentioned polyvinyl ether-based compounds having a structural unit represented by the following general formula (15):

[Chemical Formula 4]

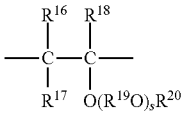

(15)

[wherein $R^{16}$-$R^{18}$ may be the same or different and each represents hydrogen or a C1-8 hydrocarbon group, $R^{19}$ represents a C1-10 divalent hydrocarbon group or C2-20 divalent ether-bonded oxygen-containing hydrocarbon group, $R^{20}$ represents a C1-20 hydrocarbon group, s represents an integer whose average is 0-10, $R^{16}$-$R^{20}$ may be the same or different for each structural unit, and when the structural unit represented by general formula (15) has multiple $R^{19}O$ groups, the multiple $R^{19}O$ groups may be the same or different].

There may also be used polyvinyl ether-based compounds comprising block copolymers or random copolymers having a structural unit represented by general formula (15) above and a structural unit represented by the following general formula (16):

[Chemical Formula 5]

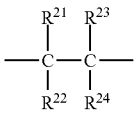

(16)

[wherein $R^{21}$-$R^{24}$ may be the same or different and each represents hydrogen or a C1-20 hydrocarbon group, and $R^{21}$-$R^{24}$ may be the same or different for each structural unit].

$R^{16}$-$R^{18}$ in general formula (15) above each represents hydrogen or a C1-8 hydrocarbon group (preferably a C1-4 hydrocarbon group), and they may be the same or different. As specific hydrocarbon groups there may be mentioned alkyl groups such as methyl, ethyl, n-propyl, isopropyl, n-butyl, isobutyl, sec-butyl, tert-butyl, pentyl isomers, hexyl isomers, heptyl isomers and octyl isomers; cycloalkyl groups such as cyclopentyl, cyclohexyl, methylcyclohexyl isomers, ethylcyclohexyl isomers and dimethylcyclohexyl isomers; aryl groups such as phenyl, methylphenyl isomers, ethylphenyl isomers and dimethylphenyl isomers; and arylalkyl groups such as benzyl, phenylethyl isomers and methylbenzyl isomers; however, hydrogen is preferred for $R^{22}$-$R^{24}$.

$R^{19}$ in general formula (15) represents a C1-10 (preferably C2-10) divalent hydrocarbon group or a C2-20 divalent ether-bonded oxygen-containing hydrocarbon group. As specific C1-10 divalent hydrocarbon groups there may be mentioned divalent aliphatic linear hydrocarbon groups such as methylene, ethylene, phenylethylene, 1,2-propylene, 2-phenyl-1,2-propylene, 1,3-propylene, butylene isomers, pentylene isomers, hexylene isomers, heptylene isomers, octylene isomers, nonylene isomers and decylene isomers; alicyclic hydrocarbon groups having two binding sites in the alicyclic hydrocarbon group, such as cyclohexane, methylcyclohexane, ethylcyclohexane, dimethylcyclohexane and propylcyclohexane; divalent aromatic hydrocarbon groups such as phenylene isomers, methylphenylene isomers, ethylphenylene isomers, dimethylphenylene isomers and naphthylene isomers; alkylaromatic hydrocarbon groups having a monovalent binding site at the alkyl group portion and the aromatic portion of the alkylaromatic hydrocarbon, such as toluene, xylene and ethylbenzene; alkylaromatic hydrocarbon groups having a binding site at the alkyl portion of the polyalkylaromatic hydrocarbon, such as xylene and diethylbenzene. Particularly preferred among these are C2-4 aliphatic linear hydrocarbon groups.

As examples of preferred C2-20 divalent ether-bonded oxygen-containing hydrocarbon groups there may be mentioned specifically methoxymethylene, methoxyethylene, methoxymethylethylene, 1,1-bismethoxymethylethylene, 1,2-bismethoxymethylethylene, ethoxymethylethylene, (2-methoxyethoxy)methylethylene and (1-methyl-2-methoxy)methylethylene. The letter s in general formula (15) represents the number of repeats of $R^{19}O$, and its average is in the range of 0-10, and preferably 0-5. When multiple $R^{19}O$ groups are present in the same structural unit, the multiple $R^{19}O$ groups may be the same or different.

$R^{20}$ in general formula (15) represents a C1-20 and preferably C1-10 hydrocarbon group, and as such hydrocarbon groups there may be mentioned specifically alkyl groups such as methyl, ethyl, n-propyl, isopropyl, n-butyl, isobutyl, sec-butyl, tert-butyl, pentyl isomers, hexyl isomers, heptyl isomers, octyl isomers, nonyl isomers and decyl isomers; cycloalkyl groups such as cyclopentyl, cyclohexyl, methylcyclohexyl isomers, ethylcyclohexyl isomers, propylcyclohexyl isomers and dimethylcyclohexyl isomers; aryl groups such as phenyl, methylphenyl isomers, ethylphenyl isomers, dimethylphenyl isomers, propylphenyl isomers, trimethylphenyl isomers, butylphenyl isomers and naphthyl isomers; and arylalkyl groups such as benzyl, phenylethyl isomers, methylbenzyl isomers, phenylpropyl isomers and phenylbutyl isomers. $R^{22}$-$R^{26}$ may be the same or different for each structural unit.

When a polyvinyl ether used for the invention is a homopolymer comprising a structural unit represented by general formula (15) above, the carbon/oxygen molar ratio is preferably in the range of 4.2-7.0. A molar ratio of less than 4.2 will produce excessive hygroscopicity, while a molar ratio of 7.0 will tend to reduce miscibility with refrigerants.

In general formula (16) above, $R^{21}$-$R^{24}$ may be the same or different and each represents hydrogen or a C1-20 hydrocarbon group. As C1-20 hydrocarbon groups there may be mentioned the hydrocarbon groups for $R^{20}$ in general formula (15). $R^{21}$-$R^{24}$ may be the same or different for each structural unit.

When a polyvinyl ether used for the invention is a block copolymer or random copolymer of a structural unit represented by general formula (15) and a structural unit represented by general formula (16), the carbon/oxygen molar ratio is preferably in the range of 4.2-7.0. A molar ratio of less than 4.2 will produce excessive hygroscopicity, while a molar ratio of 7.0 will tend to reduce miscibility with refrigerants.

According to the invention, there may also be used a mixture of a homopolymer comprising a structural unit represented by general formula (15) with a block copolymer or random copolymer comprising a structural unit represented by general formula (15) and a structural unit represented by general formula (16). Such homopolymers and copolymers may be produced, respectively, by polymerization of the corresponding vinyl ether-based monomer, and copolymerization of the corresponding hydrocarbon monomer having an olefinic double bond and the corresponding vinyl ether-based monomer.

As polyvinyl ethers to be used for the invention there are preferred those wherein at least one of the terminal structures is represented by the following general formula (17) or (18):

[Chemical Formula 6]

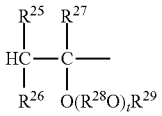

(17)

[wherein $R^{25}$-$R^{27}$ may be the same or different and each represents hydrogen or a C1-8 hydrocarbon group, $R^{28}$ represents a C1-10 divalent hydrocarbon group or a C2-20 divalent ether-bonded oxygen-containing hydrocarbon group, $R^{29}$ represents a C1-20 hydrocarbon group and t represents a number whose average is 0-10, with the proviso that when the terminal structure represented by general formula (17) contains multiple $R^{28}O$ groups, the multiple $R^{28}O$ groups may be the same or different]

[Chemical Formula 7]

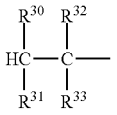

(18)

[wherein $R^{30}$-$R^{31}$ may be the same or different and each represents hydrogen or a C1-20 hydrocarbon group] and the other terminal structure is represented by the following general formula (19) or (20):

[Chemical Formula 8]

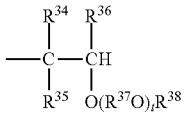

(19)

[wherein $R^{34}$-$R^{36}$ may be the same or different and each represents hydrogen or a C1-8 hydrocarbon group, $R^{37}$ represents a C1-10 divalent hydrocarbon group or a C2-20 divalent ether-bonded oxygen-containing hydrocarbon group, $R^{38}$ represents a C1-20 hydrocarbon group and t represents a number whose average is 0-10, with the proviso that when the terminal structure represented by general formula (19) contains multiple $R^{37}O$ groups, the multiple $R^{37}O$ groups may be the same or different]

[Chemical Formula 9]

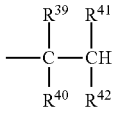

(20)

[wherein $R^{39}$-$R^{42}$ may be the same or different and each represents hydrogen or a C1-20 hydrocarbon group]; and those wherein one of the terminal structures is represented by general formula (17) or (18) and the other is represented by the following general formula (21):

[Chemical Formula 10]

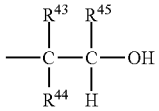

(21)

[wherein $R^{43}$-$R^{45}$ may be the same or different and each represents hydrogen or a C1-8 hydrocarbon group]. Among such polyvinyl ethers, the following may be mentioned as particularly preferable.

(1) Polyvinyl ethers wherein one terminal has a structure represented by general formula (17) or (18) and the other has a structure represented by general formula (19) or (20), any of $R^{16}$-$R^{18}$ in general formula (15) is hydrogen, s is an integer of 0-4, $R^{19}$ is a C2-4 divalent hydrocarbon group, and $R^{20}$ is a C1-20 hydrocarbon group;

(2) Polyvinyl ethers having only a structural unit represented by general formula (15), wherein one terminal has a structure represented by general formula (17) and the other has a structure represented by general formula (18), any of $R^{16}$-$R^{18}$ in general formula (15) is hydrogen, s is an integer of 0-4, $R^{19}$ is a C2-4 divalent hydrocarbon group, and $R^{20}$ is a C1-20 hydrocarbon group;

(3) Polyvinyl ethers wherein one terminal has a structure represented by general formula (17) or (18) and the other has a structure represented by general formula (19), any of $R^{16}$-$R^{18}$ in general formula (15) is hydrogen, s is an integer of 0-4, $R^{19}$ is a C2-4 divalent hydrocarbon group, and $R^{20}$ is a C1-20 hydrocarbon group; and (4) Polyvinyl ethers having only a structural unit represented by general formula (15), wherein one terminal has a structure represented by general formula (17) and the other has a structure represented by general formula (20), any of $R^{16}$-$R^{18}$ in general formula (15) is hydrogen, s is an integer of 0-4, $R^{19}$ is a C2-4 divalent hydrocarbon group, and $R^{20}$ is a C1-20 hydrocarbon group.

According to the invention, there may also be used polyvinyl ethers having a structural unit represented by general formula (15), wherein one terminal has a structure represented by general formula (17) and the other has a structure represented by the following general formula (22):

[Chemical Formula 11]

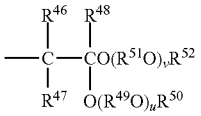

(22)

[wherein $R^{46}$-$R^{48}$ may be the same or different and each represents hydrogen or a C1-8 hydrocarbon group, $R^{49}$ and $R^{51}$-may be the same or different and each represents a C2-10 divalent hydrocarbon group, $R^{50}$ and $R^{52}$ may be the same or different and each represents a C1-10 hydrocarbon group, u and v may be the same or different and each represents a number whose average is 0-10, and when the terminal structure represented by general formula (22) has multiple $R^{49}O$ or $R^{51}O$ groups, the multiple $R^{49}O$ or $R^{51}O$ groups may be the same or different].

According to the invention, there may also be used polyvinylether-based compounds comprising an alkylvinyl ether homopolymer or copolymer composed of a structural unit represented by the following general formula (23) or (24):

[Chemical Formula 12]

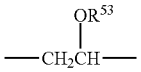

(23)

[wherein $R^{53}$ represents a C1-8 hydrocarbon group]

[Chemical Formula 13]

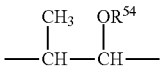

(24)

[wherein $R^{54}$ represents a C1-8 hydrocarbon group] and having a weight-average molecular weight of 300-5000, wherein one of the terminals has a structure represented by the following general formula (25) or (26):

[Chemical Formula 14]

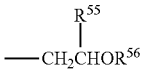

(25)

[wherein $R^{55}$ represents a C1-3 alkyl group, and $R^{56}$ represents a C1-8 hydrocarbon group] [Chemical Formula 15]

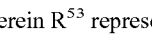

(26)

[wherein $R^{57}$ represents a C1-8 hydrocarbon group].

According to the invention, one oil selected from the group consisting of the aforementioned mineral oils and synthetic oils may be used alone or two or more thereof may be used in combination, but when using an HFC-based refrigerant, polyoxyalkylene glycols, esters, and polyvinyl ethers are preferred among the above-mentioned mineral oils and synthetic oils for open-type compressors in automobile air conditioners and the like, while alkylbenzenes, esters and polyvinyl ethers are preferred for closed-type compressors in refrigerators, air conditioning machines and the like.

(Phosphorus-Based Extreme Pressure Agent)

The phosphorus-based extreme pressure agent included in the refrigerating machine oil composition of the invention is preferably at least one selected from the group consisting of phosphorothionates (thiophosphoric acid esters), phosphoric acid esters, acidic phosphoric acid esters' acidic phosphoric acid ester amine salts, chlorinated phosphoric acid esters and phosphorous acid esters. Among the aforementioned preferred phosphorus-based extreme pressure agents, phosphorus-based additives other than phosphorothionates include esters of phosphoric acid or phosphorous acid with alkanols and polyether-type alcohols, or their derivatives.

A phosphorothionate according to the invention is a compound represented by the following general formula (27):

[Chemical Formula 16]

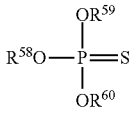

(27)

[wherein $R^{58}$-$R^{60}$ may be the same or different and each represents a C1-24 hydrocarbon group].

As specific C1-24 hydrocarbon groups represented by $R^{58}$-$R^{60}$ there may be mentioned alkyl, cycloalkyl, alkenyl, alkylcycloalkyl, aryl, alkylaryl and arylalkyl.

As examples of alkyl groups there may be mentioned alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl (where these alkyl groups may be either straight-chain or branched).

As examples of cycloalkyl groups there may be mentioned C5-7 cycloalkyl groups such as cyclopentyl, cyclohexyl and cycloheptyl. As examples of alkylcycloalkyl groups there may be mentioned C6-11 alkylcycloalkyl groups such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl (where the substituting position of the alkyl group on the cycloalkyl group is optional).

As examples of alkenyl groups there may be mentioned alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl (where the alkyl groups may be either straight-chain or branched, and the position of the double bond is optional).

As examples of aryl groups there may be mentioned aryl groups such as phenyl and naphthyl. As examples of alkylaryl groups there may be mentioned C7-18 alkylaryl groups such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl (where the alkyl groups may be either straight-chain or branched, and the substituting position on the aryl group is optional).

As examples of arylalkyl groups there may be mentioned C7-12 arylalkyl groups such as benzyl, phenylethyl, phenylpropyl, phenylbutyl, phenylpentyl and phenylhexyl (where the alkyl groups may be either straight-chain or branched).

The C1-24 hydrocarbon group represented by $R^{58}$-$R^{60}$ is preferably alkyl, aryl or alkylaryl, and more preferably C4-18 alkyl, C7-24 alkylaryl or phenyl.

As specific phosphorothionates represented by general formula (27) there may be mentioned tributyl phosphorothionate, tripentyl phosphorothionate, trihexyl phosphorothionate, triheptyl phosphorothionate, trioctyl phosphorothionate, trinonyl phosphorothionate, tridecyl phosphorothionate, triundecyl phosphorothionate, tridodecyl phosphorothionate, tritridecyl phosphorothionate, tritetradecyl phosphorothionate, tripentadecyl phosphorothionate, trihexadecyl phosphorothionate, triheptadecyl phosphorothionate, trioctadecyl phosphorothionate, trioleyl phosphorothionate, triphenyl phosphorothionate, tricresyl phosphorothionate, trixylenyl phosphorothionate, cresyldiphenyl phosphorothionate, xylenyldiphenyl phosphorothionate, tris-(n-propylphenyl) phosphorothionate, tris(isopropylphenyl) phosphorothionate, tris (n-butylphenyl) phosphorothionate, tris(isobutylphenyl) phosphorothionate, tris(s-butylphenyl) phosphorothionate and tris(t-butylphenyl) phosphorothionate. Mixtures of these may also be used.

There are no particular restrictions on the phosphorothionate content, but it will usually be 0.01-10 wt %, preferably 0.01-5 wt % and more preferably 0.01-3 wt % based on the total weight of the refrigerating machine oil composition (the total weight of the base oil and all additives).

Among phosphorus-based extreme pressure agents other than phosphorothionates, the following may be mentioned as phosphoric acid esters: tributyl phosphate, tripentyl phosphate, trihexyl phosphate, triheptyl phosphate, trioctyl phosphate, trinonyl phosphate, tridecyl phosphate, triundecyl phosphate, tridodecyl phosphate, tritridecyl phosphate, tritetradecyl phosphate, tripentadecyl phosphate, trihexadecyl phosphate, triheptadecyl phosphate, trioctadecyl phosphate, trioleyl phosphate, triphenyl phosphate, tricresyl phosphate, trixylenyl phosphate, cresyldiphenyl phosphate and xylenyldiphenyl phosphate;

the following may be mentioned as acidic phosphoric acid esters: monobutyl acid phosphate, monopentyl acid phosphate, monohexyl acid phosphate, monoheptyl acid phosphate, monooctyl acid phosphate, monononyl acid phosphate, monodecyl acid phosphate, monoundecyl acid phosphate, monododecyl acid phosphate, monotridecyl acid phosphate, monotetradecyl acid phosphate, monopentadecyl acid phosphate, monohexadecyl acid phosphate, monoheptadecyl acid phosphate, monooctadecyl acid phosphate, monooleyl acid phosphate, dibutyl acid phosphate, dipentyl acid phosphate, dihexyl acid phosphate, diheptyl acid phosphate, dioctyl acid phosphate, dinonyl acid phosphate, didecyl acid phosphate, diundecyl acid phosphate, didodecyl acid phosphate, ditridecyl acid phosphate, ditetradecyl acid phosphate, dipentadecyl acid phosphate, dihexadecyl acid phosphate, diheptadecyl acid phosphate, dioctadecyl acid phosphate and dioleyl acid phosphate;

the following may be mentioned as acidic phosphoric acid ester amine salts: salts of the aforementioned acidic phosphoric acid esters with amines such as methylamine, ethylamine, propylamine, butylamine, pentylamine, hexylamine, heptylamine, octylamine, dimethylamine, diethylamine, dipropylamine, dibutylamine, dipentylamine, dihexylamine, diheptylamine, dioctylamine, trimethylamine, triethylamine, tripropylamine, tributylamine, tripentylamine, trihexylamine, triheptylamine and trioctylamine;

the following may be mentioned as chlorinated phosphoric acid esters: tris(dichloropropyl) phosphate, tris(chloroethyl) phosphate, tris(chlorophenyl) phosphate and polyoxyalkylene bis[di(chloroalkyl)] phosphate;

and the following may be mentioned as phosphorous acid esters: dibutyl phosphite, dipentyl phosphite, dihexyl phosphite, diheptyl phosphite, dioctyl phosphite, dinonyl phosphite, didecyl phosphite, diundecyl phosphite, didodecyl phosphite, dioleyl phosphite, diphenyl phosphite, dicresyl phosphite, tributyl phosphite, tripentyl phosphite, trihexyl phosphite, triheptyl phosphite, trioctyl phosphite, trinonyl phosphite, tridecyl phosphite, triundecyl phosphite, tridodecyl phosphite, trioleyl phosphite, triphenyl phosphite and tricresyl phosphite. Mixtures of these may also be used.

When a phosphorus-based extreme pressure agent other than a phosphorothionate is included in the refrigerating machine oil composition of the invention, there are no particular restrictions on its content, but the phosphorus-based extreme pressure agent will usually be added in an amount of 0.01-5.0 wt % and preferably 0.02-3.0 wt %, based on the total weight of the refrigerating machine oil composition (the total weight of the base oil and all additives).

Although any one of the aforementioned phosphorus-based extreme pressure agents alone or any two or more in combination may be used in the refrigerating machine oil composition of the invention, a phosphorothionate is preferably used from the standpoint of achieving more excellent thermal stability.

If a phosphorothionate and a phosphorus-based extreme pressure agent other than a phosphorothionate are used in combination as the phosphorus-based extreme pressure agent, the synergistic effect of the phosphorus-based extreme pressure agents, as well as the synergistic effect of each of the phosphorus-based extreme pressure agents with the oil agent, will produce a higher degree of the aforementioned effect of the invention, and particularly will further enhance the abrasion resistance.

(Oil Agent)

As oil agents to be used for the invention there may be mentioned ester oil agents, monohydric alcohol oil agents, carboxylic acid oil agents, ether oil agents and the like.

An ester oil agent used may be natural (usually found in a natural fat or oil derived from an animal or plant), or synthetic. According to the invention, synthetic esters are preferred from the standpoint of stability of the resulting refrigerating machine oil composition and homogeneity of the ester component.

A synthetic ester used as the ester oil agent is obtained by reacting an alcohol with a carboxylic acid. The alcohol may be a monohydric alcohol or a polyhydric alcohol. The carboxylic acid may be a monobasic acid or a polybasic acid.

The monohydric alcohol forming the ester oil agent will usually have 1-24, preferably 1-12 and more preferably 1-8 carbon atoms, and such alcohols may be either straight-chain or branched, and either saturated or unsaturated. As specific examples of C1-24 alcohols there may be mentioned methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched eicosanol, straight-chain or branched heneicosanol, straight-chain or branched tricosanol, straight-chain or branched tetracosanol, and mixtures thereof.

A polyhydric alcohol forming the ester oil agent will usually be 2-10 polyhydric and preferably 2-6 polyhydric. As specific examples of 2-10 polyhydric alcohols there may be mentioned dihydric alcohols such as ethylene glycol, diethylene glycol, polyethylene glycol (3-15 mers of ethylene glycol), propylene glycol, dipropylene glycol, polypropylene glycol (3-15 mers of propylene glycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol and neopentyl glycol; polyhydric alcohols such as glycerin, polyglycerin (2-8 mers of glycerin, such as diglycerin, triglycerin, tetraglycerin, etc.), trimethylolalkanes (trimethylolethane, trimethylolpropane, trimethylolbutane, etc.) and their 2-8 mers, pentaerythritol and their 2-4 mers, 1,2,4-butanetriol, 1,3,5-pentanetrioli 1,2,6-hexanetriol, 1,2,3,4-butanetetrol, sorbitol, sorbitan, sorbitol glycerin condensate, adonitol, arabitol, xylitol and mannitol; sugars such as xylose, arabinose, ribose, rhamnose, glucose, fructose, galactose, mannose, sorbose, cellobiose, maltose, isomaltose, trehalose and sucrose, and mixtures thereof.

Among these polyhydric alcohols there are preferred 2-6 polyhydric alcohols such as ethylene glycol, diethylene glycol, polyethylene glycol (3-10 mers of ethylene glycol), propylene glycol, dipropylene glycol, polypropylene glycol (3-10 mers of propylene glycol), 1,3-propanediol, 2-methyl-1,2-propanediol, 2-methyl-1,3-propanediol, neopentyl glycol, glycerin, diglycerin, triglycerin, trimethylolalkanes (trimethylolethane, trimethylolpropane, trimethylolbutane, etc.) and their 2-4 mers, pentaerythritol, dipentaerythritol, 1,2,4-butanetriol, 1,3,5-pentanetriol, 1,2,6-hexanetriol, 1,2,3,4-butanetetrol, sorbitol, sorbitan, sorbitol glycerin condensate, adonitol, arabitol, xylitol, mannitol, and mixtures thereof. More preferred are ethylene glycol, propylene glycol, neopentyl glycol, glycerin, trimethylolethane, trimethylolpropane, pentaerythritol, sorbitan, and mixtures thereof. Among these, neopentyl glycol, trimethylolethane, trimethylolpropane, pentaerythritol and mixtures thereof are particularly preferred because they provide higher oxidative stability.

The alcohol forming the ester oil agent of the invention may be a monohydric alcohol or polyhydric alcohol as explained above, but it is preferably a monohydric alcohol from the standpoint of further increasing the abrasion resistance and friction properties when used in combination with the phosphorus-based extreme pressure agent, and from the standpoint of the anti-separation property in a refrigerant atmosphere and at low temperature.

The acid forming the ester oil agent of the invention may be a monobasic acid, usually C2-24, fatty acid, and such fatty acids may be either straight-chain or branched, and either saturated or unsaturated. As specific examples there may be mentioned saturated fatty acids such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxyoctadecanoic acid, straight-chain or branched nonadecanoic acid, straight-chain or branched eicosanoic acid, straight-chain or branched heneicosanoic acid, straight-chain or branched docosanoic acid, straight-chain or branched tricosanoic and straight-chain or branched tetracosanoic acid, and unsaturated fatty acids such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyoctadecenoic acid, straight-chain or branched nonadecenoic acid, straight-chain or branched eicosenoic acid, straight-chain or branched heneicosenoic acid, straight-chain or branched docosenoic acid, straight-chain or branched tricosenoic acid and straight-chain or branched tetracosenoic acid, as well as mixtures thereof.

As polybasic acids there may be mentioned dibasic acids, trimellitic acid, and the like, but dibasic acids are preferred from the standpoint of refrigerant atmosphere/low temperature anti-separation property. A dibasic acid may be either a linear dibasic acid or a cyclic dibasic acid. In the case of a linear dibasic acid, it may be either straight-chain or branched, and either saturated or unsaturated. Linear dibasic acids are preferably C2-16 linear dibasic acids, and as specific examples there may be mentioned ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid and mixtures thereof. As cyclic dibasic acids there may be mentioned 1,2-cyclohexanedicarboxylic acid, 4-cyclohexene-1,2-dicarboxylic acid and aromatic dicarboxylic acids. Linear dibasic acids are preferred from the standpoint of stability.

The acid forming the ester oil agent of the invention may be either a monobasic acid or a polybasic acid as mentioned above, but is preferably a monobasic acid from the standpoint of achieving a more excellent enhancing effect on the abrasion resistance and friction properties.

Any combination of alcohols and acids may be employed for the ester oil agent, with no particular restrictions, and as examples there may be mentioned esters comprising the following combinations (i) to (vii).

(i) Esters of monohydric alcohols and monobasic acids (ii) Esters of polyhydric alcohols and monobasic acids (iii) Esters of monohydric alcohols and polybasic acids (iv) Esters of polyhydric alcohols and polybasic acids (v) Esters comprising mixtures of monohydric alcohols and polyhydric alcohols, and polybasic acids (vi) Esters comprising polyhydric alcohols and mixtures of monobasic acids and polybasic acids (vii) Esters comprising mixtures of monohydric alcohols and polyhydric alcohols, and monobasic and polybasic acids.

Each of the esters of (ii) to (vii) above may be a complete ester wherein all of the hydroxyl groups of the polyhydric alcohol or all of the carboxyl groups of the polybasic acid are esterified, or a partial ester wherein some of the hydroxyl groups or carboxyl groups remain, but complete esters are preferred from the standpoint of reducing the effect on the refrigerant atmosphere/low temperature anti-separation property, while partial esters are preferred from the standpoint of enhancing effect on the abrasion resistance.

Among the esters of (i) to (vii) above there are preferred (i) esters of monohydric alcohols and monobasic acids and (iii) esters of monohydric alcohols and polybasic acids, with the esters of (i) being more preferred. These esters have a very significant effect on enhancement of abrasion resistance and friction properties, while also minimizing the effects on the refrigerant atmosphere/low temperature anti-separation property, and thermal-oxidative stability.

For the esters of (i), the number of carbon atoms of the monobasic acid is preferably 10 or greater, more preferably 12 or greater and more preferably 14 or greater, from the standpoint of enhancing the abrasion resistance and friction property when used in combination with the phosphorus-based extreme pressure agent, and from the standpoint of thermal-oxidative stability. The number of carbon atoms of the monobasic acid is also preferably no greater than 28, more preferably no greater than 26 and more preferably no greater than 24 from the standpoint of the refrigerant atmosphere/low temperature anti-separation property. As such esters there may be mentioned methyl stearate, butyl stearate, methyl palmitate and isopropyl palmitate.

The monobasic acids and monohydric alcohols forming the esters of (i) above may each be straight-chain or branched, but esters of straight-chain monobasic acids are preferred from the standpoint of friction properties.

The dibasic acids in the esters of (iii) above are preferably linear. As such esters there may be mentioned diisodecyl adipate, diisononyl adipate and diisobutyl adipate.

The refrigerating machine oil composition of the invention will sometimes contain an ester as the base oil, and the ester used as the base oil is preferably at least one selected from among polyol esters and diesters of alicyclic dibasic acids, while the ester oil agent is preferably at least one selected from among esters of monohydric alcohols and monobasic acids and esters of linear dibasic acids and monohydric alcohols.

As monohydric alcohol oil agents there may be mentioned the monohydric alcohols mentioned above for the ester oil agent. The total number of carbon atoms of the monohydric alcohol oil agent is preferably 6 or greater, more preferably 8 or greater and most preferably 10 or greater from the standpoint of enhancing the abrasion resistance and friction properties on the other hand, since separation will tend to occur in the refrigerant atmosphere if the total number of carbon atoms is too high, it is preferably no greater than 20, more preferably no greater than 18 and most preferably no greater than 16.

Carboxylic acid oil agents may be monobasic acids or polybasic acids. As examples of such carboxylic acids there may be mentioned the monobasic acids and polybasic acids mentioned above for the ester oil agent. Monobasic acids are preferred from the standpoint of abrasion resistance and friction properties. The total number of carbon atoms in the carboxylic acid oil agent is preferably 6 or greater, more preferably 8 or greater and most preferably 10 or greater from the standpoint of enhancing the abrasion resistance and friction properties. On the other hand, since separation will tend to occur in the refrigerant atmosphere if the total number of carbon atoms of the carboxylic acid oil agent is too high, it is preferably no greater than 20, more preferably no greater than 18 and most preferably no greater than 16.

As ether oil agents there may be mentioned etherified aliphatic 3-6 polyhydric alcohols, and etherified bimolecular condensates or trimolecular condensates of aliphatic 3-6 polyhydric alcohols.

Examples of etherified aliphatic 3-6 polyhydric alcohols include those represented by the following general formulas (28)-(33).

[Chemical Formula 17]

(28)

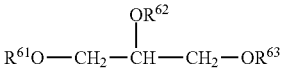

[Chemical Formula 18]

(29)

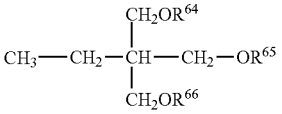

[Chemical Formula 19]

(30)

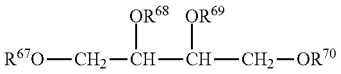

[Chemical Formula 20]

(31)

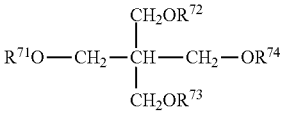

[Chemical Formula 21]

(32)

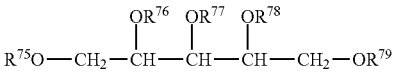

[Chemical Formula 22]

(33)

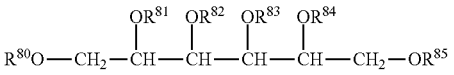

[wherein $R^{61}$-$R^{85}$ may be the same or different and each represents hydrogen or C1-18 straight-chain or branched alkyl, allyl, aralkyl, or a glycol ether residue represented by —$(R^aO)_n$—$R^b$ (where $R^a$ represents C2-6 alkylene, $R^b$ represents C1-20 alkyl, allyl, aralkyl, and n represents an integer of 1-10)].

As specific examples of aliphatic 3-6 polyhydric alcohols there may be mentioned glycerin, trimethylolpropane, erythritol, pentaerythritol, arabitol, sorbitol and mannitol. As groups for $R^{61}$-$R^{85}$ in general formulas (28) to (33) above there may be mentioned methyl, ethyl, n-propyl, isopropyl, butyl isomers, pentyl isomers, hexyl isomers, heptyl isomers, octyl isomers, nonyl isomers, decyl isomers, undecyl isomers, dodecyl isomers, tridecyl isomers, tetradecyl isomers, pentadecyl isomers, hexadecyl isomers, heptadecyl isomers, octadecyl isomers, phenyl and benzyl. The aforementioned etherified forms also include partial etherified forms wherein some of $R^{61}$-$R^{85}$ are hydrogen.

As etherified bimolecular condensates or trimolecular condensates of aliphatic 3-6 polyhydric alcohols there may be mentioned homogeneous or heterogeneous condensates among the compounds represented by general formulas (28)-(33). For example, etherified bimolecular condensates and trimolecular condensates of alcohols represented by general formula (28) are represented by general formulas (34) and (35), respectively. Etherified bimolecular condensates or trimolecular condensates of alcohols represented by general formula (30) are represented by general formulas (36) and (37), respectively.

[Chemical Formula 23]

(34)

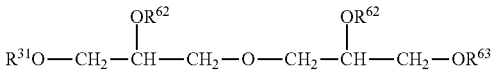

[Chemical Formula 24]

(35)

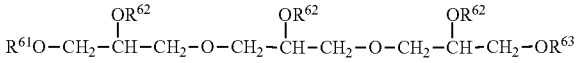

[Chemical Formula 25]

(36)

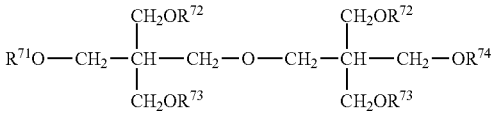

[Chemical Formula 26]

(37)

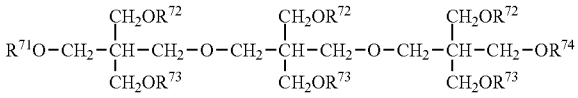

[wherein $R^{61}$-$R^{63}$ and $R^{71}$-$R^{74}$ have the same definitions as $R^{61}$-$R^{63}$ in formula (28) and $R^{71}$-$R^{74}$ in formula (31), respectively].

As specific examples of etherified bimolecular condensates or trimolecular condensates of aliphatic 3-6 polyhydric alcohols there may be mentioned diglycerin, ditrimethylolpropane, dipentaerythritol, disorbitol, triglycerin, tritrimethylolpropane, tripentaerythritol and trisorbitol.

As specific examples of ether oil agents represented by general formulas (28) to (37) there may be mentioned glycerin trihexylether, glycerin dimethyloctyl triether, glycerin di(methyloxyisopropylene)dodecyl triether, glycerin diphenyloctyl triether, glycerin di(phenyloxyisopropylene)dodecyl triether, trimethylolpropane trihexylether, trimethylolpropane dimethyloctyl triether, trimethylolpropane di(methyloxyisopropylene)dodecyl triether, pentaerythritol tetrahexylether, pentaerythritol trimethyloctyltetraether, pentaerythritol tri(methyloxyisopropylene)dodecyltetraether, sorbitol hexapropylether, sorbitol tetramethyloctylpentaether, sorbitol hexa(methyloxyisopropylene)ether, diglycerin tetrabutylether, diglycerin dimethyldioctyltetraether, diglycerin tri (methyloxyisopropylene) dodecyltetraether, triglycerin pentaethylether, triglycerin trimethyldioctylpentaether, triglycerin tetra(methyloxyisopropylene)decylpentaether, ditrimethylolpropane tetrabutylether, ditrimethylolpropane dimethyldioctyltetraether, ditrimethylolpropane tri(methyloxyisopropylene)dodecyltetraether, tritrimethylolpropane pentaethylether, tritrimethylolpropane trimethyldioctylpentaether, tritrimethylolpropane tetra(methyloxyisopropylene) decylpentaether, dipentaerythritol hexapropylether, dipentaerythritol pentamethyloctyl hexaether, dipentaerythritol hexa(methyloxyisopropylene)ether, tripentaerythritol octapropylether, tripentaerythritol pentamethyloctyl hexaether, tripentaerythritol hexa(methyloxyisopropylene)ether, disorbitol octamethyldioctyl decaether and disorbitol deca(methyloxyisopropylene)ether. Preferred among these are glycerin diphenyloctyl triether, trimethylolpropane di(methyloxyisopropylene)dodecyl triether, pentaerythritol tetrahexylether, sorbitol hexapropylether, diglycerin dimethyldioctyltetraether, triglycerin tetra(methyloxyisopropylene)decylpentaether, dipentaerythritol hexapropylether and tripentaerythritol pentamethyloctyl hexaether.

Any single ester oil agent, monohydric alcohol oil agent, carboxylic acid oil agent or ether oil agent may be used alone, or two or more may be used in combination, together with the phosphorus-based extreme pressure agent in the refrigerating machine oil composition of the invention. Preferred among these oil agents are those comprising ester oil agents as essential components, from the standpoint of achieving a satisfactory balance with high levels of abrasion resistance, friction properties, anti-separation property and stability. Ester oil agents not only provide a high level of abrasion resistance and friction properties, but also result in a more excellent anti-separation property compared to monohydric alcohol oil agents or ether oil agents, and superior stability than carboxylic acid oil agents.

Although the content of the oil agent may be as desired, it is preferably 0.01 wt % or greater, more preferably 0.05 wt % or greater and more preferably 0.1 wt % or greater based on the total amount of the composition, from the standpoint of an excellent enhancing effect on the abrasion resistance and friction properties by use with the phosphorus-based extreme pressure agent. The content is also preferably no greater than 10 wt %, more preferably no greater than 7.5 wt % and even more preferably no greater than 5 wt % based on the total amount of the composition, from the standpoint of a more excellent refrigerant atmosphere/low temperature anti-separation property, and thermal-oxidative stability of the refrigerating machine oil composition.

The proportion of the phosphorus-based extreme pressure agent and the oil agent is preferably 1:10-10:1, more preferably 1:5-5:1, and even more preferably 1:3-1:1, based on weight. If the proportion of the phosphorus-based extreme pressure agent and the oil agent is within this range, it will be possible to achieve further enhancement in abrasion resistance and friction properties.

As mentioned above, the refrigerating machine oil composition of the invention comprises a prescribed base oil, phosphorus-based extreme pressure agent and oil agent as essential components, but it may also further contain benzotriazole and/or its derivatives, epoxy compounds, or other additives, as explained-below.

(Benzotriazole and/or its Derivatives)

The refrigerating machine oil composition of the invention also preferably contains benzotriazole and/or a derivative thereof. Adding benzotriazole and/or a derivative thereof will further increase the enhancing effect on the abrasion resistance and friction properties.

Benzotriazole is the compound represented by the following formula (38).

[Chemical Formula 27]

(38)

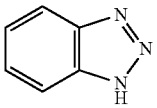

As examples of benzotriazole derivatives there may be mentioned alkylbenzotriazoles represented by the following general formula (39), and (alkyl)aminoalkylbenzotriazoles represented by general formula (40).

[Chemical Formula 28]

(39)

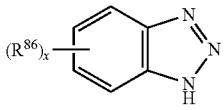

[Chemical Formula 29]

(40)

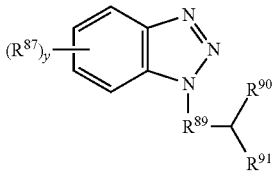

In formula (39), $R^{86}$ represents a C1-4 straight-chain or branched alkyl group, and preferably methyl or ethyl, and x represents an integer of 1-3, and preferably 1 or 2. As examples of $R^{86}$ there may be mentioned methyl, ethyl, n-propyl, isopropyl, n-butyl, isobutyl, sec-butyl and tert-butyl. As alkylbenzotriazoles represented by formula (39) there are preferred compounds wherein $R^{86}$ is methyl or ethyl and x is 1 or 2, particularly from the standpoint of achieving excellent oxidation resistance, and as examples there may be mentioned methylbenzotriazole(tolyltriazole), dimethylbenzotriazole, ethylbenzotriazole, ethylmethylbenzotriazole, diethylbenzotriazole, or mixtures thereof.

In formula (40), $R^{87}$ represents a C1-4 straight-chain or branched alkyl group, and preferably methyl or ethyl, $R^{88}$ represents methylene or ethylene, $R^{89}$ and $R^{90}$ may be the same or different and each represents hydrogen or a C1-18 straight-chain or branched alkyl group, and preferably a C1-12 straight-chain or branched alkyl group, and y represents an integer of 0-3, and preferably 0 or 1. As examples of $R^{87}$ there may be mentioned methyl, ethyl, n-propyl, isopropyl, n-butyl, isobutyl, sec-butyl and tert-butyl. As examples of $R^{89}$ and $R^{90}$, independently, there may be mentioned hydrogen, and alkyl groups such as methyl, ethyl, propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl and straight-chain or branched octadecyl.

As (alkyl)aminobenzotriazoles represented by formula (40) above there are preferably used dialkylaminoalkylbenzotriazole and dialkylaminoalkyltolyltriazole, wherein $R^{87}$ is methyl, y is 0 or 1, $R^{88}$ is methylene or ethylene and $R^{89}$ and $R^{90}$ are C1-12 straight-chain or branched alkyl groups, or mixtures thereof, from the standpoint of achieving particularly excellent oxidation resistance. As examples of these dialkylaminoalkylbenzotriazoles there may be mentioned dimethylaminomethylbenzotriazole, diethylaminomethylbenzotriazole, di-(straight-chain or branched)-propylaminomethylbenzotriazole, di-(straight-chain or branched)-butylaminomethylbenzotriazole, di-(straight-chain or branched)-pentylaminomethylbenzotriazole, di-(straight-chain or branched)-hexylaminomethylbenzotriazole, di-(straight-chain or branched)-heptylaminomethylbenzotriazole, di-(straight-chain or branched)-octylaminomethylbenzotriazole, di-(straight-chain or branched)-nonylaminomethylbenzotriazole, di-(straight-chain or branched)-decylaminomethylbenzotriazole, di-(straight-chain or branched)-undecylaminomethylbenzotriazole and di-(straight-chain or branched)-dodecylaminomethylbenzotriazole; dimethylaminoethylbenzotriazole, diethylaminoethylbenzotriazole, di-(straight-chain or branched )propylaminoethylbenzotriazole, di-(straight-chain or branched )butylaminoethylbenzotriazole, di-(straight-chain or branched) pentylaminoethylbenzotriazole, di-(straight-chain or branched )hexylaminoethylbenzotriazole, di-(straight-chain or branched)heptylaminoethylbenzotriazole, di-(straight-chain or branched)octylaminoethylbenzotriazole, di-(straight-chain or branched)nonylaminoethylbenzotriazole, di-(straight-chain or branched)decylaminoethylbenzotriazole, di-(straight-chain or branched)undecylaminoethylbenzotriazole and di-(straight-chain or branched)-dodecylaminoethylbenzotriazole; dimethylaminomethyltolyltriazole, diethylaminomethyltolyltriazole, di-(straight-chain or branched)-propylaminomethyltolyltriazole, di-(straight-chain or branched)-butylaminomethyltolyltriazole, di-(straight-chain or branched)-pentylaminomethyltolyltriazole, di-(straight-chain or branched)-hexylaminomethyltolyltriazole, di-(straight-chain or branched)-heptylaminomethyltolyltriazole, di-(straight-chain or branched)-octylaminomethyltolyltriazole, di-(straight-chain or branched)-nonylaminomethyltolyltriazole, di-(straight-chain or branched)-decylaminomethyltolyltriazole, di-(straight-chain or branched)-undecylaminomethyltolyltriazole and di-(straight-chain or branched)-dodecylaminomethyltolyltriazole; dimethylaminoethyltolyltriazole, diethylaminoethyltolyltriazole, di-(straight-chain or branched)propylaminoethyltolyltriazole, di-(straight-chain or branched)butylaminoethyltolyltriazole, di-(straight-chain or branched)pentylaminoethyltolyltriazole, di-(straight-chain or branched)hexylaminoethyltolyltriazole, di-(straight-chain or branched)heptylaminoethyltolyltriazole, di-(straight-chain or branched)octylaminoethyltolyltriazole, di-(straight-chain or branched)nonylaminoethyltolyltriazole, di-(straight-chain or branched)decylaminoethyltolyltriazole, di-(straight-chain or branched)undecylaminoethyltolyltriazole and di-(straight-chain or branched)-dodecylaminoethyltolyltriazole; or mixtures thereof.

Although the content of the benzotriazole and/or its derivative in the refrigerating machine oil composition of the invention may be as desired, it is preferably 0.001 wt % or greater and more preferably 0.005 wt % or greater based on the total weight of the composition. If it is less than 0.001 wt %, the enhancing effect of the benzotriazole and/or its derivative on the abrasion resistance and friction properties may be insufficient. The content of the benzotriazole and/or its derivative is preferably no greater than 1.0 wt % and more preferably no greater than 0.5 wt % based on the total weight of the composition. If the content is greater than 1.0 wt %, a commensurate enhancing effect on the abrasion resistance and friction properties will not be obtained, thus presenting a disadvantage in terms of economy.

(Epoxy Compound)

For further improved friction properties and thermal/hydrolytic stability, the refrigerating machine oil composition of the invention preferably contains at least one epoxy compound selected from the group consisting of:

(1) phenylglycidyl ether-type epoxy compounds (2) alkylglycidyl ether-type epoxy compounds (3) glycidyl ester-type epoxy compounds (4) allyloxirane compounds (5) alkyloxirane compounds (6) alicyclic epoxy compounds (7) epoxidated fatty acid monoesters, and (8) epoxidated vegetable oils.

(1) Specific examples of phenylglycidyl ether-type epoxy compounds include phenylglycidyl ethers and alkylphenylglycidyl ethers. As alkylphenylglycidyl ethers there may be mentioned those having one to three C1-13 alkyl groups, among which those having one C4-10 alkyl group such as, for example, n-butylphenylglycidyl ether, i-butylphenylglycidyl ether, sec-butylphenylglycidyl ether, tert-butylphenylglycidyl ether, pentylphenylglycidyl ether, hexylphenylglycidyl ether, heptylphenylglycidyl ether, octzlphenylglyqidyl ether, nonylphenylglycidyl ether and decylphenylglycidyl ether, are preferred.

(2) Specific examples of alkylglycidyl ether-type epoxy compounds include decylglycidyl ether, undecylglycidyl ether, dodecylglycidyl ether, tridecylglycidyl ether, tetradecylglycidyl ether, 2-ethylhexylglycidyl ether, neopentyl glycol diglycidyl ether, trimethylolpropane triglycidyl ether, pentaerythritoltetraglycidyl ether, 1,6-hexanediol diglycidyl ether, sorbitol polyglycidyl ether, polyalkylene glycol monoglycidyl ethers and polyalkylene glycol diglycidyl ethers.

(3) As specific examples of glycidyl ester-type epoxy compounds there may be mentioned compounds represented by the following general formula (41):

[Chemical Formula 30]

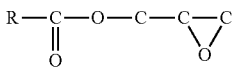

(41)

(wherein R represents a C1-18 hydrocarbon group).

In formula (41), R represents a C1-18 hydrocarbon group, and as such hydrocarbon groups there may be mentioned C1-18 alkyl, C2-18 alkenyl, C5-7 cycloalkyl, C6-18 alkylcycloalkyl, C6-10 aryl, C7-18 alkylaryl and C7-18 arylalkyl. Preferred among these are alkylphenyl groups such as C5-15 alkyl, C2-15 alkenyl, phenyl and C1-4 alkyl.

Specific examples of preferred glycidyl ester-type epoxy compounds include glycidyl-2,2-dimethyl octanoate, glycidyl benzoate, glycidyl-tert-butyl benzoate, glycidyl acrylate and glycidyl methacrylate.

(4) Specific examples of allyloxirane compounds include 1,2-epoxystyrene and alkyl-1,2-epoxystyrene.

(5) Specific examples of alkyloxirane compounds include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane and 1,2-epoxyeicosane.

(6) As alicyclic epoxy compounds there may be mentioned compounds wherein the carbon atoms forming the epoxy group directly form an alicyclic ring, such as compounds represented by the following general formula (42):

[Chemical Formula 31]

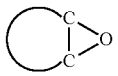

(42)

Specific examples of alicyclic epoxy compounds include 1,2-epoxycyclohexane, 1,2-epoxycyclopentane, 3,4-epoxycyclohexylmethyl-3,4-epoxycyclohexanecarboxylate, bis(3,4-epoxycyclohexylmethyl) adipate, exo-2,3-epoxynorbornane, bis(3,4-epoxy-6-methylcyclohexylmethyl) adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane and 4-epoxyethyl-1,2-epoxycyclohexane.

(7) Specific examples of epoxidated fatty acid monoesters include esters of epoxidated C12-20 fatty acids and C1-8 alcohols, phenols or alkylphenols. Particularly preferred for use are butyl, hexyl, benzyl, cyclohexyl, methoxyethyl, octyl, phenyl and butylphenyl esters of epoxystearic acid.

(8) Specific examples of epoxidated vegetable oils include epoxy compounds derived from vegetable oils such as soybean oil, linseed oil, cotton oil, and the like.

Among these epoxy compounds, there are preferred phenylglycidyl ether-type epoxy compounds, glycidyl ester-type epoxy compounds, alicyclic epoxy compounds and epoxidated fatty acid monoesters, with glycidyl ester-type epoxy compounds and alicyclic epoxy compounds being more preferred, as they will allow further enhanced thermal/hydrolytic stability.

When these epoxy compounds are included in the refrigerating machine oil composition of the invention, their contents are not particularly restricted, but the epoxy compounds will usually be added to contents of 0.1-5.0 wt % and more preferably 0.2-2.0 wt % based on the total weight of the refrigerating machine oil composition (total weight of the base oil and all additives).

Needless to mention, two or more of the aforementioned epoxy compounds may be used in combination.

(Other Additives)

For even further increased performance, the refrigerating machine oil composition of the invention may, if necessary, contain conventional publicly known refrigerating machine oil additives including, for example, phenol-based antioxidants such as di-tert-butyl-p-cresol and bisphenol A, amine-based antioxidants such as phenyl-α-naphthylamine and N,N-di(2-naphthyl)-p-phenylenediamine, anti-abrasion agents such as zinc dithiophosphate, phosphorus-based extreme pressure agents such as chlorinated paraffin and sulfur-based extreme pressure agents, antifoaming agents such as silicone-based agents, viscosity index improvers, pour point depressants, detergent dispersants and the like, either alone or as combinations of different types. There are no particular restrictions on the total amount of addition of such additives, but it is preferably no greater than 10 wt % and more preferably no greater than 5 wt % based on the total weight of the refrigerating machine oil composition (the total weight of the base oil and all additives).

There are no particular restrictions on the volume resistivity of the refrigerating machine oil composition of the invention, but it is preferably $1.0\times10^9$ Ω·cm. High electrical insulation will tend to be required especially for use in a closed-type refrigerating machine. Here, the volume resistivity refers to the value [Ω·cm] measured at 25° C. according to JIS C 2101: "Electrical Insulating Oil Test Method".

There are no particular restrictions on the moisture content of the refrigerating machine oil composition of the invention, but it is preferably no greater than 200 ppm, more preferably no greater than 100 ppm and most preferably no greater than 50 ppm, based on the total of the refrigerating machine oil composition. Particularly when the composition is to be used in a closed-type refrigerating machine, a smaller moisture content is desired from the viewpoint of its effect on the thermal/hydrolytic stability and electrical insulation property of the oil.

The acid value of the refrigerating machine oil composition of the invention is not particularly restricted, but in order to prevent corrosion of the metal used in the refrigerating machine or pipes, it is preferably no greater than 0.1 mgKOH/g and more preferably no greater than 0.05 mgKOH/g. Here, the acid value refers to the value [mgKOH/g] measured according to JIS K 2501: "Petroleum Products and Lubricating Oils—Neutralization Value Test Method".

The ash content of the refrigerating machine oil composition of the invention is also not particularly restricted, but in order to increase the thermal/hydrolytic stability of the refrigerating machine oil composition of the invention and inhibit production of sludge, it is preferably no greater than 100 ppm and more preferably no greater than 50 ppm. According to the invention, the ash content refers to the value [ppm] measured according to JIS K 2272: "Crude Oil and Petroleum Product Ash Content and Sulfated Ash Test Method".

The refrigerant used in a refrigerating machine employing the refrigerating machine oil composition of the invention is an HFC refrigerant, a fluoroether-based refrigerant such as perfluoroether, a non-fluoroether-based refrigerant such as dimethyl ether or a natural refrigerant such as carbon dioxide ammonia or a hydrocarbon, and any of these may be used alone or in mixtures of two or more different types.

As HFC refrigerants there may be mentioned C1-3 and preferably C1-2 hydrofluorocarbons. As specific examples there may be mentioned HFCs such as difluoromethane (HFC-32), trifluoromethane (HFC-23), pentafluoroethane (HFC-125), 1,1,2,2-tetrafluoroethane (HFC-134), 1,1,1,2-tetrafluoroethane (HFC-134a), 1,1,1-trifluoroethane (HFC-143a), 1,1-difluoroethane (HFC-152a) and the like, or mixtures of two or more thereof. These refrigerants may be appropriately selected depending on the purpose of use and the required performance, but as preferred examples there may be mentioned HFC-32 alone; HFC-23 alone; HFC-134a alone; HFC-125 alone; mixture of HFC-134a/HFC-32=60-80 wt %/40-20 wt %; mixture of HFC-32/HFC-125=40-70 wt %/ 60-30 wt %; mixture of HFC-125/HFC-143a=40-60 wt %/ 60-40 wt %; mixture of HFC-134a/HFC-32/HFC-125=60 wt %/30 wt %/10 wt %; mixture of HFC-134a/HFC-32/HFC-125=40-70 wt %/15-35 wt %/5-40 wt %; and mixture of HFC-125/HFC-134a/HFC-143a=35-55 wt %/1-15 wt %/ 40-60 wt %. More specifically, there may be mentioned mixture of HFC-134a/HFC-32=70/30 wt %; mixture of HFC-32/HFC-125=60/40 wt %; mixture of HFC-32/HFC-125=50/50 wt % (R410A); mixture of HFC-32/HFC-125=45/55 wt % (R410B); mixture of HFC-125/HFC-143a=50/50 wt % (R507C); mixture of HFC-32/HFC-125/HFC-134a=30/10/60 wt %; mixture of HFC-32/HFC-125/HFC-134a=23/25/52 wt % (R407C); mixture of HFC-32/HFC-125/HFC-134a=25/15/60 wt % (R407E); and mixture of HFC-125/HFC-134a/HFC-143a=44/4/52 wt % (R404A).

As natural refrigerants there may be mentioned carbon dioxide, ammonia, and hydrocarbons. Preferred hydrocarbon refrigerants are those which are gases at 25° C., 1 atmosphere. Specifically, these include C1-5 and preferably C1-4 alkanes, cycloalkanes, alkenes and mixtures thereof. As specific examples there may be mentioned methane, ethylene, ethane, propylene, propane, cyclopropane, butane, isobutane, cyclobutane, methylcyclopropane or mixtures of two or more thereof. Among these, propane, butane, isobutane, and their mixtures are preferred.

The refrigerating machine oil composition of the invention will ordinarily be in the form of a refrigerating machine fluid composition in admixture with the aforementioned refrigerant in a refrigerating machine. There are no particular restrictions on the mixing ratio of the refrigerating machine oil and refrigerant in the fluid composition, but it is preferably 1-500 parts by weight and more preferably 2-400 parts by weight of the refrigerating machine oil with respect to 100 parts by weight of the refrigerant.

The refrigerating machine oil composition of the invention provides a satisfactory balance between all of, the required performance properties including lubricity, refrigerant miscibility, low temperature flow property and stability, and it may be suitably used in a refrigeration device or heat pump comprising a reciprocating or rotating open-type or semi-closed-type or closed-type compressor. Particularly when used in a refrigeration device employing aluminum-based members, it allows both the anti-abrasion property and thermal/chemical stability of the aluminum-based members to be kept at a high level. More specifically, such refrigeration devices include automobile air conditioners, dehumidifiers, refrigerators, refrigerated storage rooms, vending machines, showcases, refrigerating apparatuses in chemical plants and the like, home air conditioners, package air conditioners, and water heater heat pumps. The refrigerating machine oil composition of the invention may be used in a reciprocating, rotating or centrifugal type of compressor.

A typical construction for a refrigerant circulation system which may employ the refrigerating machine oil composition of the invention comprises a refrigerant compressor, condenser, expansion mechanism and evaporator connected in that order along the flow path, and if necessary is also equipped with a drier in the flow path.

Refrigerant compressors may be exemplified by a high-pressure vessel compressor housing a motor comprising a rotor and a stator in a closed vessel holding refrigerating machine oil, a rotary shaft fitted on the rotor and a compressor section connected to the motor via the rotary shaft, wherein high-pressure refrigerant gas discharged from the compressor section accumulates in the closed vessel, or a low-pressure vessel compressor housing a motor comprising a rotor and a stator in a closed vessel holding refrigerating machine oil, a rotary shaft fitted on the rotor and a compressor section connected to the motor via the rotary shaft, wherein high-pressure refrigerant gas discharged from the compressor section is directly expelled out of the closed vessel.

The insulating film used as an electrical insulating system material in the motor is preferably a crystalline plastic film having a glass transition temperature of 50° C. or higher, and specifically, for example, at least one type of insulating film selected from the group consisting of polyethylene terephthalate, polybutylene terephthalate, polyphenylene sulfide, polyetherether ketone, polyethylene naphthalate, polyamideimide and polyimide, or a composite film comprising a resin layer having a high glass transition temperature coated on a film having a low glass transition temperature, from the standpoint of avoiding deterioration in tensile strength and electrical insulating property. The magnet wire used in the motor preferably has an enamel coating having a glass transition temperature of 120° C. or higher, such as, for example, an enamel coating comprising a single layer of a polyester, polyesterimide, polyamide or polyamideimide, or comprising a composite coating of a layer with a low glass transition temperature as the lower layer and a layer with a high glass transition temperature as the upper layer. As composite coated enamel wires there may be mentioned those having a polyesterimide as the lower layer and a polyamideimide as the upper layer (AI/EI), and those having a polyester as the lower layer and a polyamideimide as the upper layer (AI/PE).

The drying agent filling the drier is preferably synthetic zeolite composed of compound alkali metal salts of silicic acid and aluminic acid, having a pore size of no greater than 3.3 angstroms and a carbon dioxide gas absorption capacity of no greater than 1.0% at 25° C. and a carbon dioxide partial pressure of 250 mmHg. As specific examples there may be mentioned XH-9, XH-10, XH-11 and XH-600 (trade names) by Union Showa Co., Ltd.

EXAMPLES

The present invention will now be explained in greater detail based on examples and comparative examples, with the understanding that these examples are in no way limitative on the invention.

Examples 1-125, Comparative Examples 1-52

For Examples 1-125 and Comparative Examples 1-52, the following base oils and additives were used to prepare refrigerating machine oil compositions having the compositions shown in Tables 1 to 20.

(Base Oil)

Base oil 1: Tetraester of pentaerythritol and an equimolar mixture of 2-ethylhexanoic acid and 3,5,5-trimethylhexanoic acid (kinematic viscosity at 40° C.: 68.5 $mm^2/S$, pour point: −25° C.)

Base oil 2: Diester of 1,2-cyclohexanedicarboxylic acid and 2-ethylhexanol (kinematic viscosity at 40° C.: 15 $mm^2/s$, pour point: −40° C.)

Base oil 3: Random copolymer of vinyl ethyl ether and vinyl isobutyl ether (vinyl ethyl ether/vinyl isobutyl ether molar ratio: 7/1, number average molecular weight: 900, kinematic viscosity at 40° C.: 68.5 $mm^2/s$, kinematic viscosity at 100° C.: 8 $mm^2/s$, pour point: −40° C.)

Base oil 4: Naphthene-based mineral oil (kinematic viscosity at 40° C.: 56.6 $mm^2/s$, pour point: −30° C.)

Base oil 5: Polypropyleneglycol monomethylether (number average molecular weight: 1000, kinematic viscosity at 40° C.: 46 $mm^2/s$, kinematic viscosity at 100° C.: 10 $mM^2/s$, pour point: −40° C.).

(Phosphorus-Based Extreme Pressure Agent)

A1: Tricresyl phosphate
A2: Triphenyl phosphate
A3: Tri(n-octyl) phosphate.

(Oil Agent)

B1: Butyl stearate
B2: Diisobutyl adipate
B3: Diisodecyl adipate
B4: Glycerin monooleate
B5: Glycerin trioleate
B6: Oleyl alcohol
B7: Glyceryl ether
B8: Stearic acid.

(Other Additives)

C1: Di-t-butyl-p-cresol
C2: Glycidyl-2,2'-dimethyl octanoate
C3: Benzotriazole.

Next, each of the refrigerating machine oil compositions of Examples 1-125 and Comparative Examples 1-52 were subjected to the evaluation tests described below. The row "Refrigerant" in Tables 1-21 shows the type of refrigerant used in the friction property and abrasion property evaluation test and the stability evaluation test.

[Friction Property and Abrasion Property Evaluation Test 1]

The slide member of a FALEX Tester (ASTM D2714) was set in a pressure-resistant vessel, the refrigerant was introduced into the vessel, and a FALEX test was carried out under the following conditions.

Test materials: Steel ring, steel block
Test initial temperature: 80° C.
Test time: 1 hr
Sliding speed: 0.5 m/s
Load: 1250 N
Refrigerant atmosphere pressure: 500 kPa.

The frictional coefficient and oil temperature were measured every other second after the start of the FALEX test, and the mean values were calculated (hereinafter referred to as "mean frictional coefficient 1" and "mean oil temperature 1"). The block abrasion loss after completion of the test was determined in terms of volume reduction (hereinafter referred to as "abrasion volume 1"). The results are shown in Tables 1-20.

[Anti-Separation Property Evaluation Test 1]

Each refrigerating machine oil composition was cooled to a temperature of 5° C. higher than the pour point of the base oil in the composition, and the outer appearance of the composition was visually examined. The results are shown in Tables 1-20. Letters A-D in the tables stand for the following conditions.

A: Transparent

B: Slight cloudiness

C: Opaque

D: Total separation of additives

[Stability Evaluation Test 1]

A shielded glass tube test was carried out according to JIS K 2211 using iron, copper and aluminum as catalysts, and the presence of sludge was observed after a period of 2 weeks at 200° C. The results are shown in Tables 1-20. Letter A in the tables indicates that no sludge was found, and B indicates that sludge was found.

[Anti-Separation Property Evaluation Test 2]

First, base oils 1-5 were used to prepare test solutions comprising 20 vol% of each base oil and 80 vol % of refrigerant, and the bilayer separation temperature of the base oil and refrigerant was measured. The obtained results were as follows.

Base oil 1 and R410A: 10° C.

Base oil 2 and R134a: −35° C.

Base oil 3 and R410A: −50° C.

Base oil 4 and R22: −8° C.

Base oil 5 and R134a: −45° C.

An anti-separation property evaluation test was then conducted according to JIS K 2211. Specifically, a test solution was prepared comprising 20 vol % of the refrigerating machine oil composition and 80 vol % of refrigerant, the test solution was cooled to a temperature of 5° C. higher than the bilayer separation temperature of the base oil in the composition, the outer appearance of the composition was visually observed, and the anti-separation property was evaluated based on the following scale. The results are shown in Tables 1-20.

A: Transparent

B: Slight cloudiness

C: Completely opaque

D: Separation of additives

[Stability Evaluation Test 2]

A shielded glass tube test was carried out 5 according to JIS K 2211 using iron, copper and aluminum as catalysts, and the presence of sludge was observed after a period of 2 weeks at 175° C. The results are shown in Tables 1-20. Letter A in the tables indicates that no sludge was found, B indicates that a very small amount of sludge was found, and C indicates that a large amount of sludge was found.

TABLE 1

| | | Example 1 | Example 2 | Example 3 | Example 4 | Example 5 | Example 6 | Example 7 | Example 8 | Example 9 |
|---|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 | Base oil 1 |
| Additive (wt %) | A1 | 0.5 | — | — | 05 | — | — | 0.5 | — | — |
| | A2 | — | 0.5 | — | — | 0.5 | — | — | 0.5 | — |
| | A3 | — | — | 0.5 | — | — | 0.5 | — | — | 0.5 |
| | B1 | 0.5 | 0.5 | 0.5 | — | — | — | — | — | — |
| | B2 | — | — | — | 0.5 | 0.5 | 0.5 | — | — | — |
| | B3 | — | — | — | — | — | — | 0.5 | 0.5 | 0.5 |
| Refrigerant | | R410A | R410A | R410A | R410A | R410A | R410A | R410A | R410A | R410A |
| Mean frictional coefficient 1 | | 0.10 | 0.12 | 0.13 | 0.11 | 0.13 | 0.13 | 0.13 | 0.14 | 0.14 |
| Mean oil temp. 1 (° C.) | | 84 | 85 | 86 | 84 | 85 | 87 | 85 | 86 | 88 |
| Abrasion volume 1 ($mm^3$) | | 2.0 | 1.9 | 2.1 | 2.2 | 2.0 | 2.3 | 2.3 | 2.2 | 2.3 |
| Anti-separation property 1 | | A | A | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 2

| | | Example 10 | Example 11 | Example 12 | Example 13 | Example 14 | Example 15 | Example 16 | Example 17 | Example 18 |
|---|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 | Base oil 1 |
| Additive (wt %) | A1 | 0.1 | 1.0 | 2.0 | — | — | — | — | — | — |
| | A2 | — | — | — | 0.1 | 1.0 | 2.0 | — | — | — |
| | A3 | — | — | — | — | — | — | 0.1 | 1.0 | 2.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| Refrigerant | | R410A | R410A | R410A | R410A | R410A | R410A | R410A | R410A | R410A |
| Mean frictional coefficient 1 | | 0.14 | 0.12 | 0.14 | 0.14 | 0.14 | 0.14 | 0.14 | 0.14 | 0.14 |
| Mean oil temp. 1 (° C.) | | 92 | 88 | 91 | 92 | 89 | 92 | 89 | 90 | 93 |
| Abrasion volume 1 ($mm^3$) | | 2.8 | 1.9 | 2.2 | 2.8 | 2.0 | 2.2 | 2.8 | 2.2 | 2.3 |
| Anti-separation property 1 | | A | A | A | A | A | A | A | A | A |
| Stability 1 | | A | A | A | A | A | A | A | A | A |

TABLE 2-continued

| | Example 10 | Example 11 | Example 12 | Example 13 | Example 14 | Example 15 | Example 16 | Example 17 | Example 18 |
|---|---|---|---|---|---|---|---|---|---|
| Anti-separation property 2 | A | A | A | A | A | A | A | A | A |
| stability 2 | A | A | A | A | A | A | A | A | A |

TABLE 3

| | | Example 19 | Example 20 | Example 21 | Example 22 | Example 23 | Example 24 | Example 25 | Example 26 | Example 27 |
|---|---|---|---|---|---|---|---|---|---|---|
| Base oil | | Base oil 1 | Base oil 1 | Base oil 3 | Base oil 3 | Base oil 3 | Base oil 3 | Base oil 3 | Base oil 3 | Base oil 3 |
| Additive (wt %) | A1 | 0.5 | 0.5 | 0.5 | — | — | 0.5 | — | — | 0.5 |
| | A2 | — | — | — | 0.5 | — | — | 0.5 | — | — |
| | A3 | — | — | — | — | 0.5 | — | — | 0.5 | — |
| | B1 | — | — | 0.5 | 0.5 | 0.5 | — | — | — | — |
| | B2 | — | — | — | — | — | 0.5 | 0.5 | 0.5 | — |
| | B3 | — | — | — | — | — | — | — | — | 0.5 |
| | B4 | 0.5 | — | — | — | — | — | — | — | — |
| | B5 | — | 0.5 | — | — | — | — | — | — | — |
| Refrigerant | | R410A | R410A | R410A | R410A | R410A | R410A | R410A | R410A | R410A |
| Mean frictional coefficient 1 | | 0.13 | 0.15 | 0.12 | 0.13 | 0.13 | 0.12 | 0.13 | 0.14 | 0.12 |
| Mean oil temp. 1 (° C.) | | 94 | 94 | 88 | 89 | 91 | 90 | 92 | 92 | 91 |
| Abrasion volume 1 ($mm^3$) | | 2.7 | 2.8 | 2.6 | 2.8 | 2.9 | 2.7 | 2.9 | 2.9 | 2.8 |
| Anti-separation property 1 | | B | B | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 4

| | | Example 28 | Example 29 | Example 30 | Example 31 | Example 32 | Example 33 | Example 34 | Example 35 | Example 36 |
|---|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 | Base oil 3 |
| Additive (wt %) | A1 | — | — | 0.1 | 1.0 | 2.0 | — | — | — | — |
| | A2 | 0.5 | — | — | — | — | 0.1 | 1.0 | 2.0 | — |
| | A3 | — | 0.5 | — | — | — | — | — | — | 0.1 |
| | B1 | — | — | 0.1 | 1.0 | 2.0 | — | — | — | — |
| | B2 | — | — | — | — | — | 0.1 | 1.0 | 2.0 | — |
| | B3 | 0.5 | 0.5 | — | — | — | — | — | — | 1.0 |
| Refrigerant | | R410A | R410A | R410A | R410A | R410A | R410A | R410A | R410A | R410A |
| Mean frictional coefficient 1 | | 0.13 | 0.14 | 0.14 | 0.12 | 0.13 | 0.14 | 0.12 | 0.13 | 0.14 |
| Mean oil temp. 1 (° C.) | | 92 | 93 | 94 | 90 | 93 | 94 | 91 | 94 | 94 |
| Abrasion volume 1 ($mm^3$) | | 2.8 | 2.9 | 3.1 | 2.5 | 2.8 | 3.1 | 2.6 | 2.9 | 3.1 |
| Anti-separation property 1 | | A | A | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 5

| | | Example 37 | Example 38 | Example 39 | Example 40 | Example 41 | Example 42 | Example 43 | Example 44 |
|---|---|---|---|---|---|---|---|---|---|
| Base oil | | Base oil 3 | Base oil 3 | Base oil 3 | Base oil 3 | Base oil 1 | Base oil 1 | Base oil 3 | Base oil 3 |
| Additive (wt %) | A1 | — | — | 0.5 | 0.5 | 0.5 | — | 0.5 | — |
| | A2 | — | — | — | — | — | 0.5 | — | 0.5 |
| | A3 | 1.0 | 2.0 | — | — | — | — | — | — |

TABLE 5-continued

| | | Example 37 | Example 38 | Example 39 | Example 40 | Example 41 | Example 42 | Example 43 | Example 44 |
|---|---|---|---|---|---|---|---|---|---|
| | B1 | — | — | — | — | 0.5 | — | 0.5 | — |
| | B2 | — | — | — | — | — | 0.5 | — | — |
| | B3 | 1.0 | 2.0 | — | — | — | — | — | 0.5 |
| | B4 | — | — | 0.5 | — | — | — | — | — |
| | B5 | — | — | — | 0.5 | — | — | — | — |
| | C1 | — | — | — | — | 0.1 | 0.1 | 0.1 | 0.1 |
| | C2 | — | — | — | — | 0.5 | 0.5 | 0.5 | 0.5 |
| | C3 | — | — | — | — | — | 0.001 | — | 0.001 |
| Refrigerant | | R410A | R410A | R410A | R410A | R410A | R410A | R410A | R410A |
| Mean frictional coefficient 1 | | 0.12 | 0.13 | 0.12 | 0.14 | 0.10 | 0.08 | 0.11 | 0.10 |
| Mean oil temp. 1 (° C.) | | 91 | 94 | 94 | 94 | 83 | 82 | 87 | 85 |
| Abrasion volume 1 ($mm^3$) | | 2.8 | 3.0 | 3.1 | 3.1 | 1.9 | 1.5 | 2.5 | 2.2 |
| Anti-separation property 1 | | A | A | B | B | A | A | A | A |
| Stability 1 | | A | A | A | A | A | A | A | A |
| Anti-separation property 2 | | A | A | A | A | A | A | A | A |
| Stability 2 | | A | A | A | A | A | A | A | A |

TABLE 6

| | | Example 45 | Example 46 | Example 47 | Example 48 | Example 49 | Example 50 |
|---|---|---|---|---|---|---|---|
| Base oil | | Base oil 1 | Base oil 1 | Base oil 1 | Base oil 3 | Base oil 3 | Base oil 3 |
| Additive (wt %) | A1 | 1.0 | 1.0 | 1.0 | 1.0 | 1.0 | 1.0 |
| | A2 | — | — | — | — | — | — |
| | A3 | — | — | — | — | — | — |
| | B1 | — | — | — | — | — | — |
| | B2 | — | — | — | — | — | — |
| | B3 | — | — | — | — | — | — |
| | B4 | — | — | 1.0 | — | — | 1.0 |
| | B5 | — | 1.0 | — | — | 1.0 | — |
| | C1 | 1.0 | — | — | 1.0 | — | — |
| Refrigerant | | R410A | R410A | R410A | R410A | R410A | R410A |
| Mean frictional coefficient 1 | | 0.14 | 0.15 | 0.16 | 0.15 | 0.15 | 0.16 |
| Mean oil temp. 1 (° C.) | | 95 | 94 | 100 | 94 | 97 | 95 |
| Abrasion volume 1 ($mm^3$) | | 2.9 | 3.1 | 2.8 | 3.1 | 2.8 | 3.0 |
| Anti-separation property 1 | | B | C | D | B | C | D |
| Stability 1 | | B | A | A | B | A | A |
| Anti-separation property 2 | | A | B | B | A | B | B |
| Stability 2 | | A | A | A | A | A | A |

TABLE 7

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive (wt %) | A1 | — | 1.0 | — | — | — | — | — | — |
| | A2 | — | — | — | — | — | — | — | — |
| | A3 | — | — | — | — | — | — | — | — |
| | B1 | — | — | 1.0 | — | — | — | — | — |
| | B2 | — | — | — | 1.0 | — | — | — | — |
| | B3 | — | — | — | — | 1.0 | — | — | — |
| | B6 | — | — | — | — | — | 1.0 | — | — |
| | B7 | — | — | — | — | — | — | 1.0 | — |
| | B8 | — | — | — | — | — | — | — | 1.0 |
| Refrigerant | | R410A | R410A | R410A | R410A | R410A | R410A | R410A | R410A |
| Mean frictional coefficient 1 | | 0.17 | 0.19 | 0.17 | 0.18 | 0.19 | 0.16 | 0.15 | 0.13 |
| Mean oil temp. 1 (° C.) | | 95 | 99 | 94 | 98 | 99 | 94 | 95 | 93 |
| Abrasion volume 1 ($mm^3$) | | 2.9 | 2.9 | 3.1 | 3.3 | 3.1 | 3.2 | 3.5 | 3.3 |

TABLE 7-continued

| | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 |
|---|---|---|---|---|---|---|---|---|
| Anti-separation property 1 | — | A | A | A | A | D | C | B |
| Stability 1 | — | A | A | A | A | A | A | B |
| Anti-separation property 2 | — | A | A | A | A | B | B | A |
| Stability 2 | — | A | A | A | A | A | A | A |

TABLE 8

| | | Comp. Ex. 9 | Comp. Ex. 10 | Comp. Ex. 11 | Comp. Ex. 12 | Comp. Ex. 13 | Comp. Ex. 14 | Comp. Ex. 15 | Comp. Ex. 16 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive (wt %) | A1 | — | 1.0 | — | — | — | — | — | — |
| | A2 | — | — | — | — | — | — | — | — |
| | A3 | — | — | — | — | — | — | — | — |
| | B1 | — | — | 1.0 | — | — | — | — | — |
| | B2 | — | — | — | 1.0 | — | — | — | — |
| | B3 | — | — | — | — | 1.0 | — | — | — |
| | B6 | — | — | — | — | — | 1.0 | — | — |
| | B7 | — | — | — | — | — | — | 1.0 | — |
| | B8 | — | — | — | — | — | — | — | 1.0 |
| Refrigerant | | R410A | R410A | R410A | R410A | R410A | R410A | R410A | R410A |
| Mean frictional coefficient 1 | | 0.17 | 0.20 | 0.17 | 0.18 | 0.20 | 0.16 | 0.15 | 0.14 |
| Mean oil temp. 1 (° C.) | | 96 | 99 | 94 | 99 | 102 | 93 | 94 | 93 |
| Abrasion volume 1 ($mm^3$) | | 3.2 | 3.2 | 3.3 | 3.7 | 3.6 | 3.4 | 3.3 | 3.2 |
| Anti-separation property 1 | | A | A | A | A | A | D | C | B |
| Stability 1 | | A | A | A | A | A | A | A | B |
| Anti-separation property 2 | | A | A | A | A | A | B | B | A |
| Stability 2 | | A | A | A | A | A | A | A | A |

TABLE 9

| | | Example 51 | Example 52 | Example 53 | Example 54 | Example 55 | Example 56 | Example 57 | Example 58 | Example 59 |
|---|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 | Base oil 2 |
| Additive (wt %) | A1 | 0.5 | — | — | 05 | — | — | 0.5 | — | — |
| | A2 | — | 0.5 | — | — | 0.5 | — | — | 0.5 | — |
| | A3 | — | — | 0.5 | — | — | 0.5 | — | — | 0.5 |
| | B1 | 0.5 | 0.5 | 0.5 | — | — | — | — | — | — |
| | B2 | — | — | — | 0.5 | 0.5 | 0.5 | — | — | — |
| | B3 | — | — | — | — | — | — | 0.5 | 0.5 | 0.5 |
| Refrigerant | | R134a | R134a | R134a | R134a | R134a | R134a | R134a | R134a | R134a |
| Mean frictional coefficient 1 | | 0.11 | 0.12 | 0.14 | 0.12 | 0.13 | 0.14 | 0.12 | 0.14 | 0.15 |
| Mean oil temp. 1 (° C.) | | 85 | 87 | 89 | 87 | 88 | 90 | 88 | 90 | 90 |
| Abrasion volume 1 ($mm^3$) | | 3.0 | 3.0 | 3.2 | 3.1 | 3.3 | 3.3 | 3.2 | 3.3 | 3.4 |
| Anti-separation property 1 | | A | A | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 10

| | Example 60 | Example 61 | Example 62 | Example 63 | Example 64 | Example 65 | Example 66 | Example 67 | Example 68 |
|---|---|---|---|---|---|---|---|---|---|
| Base oil | Base oil 2 | Base oil 2 | Base oil 2 | Base oil 2 | Base oil 2 | Base oil 2 | Base oil 2 | Base oil 2 | Base oil 2 |

TABLE 10-continued

| | | Example 60 | Example 61 | Example 62 | Example 63 | Example 64 | Example 65 | Example 66 | Example 67 | Example 68 |
|---|---|---|---|---|---|---|---|---|---|---|
| Additive (wt %) | A1 | 0.1 | 1.0 | 2.0 | — | — | — | — | — | — |
| | A2 | — | — | — | 0.1 | 1.0 | 2.0 | — | — | — |
| | A3 | — | — | — | — | — | — | 0.1 | 1.0 | 2.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| Refrigerant | | R134a | R134a | R134a | R134a | R134a | R134a | R134a | R134a | R134a |
| Mean frictional coefficient 1 | | 0.16 | 0.13 | 0.15 | 0.16 | 0.14 | 0.15 | 0.16 | 0.15 | 0.16 |
| Mean oil temp. 1 (° C.) | | 94 | 88 | 92 | 94 | 89 | 93 | 94 | 91 | 94 |
| Abrasion volume 1 ($mm^3$) | | 3.4 | 2.8 | 3.0 | 3.4 | 2.9 | 3.0 | 3.4 | 2.9 | 3.1 |
| Anti-separation property 1 | | A | A | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 11

| | | Example 69 | Example 70 | Example 71 | Example 72 | Example 73 | Example 74 | Example 75 | Example 76 | Example 77 |
|---|---|---|---|---|---|---|---|---|---|---|
| Base oil | | Base oil 2 | Base oil 2 | Base oil 5 | Base oil 5 | Base oil 5 | Base oil 5 | Base oil 5 | Base oil 5 | Base oil 5 |
| Additive (wt %) | A1 | 0.5 | 0.5 | 0.5 | — | — | 0.5 | — | — | 0.5 |
| | A2 | — | — | — | 0.5 | — | — | 0.5 | — | — |
| | A3 | — | — | — | — | 0.5 | — | — | 0.5 | — |
| | B1 | — | — | 0.5 | 0.5 | 0.5 | — | — | — | — |
| | B2 | — | — | — | — | — | 0.5 | 0.5 | 0.5 | — |
| | B3 | — | — | — | — | — | — | — | — | 0.5 |
| | B4 | 0.5 | — | — | — | — | — | — | — | — |
| | B5 | — | 0.5 | — | — | — | — | — | — | — |
| Refrigerant | | R134a | R134a | R134a | R134a | R134a | R134a | R134a | R134a | R134a |
| Mean frictional coefficient 1 | | 0.14 | 0.17 | 0.12 | 0.13 | 0.14 | 0.13 | 0.15 | 0.15 | 0.13 |
| Mean oil temp. 1 (° C.) | | 94 | 94 | 86 | 87 | 89 | 87 | 88 | 90 | 88 |
| Abrasion volume 1 ($mm^3$) | | 3.2 | 3.4 | 3.3 | 3.4 | 3.4 | 3.3 | 3.4 | 3.5 | 3.3 |
| Anti-separation property 1 | | B | B | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 12

| | | Example 78 | Example 79 | Example 80 | Example 81 | Example 82 | Example 83 | Example 84 | Example 85 | Example 86 |
|---|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 | Base oil 5 |
| Additive (wt %) | A1 | — | — | 0.1 | 1.0 | 2.0 | — | — | — | — |
| | A2 | 0.5 | — | — | — | — | 0.1 | 1.0 | 2.0 | — |
| | A3 | — | 0.5 | — | — | — | — | — | — | 0.1 |
| | B1 | — | — | 0.1 | 1.0 | 2.0 | — | — | — | — |
| | B2 | — | — | — | — | — | 0.1 | 1.0 | 2.0 | — |
| | B3 | 0.5 | 0.5 | — | — | — | — | — | — | 0.1 |
| Refrigerant | | R134a | R134a | R134a | R134a | R134a | R134a | R134a | R134a | R134a |
| Mean frictional coefficient 1 | | 0.15 | 0.16 | 0.18 | 0.13 | 0.14 | 0.18 | 0.14 | 0.15 | 0.18 |
| Mean oil temp. 1 (° C.) | | 90 | 92 | 94 | 88 | 92 | 94 | 89 | 93 | 94 |

TABLE 12-continued

| | Example 78 | Example 79 | Example 80 | Example 81 | Example 82 | Example 83 | Example 84 | Example 85 | Example 86 |
|---|---|---|---|---|---|---|---|---|---|
| Abrasion volume 1 ($mm^3$) | 3.5 | 3.5 | 3.8 | 3.1 | 3.3 | 3.8 | 3.2 | 3.5 | 3.8 |
| Anti-separation property 1 | A | A | A | A | A | A | A | A | A |
| Stability 1 | A | A | A | A | A | A | A | A | A |
| Anti-separation property 2 | A | A | A | A | A | A | A | A | A |
| Stability 2 | A | A | A | A | A | A | A | A | A |

TABLE 13

| | | Example 87 | Example 88 | Example 89 | Example 90 | Example 91 | Example 92 | Example 93 | Example 94 |
|---|---|---|---|---|---|---|---|---|---|
| Base oil | | Base oil 5 | Base oil 5 | Base oil 5 | Base oil 5 | Base oil 2 | Base oil 2 | Base oil 5 | Base oil 5 |
| Additive (wt %) | A1 | — | — | 0.5 | 0.5 | — | 0.5 | — | — |
| | A2 | — | — | — | — | — | — | 0.5 | — |
| | A3 | 1.0 | 2.0 | — | — | 0.5 | — | — | 0.5 |
| | B1 | — | — | — | — | — | — | — | 0.5 |
| | B2 | — | — | — | — | 0.5 | — | — | — |
| | B3 | 1.0 | 2.0 | — | — | — | 0.5 | 0.5 | — |
| | B4 | — | — | 0.5 | — | — | — | — | — |
| | B5 | — | — | — | 0.5 | — | — | — | — |
| | C1 | — | — | — | — | 0.1 | 0.1 | 0.1 | 0.1 |
| | C2 | — | — | — | — | 0.5 | 0.5 | 0.5 | 0.5 |
| | C3 | — | — | — | — | — | 0.001 | — | 0.001 |
| Refrigerant | | R134a | R134a | R134a | R134a | R134a | R134a | R134a | R134a |
| Mean frictional coefficient 1 | | 0.15 | 0.16 | 0.14 | 0.16 | 0.13 | 0.0.09 | 0.14 | 0.10 |
| Mean oil temp. 1 (° C.) | | 91 | 94 | 94 | 94 | 89 | 85 | 89 | 87 |
| Abrasion volume 1 ($mm^3$) | | 3.3 | 3.7 | 3.8 | 3.8 | 3.2 | 2.6 | 3.4 | 2.7 |
| Anti-separation property 1 | | A | A | B | B | A | A | A | A |
| Stability 1 | | A | A | A | A | A | A | A | A |
| Anti-separation property 2 | | A | A | A | A | A | A | A | A |
| Stability 2 | | A | A | A | A | A | A | A | A |

TABLE 14

| | | Example 95 | Example 96 | Example 97 | Example 98 | Example 99 | Example 100 |
|---|---|---|---|---|---|---|---|
| Base oil | | Base oil 2 | Base oil 2 | Base oil 2 | Base oil 5 | Base oil 5 | Base oil 5 |
| Additive (wt %) | A1 | 1.0 | 1.0 | 1.0 | 1.0 | 1.0 | 1.0 |
| | A2 | — | — | — | — | — | — |
| | A3 | — | — | — | — | — | — |
| | B1 | — | — | — | — | — | — |
| | B2 | — | — | — | — | — | — |
| | B3 | — | — | — | — | — | — |
| | B6 | — | — | 1.0 | — | — | 1.0 |
| | B7 | — | 1.0 | — | — | 1.0 | — |
| | B8 | 1.0 | — | — | 1.0 | — | — |
| Refrigerant | | R134a | R134a | R134a | R134a | R134a | R134a |
| Mean frictional coefficient 1 | | 0.14 | 0.16 | 0.17 | 0.14 | 0.16 | 0.17 |
| Mean oil temp. 1 (° C.) | | 94 | 95 | 100 | 93 | 97 | 96 |
| Abrasion volume 1 ($mm^3$) | | 3.0 | 3.1 | 3.2 | 3.5 | 3.3 | 3.4 |
| Anti-separation property 1 | | B | C | D | B | C | D |
| Stability 1 | | B | A | A | B | A | A |
| Anti-separation propery 2 | | A | B | B | A | B | B |
| Stability 2 | | A | A | A | A | A | A |

TABLE 15

| | | Comp. Ex. 17 | Comp. Ex. 18 | Comp. Ex. 19 | Comp. Ex. 20 | Comp. Ex. 21 | Comp. Ex. 22 | Comp. Ex. 23 | Comp. Ex. 24 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | — | 1.0 | — | — | — | — | — | — |
| (wt %) | A2 | — | — | — | — | — | — | — | — |
| | A3 | — | — | — | — | — | — | — | — |
| | B1 | — | — | 1.0 | — | — | — | — | — |
| | B2 | — | — | — | 1.0 | — | — | — | — |
| | B3 | — | — | — | — | 1.0 | — | — | — |
| | B6 | — | — | — | — | — | 1.0 | — | — |
| | B7 | — | — | — | — | — | — | 1.0 | — |
| | B8 | — | — | — | — | — | — | — | 1.0 |
| Refrigerant | | R134a | R134a | R134a | R134a | R134a | R134a | R134a | R134a |
| Mean frictional coefficient 1 | | 0.18 | 0.19 | 0.17 | 0.18 | 0.20 | 0.16 | 0.15 | 0.13 |
| Mean oil temp. 1 (° C.) | | 96 | 99 | 94 | 99 | 102 | 93 | 94 | 93 |
| Abrasion volume 1 ($mm^3$) | | 3.5 | 3.5 | 3.6 | 3.8 | 3.6 | 3.5 | 3.7 | 3.1 |
| Anti-separation property 1 | | — | A | A | A | A | D | C | B |
| Stability 1 | | — | A | A | A | A | A | A | B |
| Anti-separation property 2 | | — | A | A | A | A | B | B | A |
| Stability 2 | | — | A | A | A | A | A | A | A |

TABLE 16

| | | Comp. Ex. 25 | Comp. Ex. 26 | Comp. Ex. 27 | Comp. Ex. 28 | Comp. Ex. 29 | Comp. Ex. 30 | Comp. Ex. 31 | Comp. Ex. 32 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A1 | — | 1.0 | — | — | — | — | — | — |
| (wt %) | A2 | — | — | — | — | — | — | — | — |
| | A3 | — | — | — | — | — | — | — | — |
| | B1 | — | — | 1.0 | — | — | — | — | — |
| | B2 | — | — | — | 1.0 | — | — | — | — |
| | B3 | — | — | — | — | 1.0 | — | — | — |
| | B6 | — | — | — | — | — | 1.0 | — | — |
| | B7 | — | — | — | — | — | — | 1.0 | — |
| | B8 | — | — | — | — | — | — | — | 1.0 |
| Refrigerant | | R134a | R134a | R134a | R134a | R134a | R134a | R134a | R134a |
| Mean frictional coefficient 1 | | 0.18 | 0.21 | 0.18 | 0.19 | 0.19 | 0.16 | 0.15 | 0.13 |
| Mean oil temp. 1 (° C.) | | 96 | 101 | 91 | 99 | 101 | 94 | 92 | 91 |
| Abrasion volume 1 ($mm^3$) | | 3.9 | 3.9 | 4.5 | 4.2 | 4.1 | 3.9 | 3.9 | 4.0 |
| Anti-separation property 1 | | A | A | A | A | A | D | C | D |
| Stability 1 | | A | A | A | A | A | A | A | A |
| Anti-separation property 2 | | A | A | A | A | A | B | B | B |
| stability 2 | | A | A | A | A | A | A | A | A |

TABLE 17

| | | Example 101 | Example 102 | Example 103 | Example 104 | Example 105 | Example 106 | Example 107 | Example 108 | Example 109 |
|---|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 | Base oil 4 |
| Additive | A1 | 0.5 | — | — | 0.5 | — | — | 0.5 | — | — |
| (wt %) | A2 | — | 0.5 | — | — | 0.5 | — | — | 0.5 | — |
| | A3 | — | — | 0.5 | — | — | 0.5 | — | — | 0.5 |
| | B1 | 0.5 | 0.5 | 0.5 | — | — | — | — | — | — |
| | B2 | — | — | — | 0.5 | 0.5 | 0.5 | — | — | — |
| | B3 | — | — | — | — | — | — | 0.5 | 0.5 | 0.5 |
| Refrigerant | | R22 | R22 | R22 | R22 | R22 | R22 | R22 | R22 | R22 |
| Mean frictional coefficient 1 | | 0.10 | 0.11 | 0.12 | 0.11 | 0.11 | 0.12 | 0.11 | 0.12 | 0.13 |

TABLE 17-continued

| | Example 101 | Example 102 | Example 103 | Example 104 | Example 105 | Example 106 | Example 107 | Example 108 | Example 109 |
|---|---|---|---|---|---|---|---|---|---|
| Mean oil temp. 1 (° C.) | 84 | 86 | 87 | 84 | 85 | 87 | 84 | 86 | 87 |
| Abrasion volume 1 ($mm^3$) | 2.0 | 2.1 | 2.1 | 2.0 | 2.2 | 2.2 | 2.1 | 2.1 | 2.2 |
| Anti-separation property 1 | A | A | A | A | A | A | A | A | A |
| Stability 1 | A | A | A | A | A | A | A | A | A |
| Anti-separation property 2 | A | A | A | A | A | A | A | A | A |
| Stability 2 | A | A | A | A | A | A | A | A | A |

TABLE 18

| | | Example 110 | Example 111 | Example 112 | Example 113 | Example 114 | Example 115 | Example 116 | Example 117 | Example 118 |
|---|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 | Base oil 4 |
| Additive (wt %) | A1 | 0.1 | 1.0 | 2.0 | — | — | — | — | — | — |
| | A2 | — | — | — | 0.1 | 1.0 | 2.0 | — | — | — |
| | A3 | — | — | — | — | — | — | 0.1 | 1.0 | 2.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| Refrigerant | | R22 | R22 | R22 | R22 | R22 | R22 | R22 | R22 | R22 |
| Mean frictional coefficient 1 | | 0.11 | 0.12 | 0.13 | 0.11 | 0.12 | 0.13 | 0.111 | 0.13 | 0.13 |
| Mean oil temp. 1 (° C.) | | 86 | 85 | 88 | 84 | 86 | 89 | 85 | 86 | 89 |
| Abrasion volume 1 ($mm^3$) | | 2.4 | 1.9 | 2.1 | 2.4 | 2.1 | 2.2 | 2.4 | 2.1 | 2.3 |
| Anti-separation property 1 | | A | A | A | A | A | A | A | A | A |
| Stability 1 | | A | A | A | A | A | A | A | A | A |
| Anti-separation property 2 | | A | A | A | A | A | A | A | A | A |
| Stability 2 | | A | A | A | A | A | A | A | A | A |

TABLE 19

| | | Example 119 | Example 120 | Example 121 | Example 122 | Example 123 | Example 124 | Example 125 |
|---|---|---|---|---|---|---|---|---|
| Base oil | | Base oil 4 | Base oil 4 | Base oil 4 | Base oil 4 | Base oil 4 | Base oil 4 | Base oil 4 |
| Additive (wt %) | A1 | 0.5 | 0.5 | — | 0.5 | 1.0 | 1.0 | 1.0 |
| | A2 | — | — | — | — | — | — | — |
| | A3 | — | — | 0.5 | — | — | — | — |
| | B1 | — | — | 0.5 | — | — | — | — |
| | B2 | — | — | — | 0.5 | — | — | — |
| | B3 | — | — | — | — | — | — | — |
| | B4 | 0.5 | — | — | — | — | — | — |
| | B5 | — | 0.5 | — | — | — | — | — |
| | B6 | — | — | — | — | — | — | 1.0 |
| | B7 | — | — | — | — | — | 1.0 | — |
| | B8 | — | — | — | — | 1.0 | — | — |
| | C1 | — | — | 0.1 | 0.1 | — | — | — |
| | C2 | — | — | 0.5 | 0.5 | — | — | — |
| | C3 | — | — | — | 0.001 | — | — | — |
| Refrigerant | | R22 | R22 | R22 | R22 | R22 | R22 | R22 |
| Mean frictional coefficient 1 | | 0.11 | 0.13 | 0.11 | 0.08 | 0.13 | 0.15 | 0.16 |
| Mean oil temp. 1 (° C.) | | 89 | 79 | 86 | 81 | 91 | 94 | 94 |
| Abrasion volume 1 ($mm^3$) | | 2.3 | 2.3 | 2.0 | 1.5 | 2.6 | 2.7 | 2.5 |
| Anti-separation property 1 | | B | B | A | A | B | C | D |

TABLE 19-continued

| | Example 119 | Example 120 | Example 121 | Example 122 | Example 123 | Example 124 | Example 125 |
|---|---|---|---|---|---|---|---|
| Stability 1 | A | A | A | A | B | A | A |
| Anti-separation property 2 | A | A | A | A | A | B | B |
| Stability 2 | A | A | A | A | A | A | A |

TABLE 20

| | | Comp. Ex. 45 | Comp. Ex. 46 | Comp. Ex. 47 | Comp. Ex. 48 | Comp. Ex. 49 | Comp. Ex. 50 | Comp. Ex. 51 | Comp. Ex. 52 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive (wt %) | A1 | — | 1.0 | — | — | — | — | — | — |
| | A2 | — | — | — | — | — | — | — | — |
| | A3 | — | — | — | — | — | — | — | — |
| | B1 | — | — | 1.0 | — | — | — | — | — |
| | B2 | — | — | — | 1.0 | — | — | — | — |
| | B3 | — | — | — | — | 1.0 | — | — | — |
| | B6 | — | — | — | — | — | 1.0 | — | — |
| | B7 | — | — | — | — | — | — | 1.0 | — |
| | B8 | — | — | — | — | — | — | — | 1.0 |
| Refrigerant | | R22 | R22 | R22 | R22 | R22 | R22 | R22 | R22 |
| Mean frictional coefficient 1 | | 0.16 | 0.18 | 0.17 | 0.16 | 0.18 | 0.15 | 0.14 | 0.12 |
| Mean oil temp. 1 (° C.) | | 93 | 100 | 91 | 94 | 102 | 92 | 93 | 90 |
| Abrasion volume 1 ($mm^3$) | | 2.5 | 2.4 | 3.0 | 2.9 | 3.1 | 2.8 | 3.0 | 2.7 |
| Anti-separation property 1 | | A | A | A | A | A | D | C | B |
| Stability 1 | | A | A | A | A | A | A | A | B |
| Anti-separation property 2 | | A | A | A | A | A | B | B | A |
| Stability 2 | | A | A | A | A | A | A | A | A |

[Friction Property Evaluation Test 2]

The frictional coefficients of the refrigerating machine oil compositions of Examples 1,21, 41, 43, 56, 78, 91, 93, 103 and 121 were measured using an SRV tester by Optimol Inc., between a ½ inch SUJ2 steel ball and an SUJ2 disc (ϕ10 mm). The test conditions were a load of 100 N, an amplitude of 1 mm and a frequency of 25 Hz, and the frictional coefficient was recorded every second from the start of the test until 20 minutes thereafter, with the average being taken as the mean frictional coefficient (hereinafter referred to as "mean frictional coefficient 2". The refrigerant was circulated to the slide member at a flow rate of 10 L/h. The results are shown in Tables 21 and 22. In this test, the refrigerant type was selected depending on the type of base oil in the refrigerating machine oil composition. The refrigerant types used are shown in Tables 21-22.

TABLE 21

| | | Example 1 | Example 41 | Example 21 | Example 43 | Example 56 | Example 91 |
|---|---|---|---|---|---|---|---|
| Base oil | | Base oil 1 | Base oil 1 | Base oil 3 | Base oil 3 | Base oil 2 | Base oil 2 |
| Additive (wt %) | A1 | 0.5 | 0.5 | 0.5 | 0.5 | — | — |
| | A2 | — | — | — | — | — | — |
| | A3 | — | — | — | — | 0.5 | 0.5 |
| | B1 | 0.5 | 0.5 | 0.5 | 0.5 | — | — |
| | B2 | — | — | — | — | 0.5 | 0.5 |
| | B3 | — | — | — | — | — | — |
| | B4 | — | — | — | — | — | — |
| | B5 | — | — | — | — | — | — |
| | C1 | — | 0.1 | — | 0.1 | — | 0.1 |
| | C2 | — | 0.5 | — | 0.5 | — | 0.5 |
| | C3 | — | — | — | — | — | — |
| Refrigerant | | R410A | R410A | R410A | R410A | R134a | R134a |
| Mean frictional coefficient 2 | | 0.117 | 0.105 | 0.122 | 0.109 | 0.142 | 0.129 |

TABLE 22

| | | Example 78 | Example 93 | Example 103 | Example 121 |
|---|---|---|---|---|---|
| Base oil | | Base oil 5 | Base oil 5 | Base oil 4 | Base oil 4 |
| Additive | A1 | — | — | — | — |
| (wt %) | A2 | 0.5 | 0.5 | — | — |
| | A3 | — | — | 0.5 | 0.5 |
| | B1 | — | — | 0.5 | 0.5 |
| | B2 | — | — | — | — |
| | B3 | 0.5 | 0.5 | — | — |
| | B4 | — | — | — | — |
| | B5 | — | — | — | — |
| | C1 | — | 0.1 | — | 0.1 |
| | C2 | — | 0.5 | — | 0.5 |
| | C3 | — | — | — | — |
| Refrigerant | | R134a | R134a | R22 | R22 |
| Mean frictional coefficient 2 | | 0.149 | 0.141 | 0.122 | 0.109 |

[Examples 126-452, Comparative Examples 53-100]

Refrigerating machine oil compositions having the compositions shown in Tables 23-74 were prepared using the following base oils and additives, for Examples 126-452 and Comparative Examples 53-100.

(Base Oil)

Base oil 1: Tetraester of pentaerythritol and an equimolar mixture of 2-ethylhexanoic acid and 3,5,5-trimethylhexanoic acid (kinematic viscosity at 40° C.: 68.5 $mm^2/s$, pour point: −25° C.)

Base oil 2: Diester of 1,2-cyclohexanedicarboxylic acid and 2-ethylhexanol (kinematic viscosity at 40° C.: 15 $mm^2/s$, pour point: −40° C.)

Base oil 3: Random copolymer of vinyl ethyl ether and vinyl isobutyl ether (vinyl ethyl ether/vinyl isobutyl ether molar ratio: 7/1, number average molecular weight: 900, kinematic viscosity at 40° C.: 68.5 $mm^2/s$, kinematic viscosity at 100° C.: 8 $mm^2/s$, pour point: −40° C.)

Base oil 4: Naphthene-based mineral oil (kinematic viscosity at 40° C.: 56.6 $mm^2/s$, pour point: −30° C.)

Base oil 5: Polypropyleneglycol monomethylether (number average molecular weight: 1000, kinematic viscosity at 40° C.: 46 $mm^2/s$, kinematic viscosity at 100° C.: 10 $mm^2/s$, pour point: −40° C.).

Base oil 6: Complete ester of a mixture of dipentaerythritol and pentaerythritol (molar ratio=1:1) with a mixture of 2-ethylhexanoic acid and 3,5,5-trimethylhexanoic acid (molar ratio=1:1) (kinematic viscosity at 40° C.: 195 $mm^2/s$, pour point: −30° C.)

Base oil 7: Paraffin-based mineral oil (kinematic viscosity at 40° C.: 92 $mm^2/s$, pour point: −15° C.)

Base oil 8: Paraffin-based mineral oil (kinematic viscosity at 40° C.: 12 $mm^2/s$, pour point: −30° C.).

(Phosphorus-Based Extreme Pressure Agent)

A4: Triphenyl phosphorothionate

A5: Tricresyl phosphorothionate

A6: Tri(n-octyl) phosphorothionate.

(Oil Agent)

B1: Butyl stearate

B2: Diisobutyl adipate

B3: Diisodecyl adipate

B4: Glycerin monooleate

B5: Glycerin trioleate

B6: Oleyl alcohol

B7: 2-Ethylhexyl glyceryl ether

B8: Stearic acid.

(Other Additives)

C1: Di-t-butyl-p-cresol

C2: Glycidyl-2,2'-dimethyl octanoate

C3: Benzotriazole.

[Friction Property and Abrasion Property Evaluation Test 3]

Each of the refrigerating machine oil compositions of Examples 126-452 and Comparative Examples 41-100 were subjected to the evaluation tests described below. The row "Refrigerant" in Tables 23-74 shows the type of refrigerant used in the friction property and abrasion property evaluation test.

A FALEX test (ASTM D2670) was conducted under the following conditions while blowing the refrigerant into the refrigerating machine oil composition.

Test initial temperature: 25° C.

Test time: 30 min

Load: 1334 N

Refrigerant blow-in rate: 10 L/h

The frictional coefficient and oil temperature were measured every other second after the start of the FALEX test, and the mean values were calculated (hereinafter referred to as "mean frictional coefficient 3" and "mean oil temperature 3"). The weights of the pin and block were measured after completion of the test, and the abrasion loss was determined in terms of weight reduction (hereinafter referred to as "abrasion loss 3"). The results are shown in Tables 23-74.

TABLE 23

| | | Example 126 | Example 127 | Example 128 | Example 129 | Example 130 | Example 131 | Example 132 | Example 133 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A4 | 0.1 | 0.1 | 0.1 | 0.1 | 0.1 | 0.1 | 0.1 | 0.1 |
| (wt %) | A5 | — | — | — | — | — | — | — | — |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.101 | 0.102 | 0.103 | 0.102 | 0.113 | 0.111 | 0.108 | 0.109 |
| Mean oil temp. 3 (° C.) | | 45 | 45 | 46 | 46 | 47 | 52 | 51 | 51 |

TABLE 23-continued

| | Example 126 | Example 127 | Example 128 | Example 129 | Example 130 | Example 131 | Example 132 | Example 133 |
|---|---|---|---|---|---|---|---|---|
| Abrasion loss 3 (mg) | 7.8 | 7.5 | 7.9 | 8.4 | 8.6 | 8.5 | 8.8 | 8.8 |

TABLE 24

| | | Example 134 | Example 135 | Example 136 | Example 137 | Example 138 | Example 139 | Example 140 | Example 141 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A4 | — | — | — | — | — | — | — | — |
| (wt %) | A5 | 0.1 | 0.1 | 0.1 | 0.1 | 0.1 | 0.1 | 0.1 | 0.1 |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.101 | 0.101 | 0.102 | 0.103 | 0.114 | 0.113 | 0.109 | 0.110 |
| Mean oil temp. 3 (° C.) | | 44 | 45 | 45 | 44 | 46 | 50 | 52 | 51 |
| Abrasion loss 3 (mg) | | 7.4 | 7.6 | 7.2 | 8.5 | 8.6 | 8.9 | 8.6 | 9.2 |

TABLE 25

| | | Example 142 | Example 143 | Example 144 | Example 145 | Example 146 | Example 147 | Example 148 | Example 149 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A4 | — | — | — | — | — | — | — | — |
| (wt %) | A5 | — | — | — | — | — | — | — | — |
| | A6 | 0.1 | 0.1 | 0.1 | 0.1 | 0.1 | 0.1 | 0.1 | 0.1 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.102 | 0.103 | 0.103 | 0.102 | 0.114 | 0.112 | 0.109 | 0.110 |
| Mean oil temp. 3 (° C.) | | 49 | 44 | 44 | 43 | 43 | 52 | 52 | 51 |
| Abrasion loss 3 (mg) | | 7.8 | 7.9 | 7.9 | 8.5 | 8.6 | 8.6 | 8.5 | 8.6 |

TABLE 26

| | | Example 150 | Example 151 | Example 152 | Example 153 | Example 154 | Example 155 | Example 156 | Example 157 | Example 158 |
|---|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 | Base oil 1 |
| Additive | A4 | 0.01 | 0.3 | 0.10 | — | — | — | — | — | — |
| (wt %) | A5 | — | — | — | 0.01 | 0.3 | 1.0 | — | — | — |
| | A6 | — | — | — | — | — | — | 0.01 | 0.3 | 1.0 |
| | B1 | 0.1 | 1.0 | 2.0 | — | — | — | — | — | — |
| | B2 | | | | 0.1 | 1.0 | 2.0 | — | — | — |
| | B3 | — | — | — | — | — | — | 0.1 | 1.0 | 2.0 |
| | B4 | — | — | — | — | — | — | — | — | — |
| | B5 | — | — | — | — | — | — | — | — | — |
| | B6 | — | — | — | — | — | — | — | — | — |

TABLE 26-continued

| | | Example 150 | Example 151 | Example 152 | Example 153 | Example 154 | Example 155 | Example 156 | Example 157 | Example 158 |
|---|---|---|---|---|---|---|---|---|---|---|
| | B7 | — | — | — | — | — | — | — | — | — |
| | B8 | — | — | — | — | — | — | — | — | — |
| Refrigerant | | R410A | R410A | R410A | R410A | R410A | R410A | R410A | R410A | R410A |
| Mean frictional coefficient 3 | | 0.113 | 0.104 | 0.106 | 0.111 | 0.104 | 0.106 | 0.110 | 0.102 | 0.105 |
| Mean oil temp. 3 (° C.) | | 48 | 46 | 48 | 46 | 46 | 48 | 48 | 46 | 49 |
| Abrasion loss 3 (mg) | | 12.2 | 7.2 | 8.0 | 12.1 | 7.5 | 7.9 | 12.3 | 7.7 | 8.4 |

TABLE 27

| | | Example 159 | Example 160 | Example 161 | Example 162 | Example 163 | Example 164 | Example 165 | Example 166 | Example 167 |
|---|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 | Base oil 1 |
| Additive (wt %) | A4 | 0.01 | 0.3 | 1.0 | — | — | — | — | — | — |
| | A5 | — | — | — | 0.01 | 0.3 | 1.0 | — | — | — |
| | A6 | — | — | — | — | — | — | 0.01 | 0.3 | 1.0 |
| | B1 | — | — | — | — | — | — | — | — | — |
| | B2 | — | — | — | — | — | — | — | — | — |
| | B3 | — | — | — | — | — | — | — | — | — |
| | B4 | 0.1 | 1.0 | 2.0 | — | — | — | — | — | — |
| | B5 | — | — | — | 0.1 | 1.0 | 2.0 | — | — | — |
| | B6 | — | — | — | — | — | — | 0.1 | 1.0 | 2.0 |
| | B7 | — | — | — | — | — | — | — | — | — |
| | B8 | — | — | — | — | — | — | — | — | — |
| Refrigerant | | R410A | R410A | R410A | R410A | R410A | R410A | R410A | R410A | R410A |
| Mean frictional coefficient 3 | | 0.112 | 0.100 | 0.105 | 0.110 | 0.112 | 0.113 | 0.118 | 0.113 | 0.115 |
| Mean oil temp. 3 (° C.) | | 48 | 46 | 49 | 50 | 46 | 47 | 52 | 50 | 52 |
| Abrasion loss 3 (mg) | | 12.2 | 8.5 | 8.8 | 12.1 | 8.6 | 8.7 | 12.2 | 8.4 | 8.6 |

TABLE 28

| | | Example 168 | Example 169 | Example 170 | Example 171 | Example 172 | Example 173 |
|---|---|---|---|---|---|---|---|
| Base oil | | Base oil 1 | Base oil 1 | Base oil 1 | Base oil 1 | Base oil 1 | Base oil 1 |
| Additive (wt %) | A4 | 0.01 | 0.3 | 1.0 | — | — | — |
| | A5 | — | — | — | 0.01 | 0.3 | 1.0 |
| | A6 | — | — | — | — | — | — |
| | B1 | — | — | — | — | — | — |
| | B2 | — | — | — | — | — | — |
| | B3 | — | — | — | — | — | — |
| | B4 | — | — | — | — | — | — |
| | B5 | — | — | — | — | — | — |
| | B6 | — | — | — | — | — | — |
| | B7 | 0.1 | 1.0 | 2.0 | — | — | — |
| | B8 | — | — | — | 0.1 | 1.0 | 2.0 |
| Refrigerant | | R410A | R410A | R410A | R410A | R410A | R410A |
| Mean frictional coefficient 3 | | 0.114 | 0.110 | 0.112 | 0.117 | 0.111 | 0.112 |
| Mean oil temp. 3 (° C.) | | 53 | 51 | 51 | 52 | 51 | 51 |
| Abrasion loss 3 (mg) | | 12.0 | 9.2 | 9.0 | 11.8 | 9.1 | 9.2 |

TABLE 29

| | | Example 174 | Example 175 | Example 176 | Example 177 | Example 178 | Example 179 | Example 180 |
|---|---|---|---|---|---|---|---|---|
| Base oil | | Base oil 1 | Base oil 1 | Base oil 1 | Base oil 1 | Base oil 1 | Base oil 1 | Base oil 1 |
| Additive (wt %) | A4 | 0.1 | 0.1 | 0.1 | 0.1 | 0.1 | 0.1 | 0.1 |
| | A5 | — | — | — | — | — | — | — |
| | A6 | — | — | — | — | — | — | — |

TABLE 29-continued

| | | Example 174 | Example 175 | Example 176 | Example 177 | Example 178 | Example 179 | Example 180 |
|---|---|---|---|---|---|---|---|---|
| | B1 | 0.5 | — | — | — | — | 0.5 | — |
| | B2 | — | — | — | — | — | — | — |
| | B3 | — | 0.5 | — | — | — | — | — |
| | B4 | — | — | — | — | — | — | — |
| | B5 | — | — | 0.5 | — | — | — | 0.5 |
| | B6 | — | — | — | — | — | — | — |
| | B7 | — | — | — | 0.5 | — | — | — |
| | B8 | — | — | — | — | 0.5 | — | — |
| | C1 | — | — | — | — | — | 0.1 | 0.1 |
| | C2 | — | — | — | — | — | 0.5 | 0.5 |
| | C3 | 0.001 | 0.002 | 0.005 | 0.0005 | 0.001 | 0.001 | 0.001 |
| Refrigerant | | R410A | R410A | R410A | R410A | R410A | R410A | R410A |
| Mean frictional coefficient 3 | | 0.091 | 0.088 | 0.101 | 0.102 | 0.104 | 0.091 | 0.091 |
| Mean oil temp. 3 (° C.) | | 41 | 40 | 41 | 46 | 47 | 41 | 43 |
| Abrasion loss 3 (mg) | | 7.5 | 7.3 | 7.2 | 8.3 | 8.2 | 7.6 | 7.3 |

TABLE 30

| | | Comp. Ex. 41 | Comp. Ex. 42 | Comp. Ex. 43 | Comp. Ex. 44 | Comp. Ex. 45 | Comp. Ex. 46 |
|---|---|---|---|---|---|---|---|
| Base oil | | Base oil 1 | Base oil 1 | Base oil 1 | Base oil 1 | Base oil 1 | Base oil 1 |
| Additive (wt %) | A4 | 0.5 | — | — | — | — | — |
| | A5 | — | 0.5 | — | — | — | — |
| | A6 | — | — | 0.5 | — | — | — |
| | B1 | — | — | — | 0.5 | — | — |
| | B2 | — | — | — | — | 0.5 | — |
| | B3 | — | — | — | — | — | 0.5 |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| Refrigerant | | R410A | R410A | R410A | R410A | R410A | R410A |
| Mean frictional coefficient 3 | | 0.128 | 0.135 | 0.129 | 0.115 | 0.113 | 0.112 |
| Mean oil temp. 3 (° C.) | | 60 | 62 | 59 | 54 | 54 | 53 |
| Abrasion loss 3 (mg) | | 9.4 | 9.5 | 9.9 | 12.8 | 13.1 | 12.9 |

TABLE 31

| | | Comp. Ex. 47 | Comp. Ex. 48 | Comp. Ex. 49 | Comp. Ex. 50 | Comp. Ex. 51 | Comp. Ex. 52 |
|---|---|---|---|---|---|---|---|
| Base oil | | Base oil 1 | Base oil 1 | Base oil 1 | Base oil 1 | Base oil 1 | Base oil 1 |
| Additive (wt %) | A4 | — | — | — | — | — | — |
| | A5 | — | — | — | — | — | — |
| | A6 | — | — | — | — | — | — |
| | B1 | — | — | — | — | — | — |
| | B2 | — | — | — | — | — | — |
| | B3 | — | — | — | — | — | — |
| | B4 | 0.5 | — | — | — | — | — |
| | B5 | — | 0.5 | — | — | — | — |
| | B6 | — | — | 0.5 | — | — | — |
| | B7 | — | — | — | 0.5 | — | — |
| | B8 | — | — | — | — | 0.5 | — |
| Refrigerant | | R410A | R410A | R410A | R410A | R410A | R410A |
| Mean frictional coefficient 3 | | 0.110 | 0.117 | 0.118 | 0.108 | 0.109 | 0.125 |
| Mean oil temp. 3 (° C.) | | 52 | 54 | 58 | 56 | 57 | 58 |
| Abrasion loss 3 (mg) | | 12.9 | 13.1 | 13.3 | 12.8 | 13.5 | 12.5 |

TABLE 32

| | | Example 181 | Example 182 | Example 183 | Example 184 | Example 185 | Example 186 | Example 187 | Example 188 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A4 | 0.1 | 0.1 | 0.1 | 0.1 | 0.1 | 0.1 | 0.1 | 0.1 |
| (wt %) | A5 | — | — | — | — | — | — | — | — |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.105 | 0.107 | 0.108 | 0.106 | 0.117 | 0.118 | 0.112 | 0.111 |
| Mean oil temp. 3 (° C.) | | 45 | 46 | 46 | 47 | 13 | 48 | 49 | 50 |
| Abrasion loss 3 (mg) | | 8.8 | 8.6 | 8.9 | 9.4 | 9.6 | 9.5 | 9.8 | 9.9 |

TABLE 33

| | | Example 189 | Example 190 | Example 191 | Example 192 | Example 193 | Example 194 | Example 195 | Example 196 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A4 | — | — | — | — | — | — | — | — |
| (wt %) | A5 | 0.1 | 0.1 | 0.1 | 0.1 | 0.1 | 0.1 | 0.1 | 0.1 |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.106 | 0.107 | 0.108 | 0.107 | 0.115 | 0.117 | 0.113 | 0.112 |
| Mean oil temp. 3 (° C.) | | 46 | 46 | 48 | 47 | 46 | 50 | 48 | 49 |
| Abrasion loss 3 (mg) | | 8.7 | 8.7 | 8.8 | 9.5 | 9.8 | 9.6 | 9.7 | 9.6 |

TABLE 34

| | | Example 197 | Example 198 | Example 199 | Example 200 | Example 201 | Example 202 | Example 203 | Example 204 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A4 | — | — | — | — | — | — | — | — |
| (wt %) | A5 | — | — | — | — | — | — | — | — |
| | A6 | 0.1 | 0.1 | 0.1 | 0.1 | 0.1 | 0.1 | 0.1 | 0.1 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 3 | | 0.108 | 0.106 | 0.108 | 0.107 | 0.116 | 0.119 | 0.113 | 0.112 |
| Mean oil temp. 3 (° C.) | | 46 | 47 | 46 | 46 | 47 | 51 | 51 | 50 |
| Abrasion loss 3 (mg) | | 8.7 | 8.6 | 8.8 | 9.5 | 9.7 | 9.7 | 9.6 | 9.8 |

TABLE 35

| | | Example 205 | Example 206 | Example 207 | Example 208 | Example 209 | Example 210 | Example 211 | Example 212 | Example 213 |
|---|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 | Base oil 3 |
| Additive (wt %) | A4 | 0.01 | 0.3 | 0.10 | — | — | — | — | — | — |
| | A5 | — | — | — | 0.01 | 0.3 | 1.0 | — | — | — |
| | A6 | — | — | — | — | — | — | 0.01 | 0.3 | 1.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| | B4 | — | — | — | — | — | — | — | — | — |
| | B5 | — | — | — | — | — | — | — | — | — |
| | B6 | — | — | — | — | — | — | — | — | — |
| | B7 | — | — | — | — | — | — | — | — | — |
| | B8 | — | — | — | — | — | — | — | — | — |
| Refrigerant | | R410A | R410A | R410A | R410A | R410A | R410A | R410A | R410A | R410A |
| Mean frictional coefficient 3 | | 0.116 | 0.107 | 0.108 | 0.117 | 0.107 | 0.108 | 0.115 | 0.108 | 0.110 |
| Mean oil temp. 3 (° C.) | | 48 | 46 | 47 | 49 | 47 | 48 | 48 | 46 | 48 |
| Abrasion loss 3 (mg) | | 12.2 | 8.7 | 8.7 | 12.4 | 8.6 | 8.8 | 12.1 | 8.6 | 8.8 |

TABLE 36

| | | Example 214 | Example 215 | Example 216 | Example 217 | Example 218 | Example 219 | Example 220 | Example 221 | Example 222 |
|---|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 | Base oil 3 |
| Additive (wt %) | A4 | 0.01 | 0.3 | 1.0 | — | — | — | — | — | — |
| | A5 | — | — | — | 0.01 | 0.3 | 1.0 | — | — | — |
| | A6 | — | — | — | — | — | — | 0.01 | 0.3 | 1.0 |
| | B1 | — | — | — | — | — | — | — | — | — |
| | B2 | — | — | — | — | — | — | — | — | — |
| | B3 | — | — | — | — | — | — | — | — | — |
| | B4 | 0.1 | 1.0 | 2.0 | — | — | — | — | — | — |
| | B5 | — | — | — | 0.1 | 1.0 | 2.0 | — | — | — |
| | B6 | — | — | — | — | — | — | 0.1 | 1.0 | 2.0 |
| | B7 | — | — | — | — | — | — | — | — | — |
| | B8 | — | — | — | — | — | — | — | — | — |
| Refrigerant | | R410A | R410A | R410A | R410A | R410A | R410A | R410A | R410A | R410A |
| Mean frictional coefficient 3 | | 0.113 | 0.107 | 0.108 | 0.117 | 0.117 | 0.118 | 0.122 | 0.116 | 0.115 |
| Mean oil temp. 3 (° C.) | | 48 | 46 | 48 | 49 | 47 | 48 | 52 | 51 | 50 |
| Abrasion loss 3 (mg) | | 12.5 | 9.5 | 9.6 | 12.6 | 9.6 | 9.7 | 12.3 | 9.5 | 9.4 |

TABLE 37

| | | Example 223 | Example 224 | Example 225 | Example 226 | Example 227 | Example 228 |
|---|---|---|---|---|---|---|---|
| Base oil | | Base oil 3 | Base oil 3 | Base oil 3 | Base oil 3 | Base oil 3 | Base oil 3 |
| Additive (wt %) | A4 | 0.01 | 0.3 | 1.0 | — | — | — |
| | A5 | — | — | — | 0.01 | 0.3 | 1.0 |
| | A6 | — | — | — | — | — | — |
| | B1 | — | — | — | — | — | — |
| | B2 | — | — | — | — | — | — |
| | B3 | — | — | — | — | — | — |
| | B4 | — | — | — | — | — | — |
| | B5 | — | — | — | — | — | — |
| | B6 | — | — | — | — | — | — |
| | B7 | 0.1 | 1.0 | 2.0 | — | — | — |
| | B8 | — | — | — | 0.1 | 1.0 | 2.0 |
| Refrigerant | | R410A | R410A | R410A | R410A | R410A | R410A |
| Mean frictional coefficient 3 | | 0.115 | 0.114 | 0.115 | 0.119 | 0.113 | 0.114 |
| Mean oil temp. 3 (° C.) | | 50 | 48 | 49 | 150 | 48 | 48 |
| Abrasion loss 3 (mg) | | 12.8 | 9.5 | 9.7 | 12.7 | 9.7 | 9.9 |

TABLE 38

| | | Example 229 | Example 230 | Example 231 | Example 232 | Example 234 | Example 235 | Example 236 |
|---|---|---|---|---|---|---|---|---|
| Base oil | | Base oil 3 | Base oil 3 | Base oil 3 | Base oil 3 | Base oil 3 | Base oil 3 | Base oil 3 |
| Additive | A4 | 0.1 | 0.1 | 0.1 | 0.1 | 0.1 | 0.1 | 0.1 |
| (wt %) | A5 | — | — | — | — | — | — | — |
| | A6 | — | — | — | — | — | — | — |
| | B1 | 0.5 | — | — | — | — | — | — |
| | B2 | — | — | — | — | — | — | — |
| | B3 | — | 0.5 | — | — | — | 0.5 | — |
| | B4 | — | — | — | — | — | — | — |
| | B5 | — | — | 0.5 | — | — | — | — |
| | B6 | — | — | — | — | — | — | — |
| | B7 | — | — | — | 0.5 | — | — | 0.5 |
| | B8 | — | — | — | — | 0.5 | — | — |
| | C1 | — | — | — | — | — | 0.1 | 0.1 |
| | C2 | — | — | — | — | — | 0.5 | 0.5 |
| | C3 | 0.001 | 0.002 | 0.005 | 0.0005 | 0.001 | 0.002 | 0.0005 |
| Refrigerant | | R410A | R410A | R410A | R410A | R410A | R410A | R410A |
| Mean frictional coefficient 3 | | 0.094 | 0.093 | 0.103 | 0.103 | 0.102 | 0.094 | 0.103 |
| Mean oil temp. 3 (° C.) | | 41 | 43 | 44 | 49 | 49 | 41 | 47 |
| Abrasion loss 3 (mg) | | 8.0 | 7.9 | 8.0 | 9.2 | 9.3 | 8.0 | 8.8 |

TABLE 39

| | | Comp. Ex. 53 | Comp. Ex. 54 | Comp. Ex. 55 | Comp. Ex. 56 | Comp. Ex. 57 | Comp. Ex. 58 |
|---|---|---|---|---|---|---|---|
| Base oil | | Base oil 3 | Base oil 3 | Base oil 3 | Base oil | Base oil 3 | Base oil 3 |
| Additive | A4 | 0.5 | — | — | — | — | — |
| (wt %) | A5 | — | 0.5 | — | — | — | — |
| | A6 | — | — | 0.5 | — | — | — |
| | B1 | — | — | — | 0.5 | — | — |
| | B2 | — | — | — | — | 0.5 | — |
| | B3 | — | — | — | — | — | 0.5 |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| Refrigerant | | R410A | R410A | R410A | R410A | R410A | R410A |
| Mean frictional coefficient 3 | | 0.131 | 0.132 | 0.135 | 0.118 | 0.119 | 0.117 |
| Mean oil temp. 3 (° C.) | | 59 | 60 | 61 | 53 | 54 | 54 |
| Abrasion loss 3 (mg) | | 9.8 | 10.2 | 10.5 | 14.8 | 15.3 | 15.1 |

TABLE 40

| | | Comp. Ex. 59 | Comp. Ex. 60 | Comp. Ex. 61 | Comp. Ex. 62 | Comp. Ex. 63 | Comp. Ex. 64 |
|---|---|---|---|---|---|---|---|
| Base oil | | Base oil 3 | Base oil 3 | Base oil 3 | Base oil 3 | Base oil 3 | Base oil 3 |
| Additive | A4 | — | — | — | — | — | — |
| (wt %) | A5 | — | — | — | — | — | — |
| | A6 | — | — | — | — | — | — |
| | B1 | — | — | — | — | — | — |
| | B2 | — | — | — | — | — | — |
| | B3 | — | — | — | — | — | — |
| | B4 | 0.5 | — | — | — | — | — |
| | B5 | — | 0.5 | — | — | — | — |
| | B6 | — | — | 0.5 | — | — | — |
| | B7 | — | — | — | 0.5 | — | — |
| | B8 | — | — | — | — | 0.5 | — |
| Refrigerant | | R410A | R410A | R410A | R410A | R410A | R410A |
| Mean frictional coefficient 3 | | 0.115 | 0.119 | 0.125 | 0.117 | 0.118 | 0.128 |
| Mean oil temp. 3 (° C.) | | 53 | 54 | 56 | 53 | 55 | 55 |
| Abrasion loss 3 (mg) | | 14.9 | 15.1 | 15.2 | 15.5 | 15.1 | 14.2 |

TABLE 41

| | | Example 236 | Example 237 | Example 238 | Example 239 | Example 240 | Example 241 | Example 242 | Example 243 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A4 | 0.1 | 0.1 | 0.1 | 0.1 | 0.1 | 0.1 | 0.1 | 0.1 |
| (wt %) | A5 | — | — | — | — | — | — | — | — |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 3 | | 0.105 | 0.109 | 0.110 | 0.108 | 0.121 | 0.125 | 0.117 | 0.116 |
| Mean oil temp. 3 (° C.) | | 47 | 49 | 48 | 48 | 49 | 54 | 52 | 53 |
| Abrasion loss 3 (mg) | | 8.1 | 8.9 | 8.8 | 9.3 | 9.5 | 9.6 | 9.5 | 9.6 |

TABLE 42

| | | Example 244 | Example 245 | Example 246 | Example 247 | Example 248 | Example 249 | Example 250 | Example 251 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A4 | — | — | — | — | — | — | — | — |
| (wt %) | A5 | 0.1 | 0.1 | 0.1 | 0.1 | 0.1 | 0.1 | 0.1 | 0.1 |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 3 | | 0.108 | 0.109 | 0.108 | 0.109 | 0.122 | 0.125 | 0.118 | 0.117 |
| Mean oil temp. 3 (° C.) | | 48 | 48 | 47 | 49 | 49 | 53 | 55 | 54 |
| Abrasion loss 3 (mg) | | 8.9 | 8.8 | 8.7 | 9.4 | 9.6 | 9.4 | 9.3 | 9.5 |

TABLE 43

| | | Example 252 | Example 253 | Example 254 | Example 255 | Example 256 | Example 257 | Example 258 | Example 259 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A4 | — | — | — | — | — | — | — | — |
| (wt %) | A5 | — | — | — | — | — | — | — | — |
| | A6 | 0.1 | 0.1 | 0.1 | 0.1 | 0.1 | 0.1 | 0.1 | 0.1 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 3 | | 0.108 | 0.107 | 0.109 | 0.107 | 0.122 | 0.125 | 0.118 | 0.117 |
| Mean oil temp. 3 (° C.) | | 48 | 48 | 49 | 47 | 49 | 54 | 55 | 53 |
| Abrasion loss 3 (mg) | | 8.8 | 8.7 | 8.9 | 9.5 | 9.6 | 9.5 | 9.6 | 9.4 |

TABLE 44

| | | Example 260 | Example 261 | Example 262 | Example 263 | Example 264 | Example 265 | Example 266 | Example 267 | Example 268 |
|---|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 | Base oil 2 |
| Additive | A4 | 0.01 | 0.3 | 0.10 | — | — | — | — | — | — |
| (wt %) | A5 | — | — | — | 0.01 | 0.3 | 1.0 | — | — | — |
| | A6 | — | — | — | — | — | — | 0.01 | 0.3 | 1.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| | B4 | — | — | — | — | — | — | — | — | — |
| | B5 | — | — | — | — | — | — | — | — | — |
| | B6 | — | — | — | — | — | — | — | — | — |
| | B7 | — | — | — | — | — | — | — | — | — |
| | B8 | — | — | — | — | — | — | — | — | — |
| Refrigerant | | R134a | R134a | R134a | R134a | R134a | R134a | R134a | R134a | R134a |
| Mean frictional coefficient 3 | | 0.113 | 0.106 | 0.107 | 0.109 | 0.108 | 0.110 | 0.111 | 0.108 | 0.109 |
| Mean oil temp. 3 (° C.) | | 49 | 47 | 47 | 50 | 49 | 50 | 52 | 50 | 51 |
| Abrasion loss 3 (mg) | | 12.9 | 8.0 | 8.1 | 12.8 | 8.9 | 8.8 | 12.9 | 8.9 | 9.0 |

TABLE 45

| | | Example 269 | Example 270 | Example 271 | Example 272 | Example 273 | Example 274 | Example 275 | Example 276 | Example 277 |
|---|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 | Base oil 2 |
| Additive | A4 | 0.01 | 0.3 | 1.0 | — | — | — | — | — | — |
| (wt %) | A5 | — | — | — | 0.01 | 0.3 | 1.0 | — | — | — |
| | A6 | — | — | — | — | — | — | 0.01 | 0.3 | 1.0 |
| | B1 | — | — | — | — | — | — | — | — | — |
| | B2 | — | — | — | — | — | — | — | — | — |
| | B3 | — | — | — | — | — | — | — | — | — |
| | B4 | 0.1 | 1.0 | 2.0 | — | — | — | — | — | — |
| | B5 | — | — | — | 0.1 | 1.0 | 2.0 | — | — | — |
| | B6 | — | — | — | — | — | — | 0.1 | 1.0 | 2.0 |
| | B7 | — | — | — | — | — | — | — | — | — |
| | B8 | — | — | — | — | — | — | — | — | — |
| Refrigerant | | R134a | R134a | R134a | R134a | R134a | R134a | R134a | R134a | R134a |
| Mean frictional coefficient 3 | | 0.111 | 0.109 | 0.108 | 0.117 | 0.122 | 0.123 | 0.118 | 0.120 | 0.124 |
| Mean oil temp. 3 (° C.) | | 51 | 49 | 49 | 52 | 48 | 49 | 54 | 53 | 53 |
| Abrasion loss 3 (mg) | | 12.7 | 9.7 | 9.8 | 12.9 | 9.7 | 9.9 | 13.0 | 9.1 | 9.0 |

TABLE 46

| | | Example 278 | Example 279 | Example 280 | Example 281 | Example 282 | Example 283 |
|---|---|---|---|---|---|---|---|
| Base oil | | Base oil 2 | Base oil 2 | Base oil 2 | Base oil 2 | Base oil 2 | Base oil 2 |
| Additive | A4 | 0.01 | 0.3 | 1.0 | — | — | — |
| (wt %) | A5 | — | — | — | 0.01 | 0.3 | 1.0 |
| | A6 | — | — | — | — | — | — |
| | B1 | — | — | — | — | — | — |
| | B2 | — | — | — | — | — | — |
| | B3 | — | — | — | — | — | — |
| | B4 | — | — | — | — | — | — |
| | B5 | — | — | — | — | — | — |
| | B6 | — | — | — | — | — | — |
| | B7 | 0.1 | 1.0 | 2.0 | — | — | — |
| | B8 | — | — | — | 0.1 | 1.0 | 2.0 |
| Refrigerant | | R134a | R134a | R134a | R134a | R134a | R134a |
| Mean frictional coefficient 3 | | 0.119 | 0.114 | 0.115 | 0.118 | 0.118 | 0.120 |
| Mean oil temp. 3 (° C.) | | 54 | 53 | 52 | 54 | 53 | 53 |
| Abrasion loss 3 (mg) | | 12.8 | 9.2 | 9.5 | 12.7 | 9.6 | 9.8 |

TABLE 47

| | | Example 284 | Example 285 | Example 286 | Example 287 | Example 288 | Example 289 | Example 290 |
|---|---|---|---|---|---|---|---|---|
| Base oil | | Base oil 2 | Base oil 2 | Base oil 2 | Base oil 2 | Base oil 2 | Base oil 2 | Base oil 2 |
| Additive | A4 | 0.1 | 0.1 | 0.1 | 0.1 | 0.1 | 0.1 | 0.1 |
| (wt %) | A5 | — | — | — | — | — | — | — |
| | A6 | — | — | — | — | — | — | — |
| | B1 | 0.5 | — | — | — | — | 0.5 | |
| | B2 | — | — | — | — | — | — | — |
| | B3 | | 0.5 | — | — | — | — | — |
| | B4 | — | — | — | — | — | — | — |
| | B5 | — | — | 0.5 | — | — | — | — |
| | B6 | — | — | — | — | — | — | — |
| | B7 | — | — | — | 0.5 | — | — | — |
| | B8 | — | — | — | — | 0.5 | | 0.5 |
| | C1 | — | — | — | — | — | 0.1 | 0.1 |
| | C2 | — | — | — | — | — | 0.5 | 0.5 |
| | C3 | 0.001 | 0.002 | 0.005 | 0.0005 | 0.001 | 0.001 | 0.001 |
| Refrigerant | | R134a | R134a | R134a | R134a | R134a | R134a | R134a |
| Mean frictional coefficient 3 | | 0.099 | 0.101 | 0.110 | 0.112 | 0.111 | 0.100 | 0.111 |
| Mean oil temp. 3 (° C.) | | 45 | 46 | 46 | 49 | 48 | 45 | 48 |
| Abrasion loss 3 (mg) | | 7.7 | 8.0 | 8.2 | 8.5 | 8.7 | 7.8 | 8.8 |

TABLE 48

| | | Comp. Ex. 65 | Comp. Ex. 66 | Comp. Ex. 67 | Comp. Ex. 68 | Comp. Ex. 69 | Comp. Ex. 70 |
|---|---|---|---|---|---|---|---|
| Base oil | | Base oil 2 | Base oil 2 | Base oil 2 | Base oil 2 | Base oil 2 | Base oil 2 |
| Additive | A4 | 0.5 | — | — | — | — | — |
| (wt %) | A5 | — | 0.5 | — | — | — | — |
| | A6 | — | — | 0.5 | — | — | — |
| | B1 | — | — | — | 0.5 | — | — |
| | B2 | — | — | — | — | 0.5 | — |
| | B3 | — | — | — | — | — | 0.5 |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| Refrigerant | | R134a | R134a | R134a | R134a | R134a | R134a |
| Mean frictional coefficient 3 | | 0.132 | 0.139 | 0.133 | 0.115 | 0.111 | 0.113 |
| Mean oil temp. 3 (° C.) | | 61 | 50 | 58 | 55 | 54 | 55 |
| Abrasion loss 3 (mg) | | 9.3 | 9.5 | 9.9 | 14.9 | 13.9 | 14.1 |

TABLE 49

| | | Comp. Ex. 71 | Comp. Ex. 72 | Comp. Ex. 73 | Comp. Ex. 74 | Comp. Ex. 75 | Comp. Ex. 76 |
|---|---|---|---|---|---|---|---|
| Base oil | | Base oil 2 | Base oil 2 | Base oil 2 | Base oil 2 | Base oil 2 | Base oil 2 |
| Additive | A4 | — | — | — | — | — | — |
| (wt %) | A5 | — | — | — | — | — | — |
| | A6 | — | — | — | — | — | — |
| | B1 | — | — | — | — | — | — |
| | B2 | — | — | — | — | — | — |
| | B3 | — | — | — | — | — | — |
| | B4 | 0.5 | — | — | — | — | — |
| | B5 | — | 0.5 | — | — | — | — |
| | B6 | — | — | 0.5 | — | — | — |
| | B7 | — | — | — | 0.5 | — | — |
| | B8 | — | — | — | — | 0.5 | — |
| Refrigerant | | R134a | R134a | R134a | R134a | R134a | R134a |
| Mean frictional coefficient 3 | | 0.113 | 0.119 | 0.120 | 0.115 | 0.116 | 0.130 |
| Mean oil temp. 3 (° C.) | | 54 | 55 | 57 | 55 | 56 | 60 |
| Abrasion loss 3 (mg) | | 13.7 | 14.5 | 14.8 | 14.4 | 15.4 | 13.5 |

TABLE 50

| | | Example 291 | Example 292 | Example 293 | Example 294 | Example 295 | Example 296 | Example 297 | Example 298 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A4 | 0.1 | 0.1 | 0.1 | 0.1 | 0.1 | 0.1 | 0.1 | 0.1 |
| (wt %) | A5 | — | — | — | — | — | — | — | — |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 3 | | 0.108 | 0.110 | 0.109 | 0.109 | 0.119 | 0.120 | 0.113 | 0.114 |
| Mean oil temp. 3 (° C.) | | 44 | 46 | 45 | 45 | 46 | 52 | 53 | 50 |
| Abrasion loss 3 (mg) | | 10.1 | 10.3 | 10.6 | 10.9 | 11.1 | 11.0 | 10.9 | 10.4 |

TABLE 51

| | | Example 299 | Example 300 | Example 301 | Example 302 | Example 303 | Example 304 | Example 305 | Example 306 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A4 | — | — | — | — | — | — | — | — |
| (wt %) | A5 | 0.1 | 0.1 | 0.1 | 0.1 | 0.1 | 0.1 | 0.1 | 0.1 |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R314a | R134a | R134a | R134a | R134a | R134a | R134a | R134a |
| Mean frictional coefficient 3 | | 0.111 | 0.109 | 0.111 | 0.110 | 0.121 | 0.120 | 0.114 | 0.115 |
| Mean oil temp. 3 (° C.) | | 46 | 46 | 46 | 45 | 44 | 52 | 53 | 52 |
| Abrasion loss 3 (mg) | | 10.7 | 10.8 | 10.6 | 11.0 | 11.2 | 11.2 | 11.1 | 11.2 |

TABLE 52

| | | Example 307 | Example 308 | Example 309 | Example 310 | Example 311 | Example 312 | Example 313 | Example 314 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A4 | — | — | — | — | — | — | — | — |
| (wt %) | A5 | — | — | — | — | — | — | — | — |
| | A6 | 0.1 | 0.1 | 0.1 | 0.1 | 0.1 | 0.1 | 0.1 | 0.1 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 3 | | 0.109 | 0.110 | 0.110 | 0.111 | 0.121 | 0.121 | 0.114 | 0.115 |
| Mean oil temp. 3 (° C.) | | 47 | 46 | 47 | 46 | 45 | 53 | 51 | 51 |
| Abrasion loss 3 (mg) | | 10.4 | 10.3 | 10.8 | 11.1 | 11.3 | 11.0 | 11.1 | 11.0 |

TABLE 53

| | | Example 315 | Example 316 | Example 317 | Example 318 | Example 319 | Example 320 | Example 321 | Example 322 | Example 323 |
|---|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 | Base oil 5 |
| Additive | A4 | 0.01 | 0.3 | 0.10 | — | — | — | — | — | — |
| (wt %) | A5 | — | — | — | 0.01 | 0.3 | 1.0 | — | — | — |
| | A6 | — | — | — | — | — | — | 0.01 | 0.3 | 1.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| | B4 | — | — | — | — | — | — | — | — | — |
| | B5 | — | — | — | — | — | — | — | — | — |
| | B6 | — | — | — | — | — | — | — | — | — |
| | B7 | — | — | — | — | — | — | — | — | — |
| | B8 | — | — | — | — | — | — | — | — | — |
| Refrigerant | | R134a | R134a | R134a | R134a | R134a | R134a | R134a | R134a | R134a |
| Mean frictional coefficient 3 | | 0.114 | 0.109 | 0.110 | 0.114 | 0.109 | 0.109 | 0.116 | 0.109 | 0.110 |
| Mean oil temp. 3 (° C.) | | 47 | 45 | 46 | 48 | 46 | 47 | 48 | 48 | 46 |
| Abrasion loss 3 (mg) | | 12.7 | 9.9 | 9.8 | 13.1 | 10.6 | 10.7 | 13.0 | 10.6 | 10.2 |

TABLE 54

| | | Example 324 | Example 325 | Example 326 | Example 327 | Example 328 | Example 329 | Example 330 | Example 331 | Example 332 |
|---|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 | Base oil 5 |
| Additive | A4 | 0.01 | 0.3 | 1.0 | — | — | — | — | — | — |
| (wt %) | A5 | — | — | — | 0.01 | 0.3 | 1.0 | — | — | — |
| | A6 | — | — | — | — | — | — | 0.01 | 0.3 | 1.0 |
| | B1 | — | — | — | — | — | — | — | — | — |
| | B2 | — | — | — | — | — | — | — | — | — |
| | B3 | — | — | — | — | — | — | — | — | — |
| | B4 | 0.1 | 1.0 | 2.0 | — | — | — | — | — | — |
| | B5 | — | — | — | 0.1 | 1.0 | 2.0 | — | — | — |
| | B6 | — | — | — | — | — | — | 0.1 | 1.0 | 2.0 |
| | B7 | — | — | — | — | — | — | — | — | — |
| | B8 | — | — | — | — | — | — | — | — | — |
| Refrigerant | | R134a | R134a | R134a | R134a | R134a | R134a | R134a | R134a | R134a |
| Mean frictional coefficient 3 | | 0.115 | 0.109 | 0.110 | 0.123 | 0.118 | 0.118 | 0.122 | 0.120 | 0.120 |
| Mean oil temp. 3 (° C.) | | 48 | 46 | 47 | 46 | 44 | 45 | 55 | 53 | 54 |
| Abrasion loss 3 (mg) | | 13.1 | 11.2 | 11.3 | 12.9 | 11.3 | 11.5 | 13.2 | 11.3 | 11.4 |

TABLE 55

| | | Example 333 | Example 334 | Example 335 | Example 336 | Example 337 | Example 338 |
|---|---|---|---|---|---|---|---|
| Base oil | | Base oil 5 | Base oil 5 | Base oil 5 | Base oil 5 | Base oil 5 | Base oil 5 |
| Additive | A4 | 0.01 | 0.3 | 1.0 | — | — | — |
| (wt %) | A5 | — | — | — | 0.01 | 0.3 | 1.0 |
| | A6 | — | — | — | — | — | — |
| | B1 | — | — | — | — | — | — |
| | B2 | — | — | — | — | — | — |
| | B3 | — | — | — | — | — | — |
| | B4 | — | — | — | — | — | — |
| | B5 | — | — | — | — | — | — |
| | B6 | — | — | — | — | — | — |
| | B7 | 0.1 | 1.0 | 2.0 | — | — | — |
| | B8 | — | — | — | 0.1 | 1.0 | 2.0 |
| | C1 | — | — | — | — | — | — |
| | C2 | — | — | — | — | — | — |
| | C3 | — | — | — | — | — | — |
| Refrigerant | | R134a | R134a | R134a | R134a | R134a | R134a |
| Mean frictional coefficient 3 | | 0.118 | 0.112 | 0.114 | 0.118 | 0.114 | 0.115 |
| Mean oil temp. 3 (° C.) | | 54 | 53 | 54 | 54 | 52 | 53 |
| Abrasion loss 3 (mg) | | 12.8 | 11.0 | 11.2 | 13.0 | 11.2 | 11.4 |

TABLE 56

| | | Example 339 | Example 340 | Example 341 | Example 342 | Example 343 | Example 344 | Example 345 |
|---|---|---|---|---|---|---|---|---|
| Base oil | | Base oil 5 | Base oil 5 | Base oil 5 | Base oil 5 | Base oil 5 | Base oil 5 | Base oil 5 |
| Additive | A4 | 0.1 | 0.1 | 0.1 | 0.1 | 0.1 | 0.1 | 0.1 |
| (wt %) | A5 | — | — | — | — | — | — | — |
| | A6 | — | — | — | — | — | — | — |
| | B1 | 0.5 | — | — | — | — | 0.5 | |
| | B2 | — | — | — | — | — | — | — |
| | B3 | — | 0.5 | — | — | — | — | — |
| | B4 | — | — | — | — | — | — | — |
| | B5 | — | — | 0.5 | — | — | — | — |
| | B6 | — | — | — | — | — | — | — |
| | B7 | — | — | — | 0.5 | — | — | — |
| | B8 | — | — | — | — | 0.5 | — | 0.5 |
| | C1 | — | — | — | — | — | 0.1 | 0.1 |
| | C2 | — | — | — | — | — | 0.5 | 0.5 |
| | C3 | 0.001 | 0.002 | 0.005 | 0.0005 | 0.001 | 0.001 | 0.001 |
| Refrigerant | | R134a | R134a | R134a | R134a | R134a | R134a | R134a |
| Mean frictional coefficient 3 | | 0.100 | 0.101 | 0.110 | 0.115 | 0.116 | 0.100 | 0.116 |
| Mean oil temp. 3 (° C.) | | 43 | 45 | 42 | 51 | 50 | 44 | 52 |
| Abrasion loss 3 (mg) | | 9.3 | 9.5 | 9.1 | 10.1 | 10.1 | 9.3 | 10.2 |

TABLE 57

| | | Comp. Ex. 77 | Comp. Ex. 78 | Comp. Ex. 79 | Comp. Ex. 80 | Comp. Ex. 81 | Comp. Ex. 82 |
|---|---|---|---|---|---|---|---|
| Base oil | | Base oil 5 | Base oil 5 | Base oil 5 | Base oil 5 | Base oil 5 | Base oil 5 |
| Additive | A4 | 0.5 | — | — | — | — | — |
| (wt %) | A5 | — | 0.5 | — | — | — | — |
| | A6 | — | — | 0.5 | — | — | — |
| | B1 | — | — | — | 0.5 | — | — |
| | B2 | — | — | — | — | 0.5 | — |
| | B3 | — | — | — | — | — | 0.5 |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| Refrigerant | | R134a | R134a | R134a | R134a | R134a | R134a |
| Mean frictional coefficient 3 | | 0.128 | 0.129 | 0.132 | 0.116 | 0.116 | 0.118 |
| Mean oil temp. 3 (° C.) | | 57 | 59 | 59 | 52 | 52 | 53 |
| Abrasion loss 3 (mg) | | 11.1 | 11.3 | 11.4 | 14.3 | 14.8 | 14.9 |

TABLE 58

| | | Comp. Ex. 83 | Comp. Ex. 84 | Comp. Ex. 85 | Comp. Ex. 86 | Comp. Ex. 87 | Comp. Ex. 88 |
|---|---|---|---|---|---|---|---|
| Base oil | | Base oil 5 | Base oil 5 | Base oil 5 | Base oil 5 | Base oil 5 | Base oil 5 |
| Additive | A4 | — | — | — | — | — | — |
| (wt %) | A5 | — | — | — | — | — | — |
| | A6 | — | — | — | — | — | — |
| | B1 | — | — | — | — | — | — |
| | B2 | — | — | — | — | — | — |
| | B3 | — | — | — | — | — | — |
| | B4 | 0.5 | — | — | — | — | — |
| | B5 | — | 0.5 | — | — | — | — |
| | B6 | — | — | 0.5 | — | — | — |
| | B7 | — | — | — | 0.5 | — | — |
| | B8 | — | — | — | — | 0.5 | — |
| Refrigerant | | R134a | R134a | R134a | R134a | R134a | R134a |
| Mean frictional coefficient 3 | | 0.117 | 0.125 | 0.125 | 0.120 | 0.121 | 0.126 |
| Mean oil temp. 3 (° C.) | | 52 | 53 | 57 | 55 | 55 | 55 |
| Abrasion loss 3 (mg) | | 15.2 | 14.5 | 14.9 | 14.7 | 14.5 | 13.5 |

TABLE 59

| | | Example 346 | Example 347 | Example 348 | Example 349 | Example 350 | Example 351 | Example 352 | Example 353 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive | A4 | 0.1 | 0.1 | 0.1 | 0.1 | 0.1 | 0.1 | 0.1 | 0.1 |
| (wt %) | A5 | — | — | — | — | — | — | — | — |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R22 | R22 | R22 | R22 | R22 | R22 | R22 | R22 |
| Mean frictional coefficient 3 | | 0.112 | 0.112 | 0.113 | 0.112 | 0.123 | 0.121 | 0.116 | 0.117 |
| Mean oil temp. 3 (° C.) | | 47 | 47 | 49 | 48 | 47 | 54 | 53 | 55 |
| Abrasion loss 3 (mg) | | 8.1 | 8.3 | 8.0 | 8.7 | 8.8 | 8.8 | 8.9 | 8.9 |

TABLE 60

| | | Example 354 | Example 355 | Example 356 | Example 357 | Example 358 | Example 359 | Example 360 | Example 361 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive | A4 | — | — | — | — | — | — | — | — |
| (wt %) | A5 | 0.1 | 0.1 | 0.1 | 0.1 | 0.1 | 0.1 | 0.1 | 0.1 |
| | A6 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R22 | R22 | R22 | R22 | R22 | R22 | R22 | R22 |
| Mean frictional coefficient 3 | | 0.111 | 0.112 | 0.114 | 0.110 | 0.124 | 0.123 | 0.116 | 0.117 |
| Mean oil temp. 3 (° C.) | | 48 | 47 | 48 | 48 | 47 | 55 | 54 | 54 |
| Abrasion loss 3 (mg) | | 7.9 | 7.8 | 8.1 | 8.9 | 9.0 | 9.1 | 9.0 | 9.0 |

TABLE 61

| | | Example 362 | Example 363 | Example 364 | Example 365 | Example 366 | Example 367 | Example 368 | Example 369 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive | A4 | — | — | — | — | — | — | — | — |
| (wt %) | A5 | — | — | — | — | — | — | — | — |
| | A6 | 0.1 | 0.1 | 0.1 | 0.1 | 0.1 | 0.1 | 0.1 | 0.1 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R22 | R22 | R22 | R22 | R22 | R22 | R22 | R22 |
| Mean frictional coefficient 3 | | 0.112 | 0.113 | 0.111 | 0.114 | 0.124 | 0.123 | 0.117 | 0.117 |
| Mean oil temp. 3 (° C.) | | 48 | 47 | 47 | 48 | 48 | 54 | 53 | 55 |
| Abrasion loss 3 (mg) | | 8.0 | 7.9 | 7.8 | 9.1 | 9.0 | 9.0 | 8.9 | 9.1 |

TABLE 62

| | | Example 370 | Example 371 | Example 372 | Example 373 | Example 374 | Example 375 | Example 376 | Example 377 | Example 378 |
|---|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 | Base oil 4 |
| Additive (wt %) | A4 | 0.01 | 0.3 | 0.10 | — | — | — | — | — | — |
| | A5 | — | — | — | 0.01 | 0.3 | 1.0 | — | — | — |
| | A6 | — | — | — | — | — | — | 0.01 | 0.3 | 1.0 |
| | B1 | 0.1 | 1.0 | 2.0 | — | — | — | — | — | — |
| | B2 | — | — | — | 0.1 | 1.0 | 2.0 | — | — | — |
| | B3 | — | — | — | — | — | — | 0.1 | 1.0 | 2.0 |
| | B4 | — | — | — | — | — | — | — | — | — |
| | B5 | — | — | — | — | — | — | — | — | — |
| | B6 | — | — | — | — | — | — | — | — | — |
| | B7 | — | — | — | — | — | — | — | — | — |
| | B8 | — | — | — | — | — | — | — | — | — |
| Refrigerant | | R22 | R22 | R22 | R22 | R22 | R22 | R22 | R22 | R22 |
| Mean frictional coefficient 3 | | 0.119 | 0.111 | 0.113 | 0.121 | 0.111 | 0.112 | 0.120 | 0.110 | 0.111 |
| Mean oil temp. 3 (° C.) | | 50 | 47 | 49 | 48 | 46 | 47 | 49 | 48 | 49 |
| Abrasion loss 3 (mg) | | 9.4 | 8.4 | 8.2 | 9.3 | 7.8 | 8.0 | 9.4 | 7.7 | 7.9 |

TABLE 63

| | | Example 379 | Example 380 | Example 381 | Example 382 | Example 383 | Example 384 | Example 385 | Example 386 | Example 387 |
|---|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 | Base oil 4 |
| Additive (wt %) | A4 | 0.01 | 0.3 | 1.0 | — | — | — | — | — | — |
| | A5 | — | — | — | 0.01 | 0.3 | 1.0 | — | — | — |
| | A6 | — | — | — | — | — | — | 0.01 | 0.3 | 1.0 |
| | B1 | — | — | — | — | — | — | — | — | — |
| | B2 | — | — | — | — | — | — | — | — | — |
| | B3 | — | — | — | — | — | — | — | — | — |
| | B4 | 0.1 | 1.0 | 2.0 | — | — | — | — | — | — |
| | B5 | — | — | — | 0.1 | 1.0 | 2.0 | — | — | — |
| | B6 | — | — | — | — | — | — | 0.1 | 1.0 | 2.0 |
| | B7 | — | — | — | — | — | — | — | — | — |
| | B8 | — | — | — | — | — | — | — | — | — |
| Refrigerant | | R22 | R22 | R22 | R22 | R22 | R22 | R22 | R22 | R22 |
| Mean frictional coefficient 3 | | 0.121 | 0.111 | 0.112 | 0.124 | 0.122 | 0.122 | 0.124 | 0.122 | 0.122 |
| Mean oil temp. 3 (° C.) | | 50 | 48 | 49 | 48 | 47 | 48 | 54 | 52 | 52 |
| Abrasion loss 3 (mg) | | 9.3 | 8.8 | 8.7 | 9.4 | 8.9 | 9.0 | 9.3 | 8.6 | 8.6 |

TABLE 64

| | | Example 388 | Example 389 | Example 390 | Example 391 | Example 392 | Example 393 |
|---|---|---|---|---|---|---|---|
| Base oil | | Base oil 4 | Base oil 4 | Base oil 4 | Base oil 4 | Base oil 4 | Base oil 4 |
| Additive (wt %) | A4 | 0.01 | 0.3 | 1.0 | — | — | — |
| | A5 | — | — | — | 0.01 | 0.3 | 1.0 |
| | A6 | — | — | — | — | — | — |
| | B1 | — | — | — | — | — | — |
| | B2 | — | — | — | — | — | — |
| | B3 | — | — | — | — | — | — |
| | B4 | — | — | — | — | — | — |
| | B5 | — | — | — | — | — | — |
| | B6 | — | — | — | — | — | — |
| | B7 | 0.1 | 1.0 | 2.0 | — | — | — |
| | B8 | — | — | — | 0.1 | 1.0 | 2.0 |
| Refrigerant | | R22 | R22 | R22 | R22 | R22 | R22 |
| Mean frictional coefficient 3 | | 0.125 | 0.115 | 0.117 | 0.127 | 0.116 | 0.117 |
| Mean oil temp. 3 (° C.) | | 53 | 52 | 51 | 53 | 51 | 51 |
| Abrasion loss 3 (mg) | | 9.4 | 8.8 | 9.0 | 9.4 | 8.9 | 9.2 |

TABLE 65

| | | Example 394 | Example 395 | Example 396 | Example 397 | Example 398 | Example 399 | Example 400 |
|---|---|---|---|---|---|---|---|---|
| Base oil | | Base oil 4 | Base oil 4 | Base oil 4 | Base oil 4 | Base oil 4 | Base oil 4 | Base oil 4 |
| Additive | A4 | 0.1 | 0.1 | 0.1 | 0.1 | 0.1 | 0.1 | 0.1 |
| (wt %) | A5 | — | — | — | — | — | — | — |
| | A6 | — | — | — | — | — | — | — |
| | B1 | 0.5 | — | — | — | — | 0.5 | |
| | B2 | — | — | — | — | — | | |
| | B3 | — | 0.5 | — | — | — | — | — |
| | B4 | — | — | — | — | — | — | — |
| | B5 | — | — | 0.5 | — | — | — | 0.5 |
| | B6 | — | — | — | — | — | — | — |
| | B7 | — | — | — | 0.5 | — | — | — |
| | B8 | — | — | — | — | 0.5 | — | 0.5 |
| | C1 | — | — | — | — | — | 0.1 | 0.1 |
| | C2 | — | — | — | — | — | 0.5 | 0.5 |
| | C3 | 0.001 | 0.002 | 0.005 | 0.0005 | 0.001 | 0.001 | 0.005 |
| Refrigerant | | R22 | R22 | R22 | R22 | R22 | R22 | R22 |
| Mean frictional coefficient 3 | | 0.102 | 0.105 | 0.110 | 0.117 | 0.118 | 0.102 | 0.110 |
| Mean oil temp. 3 (° C.) | | 45 | 44 | 45 | 51 | 50 | 46 | 45 |
| Abrasion loss 3 (mg) | | 7.6 | 7.9 | 7.7 | 8.1 | 8.2 | 7.6 | 7.8 |

TABLE 66

| | | Comp. Ex. 89 | Comp. Ex. 90 | Comp. Ex. 91 | Comp. Ex. 92 | Comp. Ex. 93 | Comp. Ex. 94 |
|---|---|---|---|---|---|---|---|
| Base oil | | Base oil 4 | Base oil 4 | Base oil 4 | Base oil 4 | Base oil 4 | Base oil 4 |
| Additive | A4 | 0.5 | — | — | — | — | — |
| (wt %) | A5 | — | 0.5 | | — | — | — |
| | A6 | — | — | 0.5 | — | — | — |
| | B1 | — | — | — | 0.5 | — | — |
| | B2 | — | — | — | — | 0.5 | — |
| | B3 | — | — | — | — | — | 0.5 |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| Refrigerant | | R22 | R22 | R22 | R22 | R22 | R22 |
| Mean frictional coefficient 3 | | 0.133 | 0.135 | 0.137 | 0.121 | 0.123 | 0.122 |
| Mean oil temp. 3 (° C.) | | 61 | 63 | 62 | 53 | 55 | 54 |
| Abrasion loss 3 (mg) | | 8.8 | 8.7 | 8.9 | 10.5 | 10.8 | 10.9 |

TABLE 67

| | | Comp. Ex. 95 | Comp. Ex. 96 | Comp. Ex. 97 | Comp. Ex. 98 | Comp. Ex. 99 | Comp. Ex. 100 |
|---|---|---|---|---|---|---|---|
| Base oil | | Base oil 4 | Base oil 4 | Base oil 4 | Base oil 4 | Base oil 4 | Base oil 4 |
| Additive | A4 | — | — | — | — | — | — |
| (wt %) | A5 | — | — | — | — | — | — |
| | A6 | — | — | — | — | — | — |
| | B1 | — | — | — | — | — | — |
| | B2 | — | — | — | — | — | — |
| | B3 | — | — | — | — | — | — |
| | B4 | 0.5 | — | — | — | — | — |
| | B5 | — | 0.5 | — | — | — | — |
| | B6 | — | — | 0.5 | — | — | — |
| | B7 | — | — | — | 0.5 | — | — |
| | B8 | — | — | — | — | 0.5 | — |
| Refrigerant | | R22 | R22 | R22 | R22 | R22 | R22 |
| Mean frictional coefficient 3 | | 0.112 | 0.115 | 0.116 | 0.116 | 0.117 | 0.134 |
| Mean oil temp. 3 (° C.) | | 52 | 53 | 55 | 56 | 56 | 57 |
| Abrasion loss 3 (mg) | | 11.1 | 10.7 | 10.8 | 10.9 | 11.3 | 10.2 |

TABLE 68

| | | Example 401 | Example 402 | Example 403 | Example 404 | Example 405 | Example 406 | Example 407 | Example 408 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R407C | R407C | R407C | R407C | R407C | R407C | R407C | R407C |
| Mean frictional coefficient 3 | | 0.102 | 0.102 | 0.104 | 0.103 | 0.114 | 0.112 | 0.108 | 0.111 |
| Mean oil temp. 3 (° C.) | | 45 | 45 | 47 | 46 | 48 | 51 | 52 | 52 |
| Abrasion loss 3 (mg) | | 7.6 | 7.7 | 8.0 | 8.3 | 8.7 | 8.4 | 8.7 | 8.6 |

TABLE 69

| | | Example 405 | Example 406 | Example 407 | Example 408 | Example 409 | Example 410 | Example 411 | Example 412 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R407C | R407C | R407C | R407C | R407C | R407C | R407C | R407C |
| Mean frictional coefficient 3 | | 0.106 | 0.106 | 0.107 | 0.107 | 0.115 | 0.117 | 0.113 | 0.113 |
| Mean oil temp. 3 (° C.) | | 45 | 46 | 47 | 46 | 47 | 47 | 50 | 51 |
| Abrasion loss 3 (mg) | | 8.6 | 8.7 | 8.9 | 9.2 | 9.7 | 9.6 | 9.7 | 9.7 |

TABLE 70

| | | Example 413 | Example 414 | Example 415 | Example 416 | Example 417 | Example 418 | Example 419 | Example 420 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | $CO_2$ | $CO_2$ | $CO_2$ | $CO_2$ | $CO_2$ | $CO_2$ | $CO_2$ | $CO_2$ |
| Mean frictional coefficient 3 | | 0.103 | 0.107 | 0.111 | 0.110 | 0.120 | 0.124 | 0.115 | 0.114 |
| Mean oil temp. 3 (° C.) | | 48 | 50 | 49 | 49 | 50 | 54 | 53 | 55 |
| Abrasion loss 3 (mg) | | 8.3 | 9.1 | 8.9 | 9.4 | 9.6 | 9.6 | 9.5 | 9.7 |

TABLE 71

| | | Example 421 | Example 422 | Example 423 | Example 424 | Example 425 | Example 426 | Example 427 | Example 428 |
|---|---|---|---|---|---|---|---|---|---|
| Base oil | | Base oil 6 | Base oil 6 | Base oil 6 | Base oil 6 | Base oil 6 | Base oil 6 | Base oil 6 | Base oil 6 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | $CO_2$ | $CO_2$ | $CO_2$ | $CO_2$ | $CO_2$ | $CO_2$ | $CO_2$ | $CO_2$ |
| Mean frictional coefficient 3 | | 0.111 | 0.112 | 0.113 | 0.114 | 0.124 | 0.123 | 0.119 | 0.120 |
| Mean oil temp. 3 (° C.) | | 47 | 46 | 48 | 48 | 50 | 53 | 53 | 54 |
| Abrasion loss 3 (mg) | | 8.1 | 7.8 | 8.2 | 8.7 | 8.9 | 8.7 | 8.9 | 8.9 |

TABLE 72

| | | Example 429 | Example 430 | Example 431 | Example 432 | Example 433 | Example 434 | Example 435 | Example 436 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | $CO_2$ | $CO_2$ | $CO_2$ | $CO_2$ | $CO_2$ | $CO_2$ | $CO_2$ | $CO_2$ |
| Mean frictional coefficient 3 | | 0.106 | 0.108 | 0.110 | 0.110 | 0.119 | 0.121 | 0.116 | 0.117 |
| Mean oil temp. 3 (° C.) | | 46 | 46 | 47 | 48 | 48 | 49 | 51 | 52 |
| Abrasion loss 3 (mg) | | 9.3 | 9.1 | 9.2 | 9.7 | 9.8 | 9.7 | 10.0 | 10.2 |

TABLE 73

| | | Example 437 | Example 438 | Example 439 | Example 440 | Example 441 | Example 442 | Example 443 | Example 444 |
|---|---|---|---|---|---|---|---|---|---|
| Base oil | | Base oil 7 | Base oil 7 | Base oil 7 | Base oil 7 | Base oil 7 | Base oil 7 | Base oil 7 | Base oil 7 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R290 | R290 | R290 | R290 | R290 | R290 | R290 | R290 |
| Mean frictional coefficient 3 | | 0.093 | 0.094 | 0.094 | 0.095 | 0.103 | 0.101 | 0.099 | 0.101 |
| Mean oil temp. 3 (° C.) | | 44 | 44 | 46 | 45 | 47 | 49 | 50 | 50 |
| Abrasion loss 3 (mg) | | 7.6 | 7.7 | 8.0 | 8.3 | 8.4 | 8.3 | 8.5 | 8.6 |

TABLE 74

| | | Example 445 | Example 446 | Example 447 | Example 448 | Example 449 | Example 450 | Example 451 | Example 452 |
|---|---|---|---|---|---|---|---|---|---|
| Base oil | | Base oil 8 | Base oil 8 | Base oil 8 | Base oil 8 | Base oil 8 | Base oil 8 | Base oil 8 | Base oil 8 |
| Additive | A1 | 0.5 | 0.5 | 0.5 | 0.5 | 0.5 | 0.5 | 0.5 | 0.5 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R600a | R600a | R600a | R600a | R600a | R600a | R600a | R600a |
| Mean frictional coefficient 3 | | 0.105 | 0.108 | 0.109 | 0.107 | 0.123 | 0.121 | 0.119 | 0.118 |
| Mean oil temp. 3 (° C.) | | 48 | 49 | 50 | 50 | 51 | 53 | 55 | 54 |
| Abrasion loss 3 (mg) | | 7.8 | 7.5 | 7.9 | 8.4 | 8.6 | 8.5 | 8.8 | 8.8 |

The refrigerating machine oil compositions of Examples 126-133, Examples 181-188, Examples 236-243, Examples 291-298 and Examples 346-353 were subjected to the following evaluation tests. The row "Refrigerant" in Tables 46-50 shows the type of refrigerant used in the evaluation tests.

[Anti-Separation Property Test 2]

First, base oils 1-5 were used to prepare test solutions comprising 20 vol % of each base oil and 80 vol % of refrigerant, and the bilayer separation temperature of the base oil and refrigerant was measured. The obtained results were as follows.

Base oil 1 and R410A: 10° C.

Base oil 2 and $R^{134}$a: −35° C.

Base oil 3 and $R^{410}$A: −50° C.

Base oil 4 and R22: −8° C.

Base oil 5 and R134a: −45° C.

An anti-separation property evaluation test was then conducted according to JIS K 2211. Specifically, a test solution was prepared comprising 20 vol % of the refrigerating machine oil composition and 80 vol % of refrigerant, the test solution was cooled to a temperature of 5° C. higher than the bilayer separation temperature of the base oil in the composition, the outer appearance of the composition was visually observed, and the anti-separation property was evaluated based on the following scale. The results are shown in Tables 75-79.

A: Transparent

B: Slight cloudiness

C: Completely opaque

D: Separation of additives

[Stability Evaluation Test 2]

A shielded glass tube test was carried out according to JIS K 2211 using iron, copper and aluminum as catalysts, and the presence of sludge was observed after a period of 2 weeks at 175° C. The results are shown in Tables 75-79. Letter A in the tables indicates that no sludge was found, B indicates that a very small amount of sludge was found, and C indicates that a large amount of sludge was found.

TABLE 75

| | | Example 126 | Example 127 | Example 128 | Example 129 | Example 130 | Example 131 | Example 132 | Example 133 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A1 | 0.1 | 0.1 | 0.1 | 0.1 | 0.1 | 0.1 | 0.1 | 0.1 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Anti-separation property 2 | | A | A | A | B | B | B | B | A |
| Stability 2 | | A | A | A | A | A | A | A | B |

TABLE 76

| | | Example 181 | Example 182 | Example 183 | Example 184 | Example 185 | Example 186 | Example 187 | Example 188 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.1 | 0.1 | 0.1 | 0.1 | 0.1 | 0.1 | 0.1 | 0.1 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Anti-separation property 2 | | A | A | A | B | B | B | B | A |
| Stability 2 | | A | A | A | A | A | A | A | B |

TABLE 77

| | | Example 236 | Example 237 | Example 238 | Example 239 | Example 240 | Example 241 | Example 242 | Example 243 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | 0.1 | 0.1 | 0.1 | 0.1 | 0.1 | 0.1 | 0.1 | 0.1 |
| (wt %) | A2 | — | — | — | — | — | — | — | — |
| | A3 | — | — | — | — | — | — | — | — |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Anti-separation property 2 | | A | A | A | B | B | B | B | A |
| Stability 2 | | A | A | A | A | A | A | A | B |

TABLE 78

| | | Example 291 | Example 292 | Example 293 | Example 294 | Example 295 | Example 296 | Example 297 | Example 298 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive | A1 | 0.1 | 0.1 | 0.1 | 0.1 | 0.1 | 0.1 | 0.1 | 0.1 |
| (wt %) | A2 | | | | | | | | |
| | A3 | | | | | | | | |
| | B1 | 0.5 | | | | | | | |
| | B2 | | 0.5 | | | | | | |
| | B3 | | | 0.5 | | | | | |
| | B4 | | | | 0.5 | | | | |
| | B5 | | | | | 0.5 | | | |
| | B6 | | | | | | 0.5 | | |
| | B7 | | | | | | | 0.5 | |
| | B8 | | | | | | | | 0.5 |
| Refrigerant | | R134a | R134a | R134a | R134a | R134a | R134a | R134a | R134a |
| Anti-separation property 2 | | A | A | A | B | B | B | B | A |
| Stability 2 | | A | A | A | A | A | A | A | B |

TABLE 79

| | | Example 346 | Example 347 | Example 348 | Example 349 | Example 350 | Example 351 | Example 352 | Example 353 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive | A1 | 0.1 | 0.1 | 0.1 | 0.1 | 0.1 | 0.1 | 0.1 | 0.1 |
| (wt %) | A2 | — | — | — | — | — | — | — | — |
| | A3 | — | — | — | — | — | — | — | — |

TABLE 79-continued

| | | Example 346 | Example 347 | Example 348 | Example 349 | Example 350 | Example 351 | Example 352 | Example 353 |
|---|---|---|---|---|---|---|---|---|---|
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R22 | R22 | R22 | R22 | R22 | R22 | R22 | R22 |
| Anti-separation property 2 | | A | A | A | B | B | B | B | A |
| Stability 2 | | A | A | A | A | A | A | A | B |

[Friction Property Evaluation Test 2]

The frictional coefficients of the refrigerating machine oil compositions of Examples 174, 179, 230, 234, 284, 289, 339, 344, 394 and 399 were measured using an SRV tester by Optimol Inc., between a ½ inch SUJ2 steel ball and an SUJ2 disc (φ10 mm). The test conditions were a load of 100 N, an amplitude of 1 mm and a frequency of 25 Hz, and the frictional coefficient was recorded every second from the start of the test until 20 minutes thereafter, with the average being taken as the mean frictional coefficient (hereinafter referred to as "mean frictional coefficient 2". The refrigerant was circulated to the slide member at a flow rate of 10 L/h. The results are shown in Tables 80-81. In this test, the refrigerant type was selected depending on the type of base oil in the refrigerating machine oil composition. The refrigerant types used are shown in Tables 80-81.

TABLE 80

| | | Example 174 | Example 179 | Example 230 | Example 234 | Example 284 | Example 289 |
|---|---|---|---|---|---|---|---|
| Base oil | | Base oil 1 | Base oil 1 | Base oil 3 | Base oil 3 | Base oil 2 | Base oil 2 |
| Additive (wt %) | A1 | 0.1 | 0.1 | 0.1 | 0.1 | 0.1 | 0.1 |
| | A2 | — | — | — | — | — | — |
| | A3 | — | — | — | — | — | — |
| | B1 | 0.5 | 0.5 | — | — | 0.5 | 0.5 |
| | B2 | — | — | — | — | — | — |
| | B3 | — | — | 0.5 | 0.5 | — | — |
| | B4 | — | — | — | — | — | — |
| | B5 | — | — | — | — | — | — |
| | B6 | — | — | — | — | — | — |
| | B7 | — | — | — | — | — | — |
| | B8 | — | — | — | — | — | — |
| | C1 | — | 0.1 | — | 0.1 | — | 0.1 |
| | C2 | — | 0.5 | — | 0.5 | — | 0.5 |
| | C3 | 0.001 | 0.001 | 0.002 | 0.002 | 0.001 | 0.001 |
| Refrigerant | | R410A | R410A | R410A | R410A | R134a | R134a |
| Mean frictional coefficient 2 | | 0.110 | 0.095 | 0.118 | 0.105 | 0.131 | 0.119 |

TABLE 81

| | | Example 339 | Example 344 | Example 394 | Example 399 |
|---|---|---|---|---|---|
| Base oil | | Base oil 5 | Base oil 5 | Base oil 4 | Base oil 4 |
| Additive (wt %) | A1 | 0.1 | 0.1 | 0.1 | 0.1 |
| | A2 | — | — | — | — |
| | A3 | — | — | — | — |
| | B1 | 0.5 | 0.5 | 0.5 | 0.5 |
| | B2 | — | — | — | — |
| | B3 | — | — | — | — |
| | B4 | — | — | — | — |
| | B5 | — | — | — | — |
| | B6 | — | — | — | — |

TABLE 81-continued

| | | Example 339 | Example 344 | Example 394 | Example 399 |
|---|---|---|---|---|---|
| | B7 | — | — | — | — |
| | B8 | — | — | — | — |
| | C1 | — | 0.1 | — | 0.1 |
| | C2 | — | 0.5 | — | 0.5 |
| | C3 | 0.001 | 0.001 | 0.001 | 0.001 |
| Refrigerant | | R134a | R134a | R22 | R22 |
| Mean frictional coefficient 2 | | 0.139 | 0.128 | 0.118 | 0.107 |

[Examples 453-463]

Base oils 1-5 and additives A1, A4, B2, B4 and B6 were used to prepare the refrigerating machine oil compositions shown in Table 82.

[Anti-Sludge Property Evaluation Test]

The anti-sludge property of each of the refrigerating machine oil compositions of Examples 453-463 was measured by the following procedure. First, 1 g of chlorinated processed oil was added with respect to 99 g of the refrigerating machine oil composition. The water content of the test oil was adjusted to 100 ppm for Example 279 and Comparative Example 64, and to 500 ppm for all the other examples.

Next, 100 g of the test oil was placed in a 300 ml autoclave together with each iron, copper or aluminum catalyst (1 mmϕ×10 cm each), and after deairing the autoclave, it was filled with 50 g of refrigerant. The combinations of refrigerating machine oil compositions and refrigerants are shown in Table 82. Each autoclave was held at 150° C. for 14 days, and the presence of sludge was observed after the test. The results are shown in Table 82. Letter A in the tables indicates that no sludge was found, and B indicates that sludge was found.

TABLE 82

| | | Example 453 | Example 454 | Example 456 | Example 457 | Example 458 | Example 459 | Example 460 | Example 461 | Example 462 | Example 463 |
|---|---|---|---|---|---|---|---|---|---|---|---|
| Base oil | | Base oil 1 | Base oil 1 | Base oil 2 | Base oil 2 | Base oil 3 | Base oil 3 | Base oil 4 | Base oil 4 | Base oil 5 | Base oil 5 |
| Additive | A1 | — | 0.5 | — | 0.5 | — | 0.5 | — | 0.5 | — | 0.5 |
| (wt %) | A4 | 0.5 | — | 0.5 | — | 0.5 | — | 0.5 | — | 0.5 | — |
| | B2 | 0.5 | 0.5 | — | — | 0.5 | 0.5 | — | — | 0.5 | 0.5 |
| | B6 | — | — | 0.5 | 0.5 | — | — | 0.5 | 0.5 | — | — |
| Refrigerant | | R410A | R410A | R134a | R134a | R410A | R410A | R22 | R22 | R134a | R134a |
| Anti-sludge property | | A | B | A | B | A | B | A | B | A | B |

[Examples 464-569]

For Examples 464-569, base oils 1-8 and additives A1, A4 and B1-B8 were used to prepare the refrigerating machine oil compositions shown in Tables 83-94 below. These refrigerating machine oil compositions contained both tricresyl phosphate (A1) and triphenyl phosphorothionate (A4) as essential components.

Next, each of the refrigerating machine oil compositions of Examples 464-569 were subjected to the evaluation tests described below. The row "Refrigerant" in Tables 83-94 shows the type of refrigerant used in the evaluation test.

[Friction Property and Abrasion Property Evaluation Test 1]

The slide member of a FALEX Tester (ASTM D2714) was set in a pressure-resistant vessel, the refrigerant was introduced into the vessel, and a FALEX test was carried out under the following conditions.

Test materials: Steel ring, steel block

Test initial temperature: 80° C.

Test time: 1 hr

Sliding speed: 0.5 m/s

Load: 1250 N

Refrigerant atmosphere pressure: 500 kPa.

The frictional coefficient and oil temperature. were measured every other second after the start of the FALEX test, and the mean values were calculated (hereinafter referred to as "mean frictional coefficient 1" and "mean oil temperature 1"). The block abrasion loss after completion of the test was determined in terms of volume reduction (hereinafter referred to as "abrasion volume 1"). The results are shown in Tables 83-94.

[Friction Property and Abrasion Property Evaluation Test 3]

A FALEX test (ASTM D2670) was conducted under the following conditions while blowing the refrigerant into the refrigerating machine oil composition.

Test initial temperature: 25° C.

Test time: 30 min

Load: 1334 N

Refrigerant blow-in rate: 10 L/h

The frictional coefficient and oil temperature were measured every other second after the start of the FALEX test, and the mean values were calculated (hereinafter referred to as "mean frictional coefficient 3" and "mean oil temperature 3"). The weights of the pin and block were measured after completion of the test, and the abrasion loss was determined in terms of weight reduction (hereinafter referred to as "abrasion loss 3"). The results are shown in Tables 83-94.

TABLE 83

| | | Example 464 | Example 465 | Example 466 | Example 467 | Example 468 | Example 469 | Example 470 | Example 471 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 1 | | 0.11 | 0.10 | 0.14 | 0.13 | 0.15 | 0.15 | 0.14 | 0.14 |
| Mean oil temp. 1 (° C.) | | 84 | 85 | 85 | 94 | 95 | 93 | 92 | 91 |
| Abrasion volume 1 ($mm^3$) | | 1.7 | 1.9 | 2.0 | 2.3 | 2.4 | 2.4 | 2.5 | 2.6 |
| Mean frictional coefficient 3 | | 0.102 | 0.101 | 0.103 | 0.101 | 0.111 | 0.112 | 0.109 | 0.110 |
| Mean oil temp. (° C.) 3 | | 45 | 45 | 47 | 46 | 46 | 52 | 50 | 50 |
| Abrasion loss 3 (mg) | | 7.0 | 6.9 | 7.2 | 7.8 | 8.1 | 8.0 | 8.2 | 8.1 |

TABLE 84

| | | Example 472 | Example 473 | Example 474 | Example 475 | Example 476 | Example 477 | Example 478 | Example 479 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R410A | R410A | R410A | R410A | R410A | R410A | R410A | R410A |
| Mean frictional coefficient 1 | | 0.12 | 0.13 | 0.12 | 0.11 | 0.14 | 0.15 | 0.12 | 0.14 |
| Mean oil temp. 1 (° C.) | | 94 | 92 | 91 | 91 | 93 | 93 | 94 | 92 |
| Abrasion volume 1 ($mm^3$) | | 2.2 | 2.4 | 2.5 | 2.7 | 2.9 | 2.8 | 3.0 | 2.9 |
| Mean frictional coefficient 3 | | 0.104 | 0.106 | 0.109 | 0.105 | 0.117 | 0.116 | 0.114 | 0.110 |
| Mean oil temp. 3 (° C.) | | 44 | 46 | 46 | 46 | 43 | 46 | 47 | 48 |
| Abrasion loss 3 (mg) | | 8.1 | 7.8 | 8.2 | 8.8 | 8.9 | 9.0 | 9.3 | 9.4 |

TABLE 85

| | | Example 480 | Example 481 | Example 482 | Example 483 | Example 484 | Example 485 | Example 486 | Example 487 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 1 | | 0.10 | 0.13 | 0.12 | 0.13 | 0.16 | 0.17 | 0.18 | 0.17 |
| Mean oil temp. 1 (° C.) | | 85 | 86 | 86 | 92 | 91 | 94 | 93 | 93 |

TABLE 85-continued

| | Example 480 | Example 481 | Example 482 | Example 483 | Example 484 | Example 485 | Example 486 | Example 487 |
|---|---|---|---|---|---|---|---|---|
| Abrasion volume 1 ($mm^3$) | 2.6 | 2.8 | 2.9 | 2.8 | 3.0 | 3.3 | 3.1 | 3.0 |
| Mean frictional coefficient 3 | 0.104 | 0.110 | 0.108 | 0.108 | 0.120 | 0.123 | 0.115 | 0.117 |
| Mean oil temp. 3 (° C.) | 47 | 48 | 47 | 48 | 47 | 51 | 49 | 50 |
| Abrasion loss 3 (mg) | 7.6 | 8.3 | 8.5 | 8.7 | 9.0 | 8.9 | 8.8 | 9.1 |

TABLE 86

| | | Example 488 | Example 489 | Example 500 | Example 501 | Example 502 | Example 503 | Example 504 | Example 505 |
|---|---|---|---|---|---|---|---|---|---|
| Base oil | | Base oil 5 | Base oil 5 | Base oil 5 | Base oil 5 | Base oil 5 | Base oil 5 | Base oil 5 | Base oil 5 |
| Additive (wt %) | A1 | 0.5 | 0.5 | 0.5 | 0.5 | 0.5 | 0.5 | 0.5 | 0.5 |
| | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R134a | R134a | R134a | R134a | R134a | R134a | R134a | R134a |
| Mean frictional coefficient 1 | | 0.11 | 0.13 | 0.13 | 0.13 | 0.15 | 0.16 | 0.15 | 0.13 |
| Mean oil temp. 1 (° C.) | | 84 | 85 | 87 | 91 | 90 | 90 | 89 | 90 |
| Abrasion volume 1 ($mm^3$) | | 2.8 | 2.9 | 2.8 | 3.6 | 3.5 | 3.4 | 3.5 | 3.2 |
| Mean frictional coefficient 3 | | 0.106 | 0.111 | 0.108 | 0.107 | 0.115 | 0.116 | 0.110 | 0.112 |
| Mean oil temp. 3 (° C.) | | 44 | 45 | 45 | 45 | 46 | 48 | 49 | 48 |
| Abrasion loss 3 (mg) | | 9.3 | 9.5 | 9.5 | 9.9 | 10.3 | 10.4 | 10.3 | 10.0 |

TABLE 87

| | | Example 506 | Example 507 | Example 508 | Example 509 | Example 510 | Example 511 | Example 512 | Example 513 |
|---|---|---|---|---|---|---|---|---|---|
| Base oil | | Base oil 4 | Base oil 4 | Base oil 4 | Base oil 4 | Base oil 4 | Base oil 4 | Base oil 4 | Base oil 4 |
| Additive (wt %) | A1 | 0.5 | 0.5 | 0.5 | 0.5 | 0.5 | 0.5 | 0.5 | 0.5 |
| | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R22 | R22 | R22 | R22 | R22 | R22 | R22 | R22 |
| Mean frictional coefficient 1 | | 0.10 | 0.11 | 0.12 | 0.11 | 0.13 | 0.12 | 0.13 | 0.14 |
| Mean oil temp. 1 (° C.) | | 84 | 85 | 86 | 87 | 87 | 86 | 88 | 91 |
| Abrasion volume 1 ($mm^3$) | | 1.6 | 1.8 | 1.7 | 1.9 | 2.0 | 2.0 | 1.8 | 2.01 |
| Mean frictional coefficient 3 | | 0.111 | 0.113 | 0.114 | 0.111 | 0.120 | 0.119 | 0.114 | 0.116 |
| Mean oil temp. 3 (° C.) | | 47 | 48 | 49 | 48 | 47 | 50 | 51 | 51 |
| Abrasion loss 3 (mg) | | 7.6 | 7.8 | 7.7 | 8.2 | 8.3 | 8.2 | 8.4 | 8.5 |

TABLE 88

| | | Example 514 | Example 515 | Example 516 | Example 517 | Example 518 | Example 519 | Example 520 | Example 521 |
|---|---|---|---|---|---|---|---|---|---|
| Base oil | | Base oil 1 | Base oil 1 | Base oil 1 | Base oil 1 | Base oil 1 | Base oil 1 | Base oil 1 | Base oil 1 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R407C | R407C | R407C | R407C | R407C | R407C | R407C | R407C |
| Mean frictional coefficient 1 | | 0.11 | 0.10 | 0.13 | 0.13 | 0.15 | 0.14 | 0.14 | 0.14 |
| Mean oil temp. 1 (° C.) | | 84 | 85 | 85 | 92 | 92 | 91 | 92 | 90 |
| Abrasion volume 1 ($mm^3$) | | 1.1 | 1.2 | 1.4 | 1.8 | 1.9 | 1.9 | 2.0 | 2.1 |
| Mean frictional coefficient 3 | | 0.102 | 0.102 | 0.103 | 0.103 | 0.115 | 0.113 | 0.107 | 0.110 |
| Mean oil temp. 3 (° C.) | | 45 | 45 | 46 | 46 | 47 | 50 | 50 | 51 |
| Abrasion loss 3 (mg) | | 7.0 | 7.2 | 7.6 | 7.8 | 8.3 | 8.0 | 8.2 | 8.3 |

TABLE 89

| | | Example 522 | Example 523 | Example 524 | Example 525 | Example 526 | Example 527 | Example 528 | Example 529 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R407C | R407C | R407C | R407C | R407C | R407C | R407C | R407C |
| Mean frictional coefficient 1 | | 0.12 | 0.13 | 0.12 | 0.11 | 0.14 | 0.14 | 0.12 | 0.14 |
| Mean oil temp. 1 (° C.) | | 92 | 92 | 91 | 91 | 93 | 93 | 93 | 92 |
| Abrasion volume 1 ($mm^3$) | | 1.8 | 2.0 | 2.1 | 2.2 | 2.5 | 2.6 | 2.8 | 2.7 |
| Mean frictional coefficient 3 | | 0.106 | 0.106 | 0.107 | 0.107 | 0.113 | 0.114 | 0.112 | 0.113 |
| Mean oil temp. 3 (° C.) | | 45 | 46 | 46 | 46 | 47 | 47 | 49 | 50 |
| Abrasion loss 3 (mg) | | 8.0 | 8.2 | 8.5 | 8.8 | 9.2 | 9.1 | 9.3 | 9.2 |

TABLE 90

| | | Example 530 | Example 531 | Example 532 | Example 533 | Example 534 | Example 535 | Example 536 | Example 537 |
|---|---|---|---|---|---|---|---|---|---|
| Base oil | | Base oil 2 | Base oil 2 | Base oil 2 | Base oil 2 | Base oil 2 | Base oil 2 | Base oil 2 | Base oil 2 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |

TABLE 90-continued

| | Example 530 | Example 531 | Example 532 | Example 533 | Example 534 | Example 535 | Example 536 | Example 537 |
|---|---|---|---|---|---|---|---|---|
| Refrigerant | CO2 | CO2 | CO2 | CO2 | CO2 | CO2 | CO2 | CO2 |
| Mean frictional coefficient 1 | 0.10 | 0.13 | 0.12 | 0.13 | 0.15 | 0.16 | 0.17 | 0.16 |
| Mean oil temp. 1 (° C.) | 85 | 86 | 86 | 91 | 91 | 92 | 93 | 91 |
| Abrasion volume 1 ($mm^3$) | 2.3 | 2.5 | 2.5 | 2.6 | 2.7 | 2.9 | 2.7 | 2.8 |
| Mean frictional coefficient 3 | 0.103 | 0.105 | 0.108 | 0.109 | 0.118 | 0.121 | 0.113 | 0.112 |
| Mean oil temp. 3 (° C.) | 48 | 49 | 49 | 49 | 50 | 51 | 51 | 52 |
| Abrasion loss 3 (mg) | 7.7 | 8.6 | 8.3 | 9.0 | 9.1 | 9.3 | 9.2 | 9.4 |

TABLE 91

| | | Example 538 | Example 539 | Example 540 | Example 541 | Example 542 | Example 543 | Example 544 | Example 545 |
|---|---|---|---|---|---|---|---|---|---|
| Base oil | | Base oil 6 | Base oil 6 | Base oil 6 | Base oil 6 | Base oil 6 | Base oil 6 | Base oil 6 | Base oil 6 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | CO2 | CO2 | CO2 | CO2 | CO2 | CO2 | CO2 | CO2 |
| Mean frictional coefficient 1 | | 0.12 | 0.11 | 0.13 | 0.14 | 0.10 | 0.13 | 0.14 | 0.13 |
| Mean oil temp. 1 (° C.) | | 84 | 85 | 85 | 91 | 92 | 91 | 92 | 90 |
| Abrasion volume 1 ($mm^3$) | | 1.2 | 1.2 | 1.4 | 1.9 | 2.0 | 1.9 | 2.2 | 2.2 |
| Mean frictional coefficient 3 | | 0.111 | 0.112 | 0.113 | 0.114 | 0.119 | 0.120 | 0.118 | 0.119 |
| Mean oil temp. 3 (° C.) | | 47 | 46 | 47 | 48 | 49 | 50 | 51 | 52 |
| Abrasion loss 3 (mg) | | 7.5 | 7.3 | 7.8 | 8.2 | 8.4 | 8.3 | 8.4 | 8.5 |

TABLE 92

| | | Example 546 | Example 547 | Example 548 | Example 549 | Example 550 | Example 551 | Example 552 | Example 553 |
|---|---|---|---|---|---|---|---|---|---|
| Base oil | | Base oil 3 | Base oil 3 | Base oil 3 | Base oil 3 | Base oil 3 | Base oil 3 | Base oil 3 | Base oil 3 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | $CO_2$ | $CO_2$ | $CO_2$ | $CO_2$ | $CO_2$ | $CO_2$ | $CO_2$ | $CO_2$ |
| Mean frictional coefficient 1 | | 0.12 | 0.13 | 0.12 | 0.11 | 0.14 | 0.14 | 0.12 | 0.13 |
| Mean oil temp. 1 (° C.) | | 92 | 92 | 91 | 91 | 93 | 93 | 94 | 92 |
| Abrasion volume 1 ($mm^3$) | | 1.8 | 2.2 | 2.2 | 2.4 | 2.5 | 2.4 | 2.7 | 2.5 |
| Mean frictional coefficient 3 | | 0.106 | 0.108 | 0.110 | 0.110 | 0.117 | 0.117 | 0.114 | 0.115 |
| Mean oil temp. 3 (° C.) | | 46 | 46 | 47 | 48 | 48 | 49 | 50 | 51 |

TABLE 92-continued

| | Example 546 | Example 547 | Example 548 | Example 549 | Example 550 | Example 551 | Example 552 | Example 553 |
|---|---|---|---|---|---|---|---|---|
| Abrasion loss 3 (mg) | 8.1 | 8.1 | 8.2 | 8.8 | 8.9 | 8.7 | 8.9 | 9.0 |

TABLE 93

| | | Example 554 | Example 555 | Example 556 | Example 557 | Example 558 | Example 559 | Example 560 | Example 561 |
|---|---|---|---|---|---|---|---|---|---|
| Base oil | | Base oil 7 | Base oil 7 | Base oil 7 | Base oil 7 | Base oil 7 | Base oil 7 | Base oil 7 | Base oil 7 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R290 | R290 | R290 | R290 | R290 | R290 | R290 | R290 |
| Mean frictional coefficient 1 | | 0.13 | 0.14 | 0.13 | 0.12 | 0.15 | 0.15 | 0.13 | 0.14 |
| Mean oil temp. 1 (° C.) | | 92 | 92 | 91 | 91 | 93 | 93 | 94 | 92 |
| Abrasion volume 1 ($mm^3$) | | 1.7 | 2.0 | 2.1 | 2.2 | 2.3 | 2.2 | 2.4 | 2.3 |
| Mean frictional coefficient 3 | | 0.093 | 0.094 | 0.094 | 0.095 | 0.102 | 0.101 | 0.099 | 0.100 |
| Mean oil temp. 3 (° C.) | | 44 | 44 | 46 | 45 | 47 | 48 | 49 | 50 |
| Abrasion loss 3 (mg) | | 7.1 | 7.2 | 7.5 | 7.8 | 8.0 | 7.8 | 8.0 | 8.1 |

TABLE 94

| | | Example 562 | Example 563 | Example 564 | Example 565 | Example 566 | Example 567 | Example 568 | Example 569 |
|---|---|---|---|---|---|---|---|---|---|
| Base oil | | Base oil 8 | Base oil 8 | Base oil 8 | Base oil 8 | Base oil 8 | Base oil 8 | Base oil 8 | Base oil 8 |
| Additive | A1 | 0.5 | 0.5 | 0.5 | 0.5 | 0.5 | 0.5 | 0.5 | 0.5 |
| (wt %) | A4 | 0.5 | 0.5 | 0.5 | 0.5 | 0.5 | 0.5 | 0.5 | 0.5 |
| | B1 | 0.5 | — | — | — | — | — | — | — |
| | B2 | — | 0.5 | — | — | — | — | — | — |
| | B3 | — | — | 0.5 | — | — | — | — | — |
| | B4 | — | — | — | 0.5 | — | — | — | — |
| | B5 | — | — | — | — | 0.5 | — | — | — |
| | B6 | — | — | — | — | — | 0.5 | — | — |
| | B7 | — | — | — | — | — | — | 0.5 | — |
| | B8 | — | — | — | — | — | — | — | 0.5 |
| Refrigerant | | R600a | R600a | R600a | R600a | R600a | R600a | R600a | R600a |
| Mean frictional coefficient 1 | | 0.11 | 0.11 | 0.12 | 0.11 | 0.12 | 0.12 | 0.12 | 0.12 |
| Mean oil temp. 1 (° C.) | | 92 | 92 | 91 | 91 | 93 | 93 | 94 | 92 |
| Abrasion volume 1 ($mm^3$) | | 1.9 | 2.3 | 2.3 | 2.4 | 2.6 | 2.4 | 2.8 | 2.6 |
| Mean frictional coefficient 3 | | 0.105 | 0.108 | 0.109 | 0.107 | 0.120 | 0.119 | 0.118 | 0.116 |
| Mean oil temp. 3 (° C.) | | 48 | 49 | 50 | 50 | 51 | 51 | 54 | 53 |
| Abrasion loss 3 (mg) | | 7.1 | 6.9 | 7.2 | 7.8 | 8.1 | 8.0 | 8.1 | 8.2 |

The invention claimed is:

1. A refrigerating machine oil composition, consisting of:

a base oil consisting of at least one type base oil selected from the group consisting of mineral oils, hydrocarbon-based oils, aromatic esters, esters of C5-C10 linear aliphatic dibasic acids, complex esters, carbonic acid esters, polyvinyl ethers, ketones, polyphenyl ethers, silicones, polysiloxanes, and perfluoroethers wherein a kinematic viscosity of the base oil ranges from 12 $mm^2/s$ to 195 $mm^2/s$ at 40 ° C.;

a phosphorothionate selected from tricresyl phosphorothionate, triphenyl phosphorothionate, and tri(n-octyl) phosphorothionate;

a phosphorus-based extreme pressure agent other than said phosphorothionate selected from tricresyl phosphate, triphenyl phosphate, and tri(n-octyl) phosphate; and an oil agent selected from butyl stearate, diisobutyl adipate, diisodecyl adipate, glycerin monooleate, glycerin trioleate, oleyl alcohol, and glyceryl ether, and optionally a benzotriazole and/or its derivative, an epoxy compound, a phenol-based antioxidant, an amine-based antioxidant, an anti-abrasion agent, a chlorinated paraffin, a sulfur-based extreme pressure agent, an antifoaming agent, a visocisty index improver, a pour point depressant, and a detergent dispersant.

2. A refrigerating machine oil composition according to claim 1, wherein the content of the epoxy compound is 0.1-5.0 wt % based on the total weight of the composition.

3. A refrigerating machine oil composition according to claim 1, wherein said oil agent contains at least one type selected from among esters of linear dibasic acids and monohydric alcohols.

4. A refrigerating machine oil composition according to claim 1, wherein the content of said oil agent is 0.1-5.0 wt % based on the total weight of the composition.

5. A refrigerating machine oil composition according to claim 1, wherein said base oil contains at least one type selected from among esters of polyhydric alcohols and monobasic fatty acids, and said oil agent contains at least one selected from among esters of linear dibasic acids and monohydric alcohols.

6. A refrigerating machine oil composition, consisting of:

a base oil consisting of at least one type base oil selected from the group consisting of mineral oils, hydrocarbon-based oils, aromatic esters, esters of C5-C10 linear aliphatic dibasic acids, complex esters, carbonic acid esters, polyvinyl ethers, ketones, polyphenyl ethers, silicones, polysiloxanes, and perfluoroethers;

a phosphorus-based extreme pressure agent; and at least one oil agent selected from butyl stearate, diisobutyl adipate, diisodecyl adipate, glycerin monooleate, glycerin trioleate, oleyl alcohol, and glyceryl ether, and optionally a benzotriazole and/or its derivative, an epoxy compound, a phenol-based antioxidant, an amine-based antioxidant, an anti-abrasion agent, a chlorinated paraffin, a sulfur-based extreme pressure agent, an antifoaming agent, a visocisty index improver, a pour point depressant, and a detergent dispersant, wherein the content of said phosphrous-based extreme pressure agent is 0.1-5.0 wt % based on a total weight of the composition, and wherein the content of said oil agent is 0.1-5.0 wt % based on the total weight of the composition.

7. A refrigerating machine oil composition according to claim 6, wherein said phosphorus-based extreme pressure agent contains a phosphorothionate.

8. A refrigerating machine oil composition according to claim 6, wherein said phosphorus-based extreme pressure agent contains both a phosphorothionate and a phosphorus-based extreme pressure agent other than said phosphorothionate.

9. A refrigerating machine oil composition according to claim 6, wherein the content of said epoxy compound is 0.1-5.0 wt % based on the total weight of the composition.

10. A refrigerating machine oil composition according to claim 1, wherein a pour point of the base oil ranges from −40° C. to −25° C.

* * * * *